US012478221B2

(12) United States Patent
Van Varick et al.

(10) Patent No.: US 12,478,221 B2
(45) **Date of Patent: *Nov. 25, 2025**

(54) SHOWER CHAIR WITH ERGONOMIC SUPPORT AND WASHDOWN FEATURES

(71) Applicant: CVS Pharmacy, Inc., Woonsocket, RI (US)

(72) Inventors: Robert Beale Van Varick, Yardley, PA (US); Donald Samuel Strum, Princeton, NJ (US); George Benjamin Wintner, Brooklyn, NY (US); Ryan Crist, McFarland, WI (US); Gregory P. Allison, Allentown, PA (US)

(73) Assignee: CVS Pharmacy, Inc., Woonsocket, RI (US)

( * ) Notice: Subject to any disclaimer, the term of this patent is extended or adjusted under 35 U.S.C. 154(b) by 194 days.

This patent is subject to a terminal disclaimer.

(21) Appl. No.: 18/238,284

(22) Filed: Aug. 25, 2023

(65) Prior Publication Data

US 2023/0397775 A1 Dec. 14, 2023

Related U.S. Application Data

(63) Continuation of application No. 17/404,700, filed on Aug. 17, 2021, now Pat. No. 11,771,269.

(Continued)

(51) Int. Cl.
*A47K 3/28* (2006.01)
*A47C 4/02* (2006.01)

(52) U.S. Cl.
CPC ..... *A47K 3/282* (2013.01); *A47C 4/02* (2013.01)

(58) Field of Classification Search
CPC .... A47C 3/04; A47C 5/04; A47C 4/02; A47K 3/282

(Continued)

(56) References Cited

U.S. PATENT DOCUMENTS 1,603,379 A 10/1926 Dautrick
2,022,718 A 12/1935 Heins (Continued)

FOREIGN PATENT DOCUMENTS

CN 104244784 12/2014
CN 107361673 11/2017

(Continued)

OTHER PUBLICATIONS

Notice of Allowance with English Translation for China Patent Application No. 202110945800.0, dated Aug. 24, 2024 6 pages.

(Continued)

*Primary Examiner* — Jose V Chen
(74) *Attorney, Agent, or Firm* — Sheridan Ross P.C.

(57) ABSTRACT

An improved shower chair having washdown surfaces, reconfigurable arrangements, and enhanced safety features. The shower chair includes a backrest that removably attaches to an underside of the shower chair offset from, and arranged below, a seat pan. Removing the backrest exposes an upper support crossbar that runs from one side of the shower chair to the other. The washdown surfaces include a sloped surface arranged in the seat pan that is angled downward from a front of the shower chair toward a rear of the shower chair and a sloped surface arranged in the backrest of the shower chair angled from a rear of the shower chair toward a front of the shower chair under the seat pan. The washdown surfaces provide an unrestricted fluid flow path running from the seat pan to the backrest and then to the floor.

20 Claims, 37 Drawing Sheets

Related U.S. Application Data

(60) Provisional application No. 63/066,555, filed on Aug. 17, 2020.

(58) Field of Classification Search
USPC ..... 297/448.1, 451.1, 16.1
See application file for complete search history.

(56) References Cited

U.S. PATENT DOCUMENTS

| | | | | |
|---|---|---|---|---|
| 2,981,319 | A | 4/1961 | Close | |
| 3,111,344 | A | 11/1963 | Hoven et al. | |
| 3,965,564 | A | 6/1976 | Slovensky | |
| 4,193,147 | A | 3/1980 | Fischer | |
| 4,388,038 | A | 6/1983 | Freitag | |
| 4,489,981 | A | 12/1984 | Goletski | |
| 5,068,927 | A | 12/1991 | Massaro | |
| 5,517,704 | A | 5/1996 | Dagostino | |
| 5,536,068 | A | 7/1996 | Valentor et al. | |
| 5,685,035 | A | 11/1997 | Urness et al. | |
| 6,279,933 | B1 | 8/2001 | Ross et al. | |
| D478,752 | S | 8/2003 | Gilbert et al. | |
| 6,974,191 | B2 | 12/2005 | Serhan | |
| 7,032,970 | B1 | 4/2006 | Kharat | |
| 7,549,702 | B2 * | 6/2009 | Meyers | A47K 3/122 297/53 |
| 7,677,259 | B1 | 3/2010 | Arbuckle et al. | |
| 7,775,600 | B2 * | 8/2010 | Battey | A47C 7/32 297/440.15 |
| 8,646,843 | B2 | 2/2014 | Koch | |
| D812,389 | S | 3/2018 | Pong | |
| D867,779 | S | 11/2019 | Chang | |
| 11,013,373 | B1 * | 5/2021 | Lumpkin | A61H 33/601 |
| 11,771,269 | B2 * | 10/2023 | Van Varick | A47C 4/02 297/16.1 |
| 2003/0102700 | A1 | 6/2003 | Lin | |
| 2004/0070238 | A1 | 4/2004 | Moser et al. | |
| 2009/0193576 | A1 | 8/2009 | Hsiao | |
| 2010/0258152 | A1 | 10/2010 | Lin et al. | |
| 2015/0328069 | A1 | 11/2015 | Staggs | |
| 2020/0093665 | A1 | 3/2020 | Schwab | |
| 2021/0145218 | A1 * | 5/2021 | Shyka | A61H 1/00 |
| 2022/0378253 | A1 * | 12/2022 | Williams | A47C 11/005 |

FOREIGN PATENT DOCUMENTS

| | | |
|---|---|---|
| DE | 102008037434 | 7/2011 |
| WO | WO 2018/017666 | 1/2018 |

OTHER PUBLICATIONS

Notice of Acceptance (with English translation) for Chinese Patent Application No. 202130819155.9, dated Mar. 2, 2022 , 4 pages.
Notice of Allowance for U.S. Appl. No. 17/404,700, dated May 17, 2023, 9 pages.
CVS Health Convertible Shower Chair and Stool by Michael Graves Design, from cbvs.com, Earliest Public review Date: 2022, 7 pages, Retrieved online Apr. 25, 2024 from: www.cvs.com/shop/cvs-health-convertible-shower-chair-and-stool-by-michael-graves-design-prodid-656286.
Official Action with Machine Translation for China Patent Application No. 202110945800.0, dated Feb. 29, 2024 8 pages.
Official Action for U.S. Appl. No. 29/815,915, dated Feb. 20, 2024 5 pages Restriction Requirement.
Notice of Allowance for U.S. Appl. No. 29/818,915, dated May 8, 2024 8 pages.

* cited by examiner

SHOWER CHAIR WITH ERGONOMIC SUPPORT AND WASHDOWN FEATURES

CROSS-REFERENCE TO RELATED APPLICATIONS

The present application is a continuation of U.S. patent application Ser. No. 17/404,700, filed on Aug. 17, 2021, entitled "SHOWER CHAIR WITH ERGONOMIC SUPPORT AND WASHDOWN FEATURES", which claims the benefit of and priority, under 35 U.S.C. § 119(e), to U.S. Provisional Application Ser. No. 63/066,555, filed on Aug. 17, 2020, entitled "SHOWER CHAIR WITH ERGONOMIC ADJUSTMENT FEATURES," the entire disclosures of each are incorporated herein by reference, in their entireties, for all that they teach and for all purposes.

BACKGROUND

The present disclosure is generally directed to chairs and, in particular, toward shower chairs including ergonomic features.

Shower chairs are designed to provide people of all abilities with the opportunity to shower or bathe while seated. As can be appreciated, the ability to rest while cleaning may be beneficial to most people and especially to those who may be undergoing physical therapy, who may have limited strength, or who may have some type of disability.

Conventional shower chairs, however, fail to address a number of needs and desires associated with a wide range of users. Most shower chairs have been designed with basic molded plastics and cheap round aluminum tubing. These basic utilitarian designs result in a sterile medical scaffolding construction and there are few, if any, options for different colors, functions, supports, or arrangements of the shower chair.

Moreover, these traditional designs require complex and cumbersome adjustments between users of different sizes. For instance, the overall seat height of these shower chairs must be adjusted beforehand to fit a particular height of a user. This process generally includes individually setting a length of each leg of the shower chair. Once the length is set, each of the legs must be separately locked and/or fastened in place. When the height of users of the shower chair varies between uses, this repeated seat-height adjustment process can be tedious and painful. As a result, an uncomfortable "middle" height may be permanently set for the shower chair. Because this middle height may be too high for one user and too short for another user, the safety and comfort of each user is sacrificed in the process.

BRIEF SUMMARY

It is with respect to the above issues and other problems that the examples presented herein were contemplated. The present disclosure provides a shower chair having a clean, modern, and elegant construction that comprises a number of enhanced comfort, safety, and support features. These features include, but are in no way limited to, ergonomic contact surfaces, a removeable backrest, an integrated carry handle, a concealed retractable shower sprayer holder, smooth sloped washdown faces, comfort rounded seat and backrest, wide gripped nonslip feet, and/or the like. In some examples a shower chair is provided having a quick seat-height adjustment system and/or optional moveable/removeable arm rests.

In one aspect, a shower chair includes a leg assembly, comprising: a first leg frame disposed on a first side of the shower chair; and a second leg frame disposed on a second side of the shower chair opposite the first side, the second leg frame spaced apart a width from the first leg frame, wherein the first leg frame and the second leg frame each comprise a front leg tube and a rear leg tube and a seat contact tube joining the front leg tube to the rear leg tube; a lower support crossbar connected to a bottom surface of the seat contact tube of the first leg frame and the second leg frame and spanning the width; a seat pan comprising a seating side and a frame attachment side disposed opposite the seating side, wherein a portion of the seat pan on the frame attachment side is connected to an upper surface of the seat contact tube of the first leg frame and the second leg frame; and a backrest comprising a first end detachably connected to the lower support crossbar offset a distance from the seat pan on the frame attachment side and extending from the lower support crossbar past the seating side of the seat pan toward a second end of the backrest disposed at a rear of the shower chair.

Examples of the shower chair above may include one of the following features or any combination thereof. The seat pan comprises a sloped surface angled downward from a first point at a front of the shower chair to a second point at the rear of the shower chair. The backrest comprises a sloped arcuate surface disposed adjacent the first end and angled downward from the rear of the shower chair toward the front of the shower chair. A first gap is disposed between the seat pan at the backrest at the second point, and wherein a second gap is disposed between the first end of the backrest and the lower support crossbar providing an unrestricted water flow path for the shower chair running from the seat pan at the front of the shower chair toward the rear of the shower chair and then from the backrest at the rear of the shower chair toward the front of the shower chair in a space between the seat pan and the first end of the backrest. The first leg frame and the second leg frame each comprise an angled tube joined with and extending from the rear leg tube, and wherein the shower chair further comprises: an upper support crossbar disposed at the rear of the shower chair and spanning from the first leg frame to the second leg frame, wherein the upper support crossbar comprises a first post connected to the angled tube of the first leg frame and a second post connected to the angled tube of the second leg frame. The first post is disposed at least partially inside the angled tube of the first leg frame and a second post is disposed at least partially inside the angled tube of the second leg frame, and wherein an axis of the first post is arranged orthogonal to an axis of the upper support crossbar spanning from the first leg frame to the second leg frame. A portion of a rear surface of the backrest contacts the upper support crossbar, wherein the backrest comprises at least one mount hook that hooks onto the upper support crossbar, and wherein the first end detachably connected to the lower support crossbar is attached via at least one fastener. The first leg frame and the second leg frame each comprise a front leg attached to the front leg tube and a rear leg attached to the rear leg. The front leg tube and the rear leg tube each comprise a slot-shaped receptacle, wherein a first end of the front leg is disposed in the slot-shaped receptacle of the front leg tube, and wherein a first end of the rear leg is disposed in the slot-shaped receptacle of the rear leg tube. A second end of the front leg disposed opposite the first end of the front leg comprises a front compliant foot, and wherein a second end of the rear leg disposed opposite the first end of the rear leg comprises a rear compliant foot. An offset distance from the first end of the front leg relative to the seat contact tube is adjustable by a first spring pin disposed in the front leg that is engaged with a corresponding first receptacle of a first series of receptacles disposed in the front leg tube, and wherein the first series of receptacles are disposed in a surface of the front leg tube that faces the rear of the shower chair. An offset distance from the first end of the rear leg relative to the seat contact tube is adjustable by a second spring pin disposed in the rear leg that is engaged with a corresponding second receptacle of a second series of receptacles disposed in the rear leg tube, and wherein the second series of receptacles are disposed in a surface of the rear leg tube that faces the rear of the shower chair. The seat pan comprises a first side surface extending from the frame attachment side in a direction away from the seating side, wherein the seat pan comprises a second side surface extending from the frame attachment side in the direction away from the seating side, wherein the first side surface and the second side surface are disposed at the front of the shower chair and inside an overall seat width of the seat pan. A first side shield attached to the bottom surface of the seat contact tube of the first leg frame, wherein the first side shield extends from the bottom surface of the seat contact tube of the first leg frame in a direction away from the seat pan, wherein the first side shield extends from the front leg tube of the first leg frame to the rear leg tube of the first leg frame; and a second side shield attached to the bottom surface of the seat contact tube of the second leg frame, wherein the second side shield extends from the bottom surface of the seat contact tube of the second leg frame in a direction away from the seat pan, wherein the second side shield extends from the front leg tube of the second leg frame to the rear leg tube of the second leg frame, wherein an outer side surface of the first side shield is coplanar with an outer side surface of the first side surface, and wherein an outer side surface of the second side shield is coplanar with an outer side surface of the second side surface. A sprayer holder, comprising: a first end configured to be inserted into one of a receptacle disposed in the a first side surface and a receptacle disposed in the second side surface; and a second end comprising a clamp configured to receive a shower sprayer. The sprayer holder further comprises a hinge arranged between the first end and second end allowing the sprayer holder to move from a retracted position under the seat pan to an extended position disposed apart from the seat pan.

In another aspect, a shower chair includes a leg assembly, comprising: a first leg frame disposed on a first side of the shower chair; and a second leg frame disposed on a second side of the shower chair opposite the first side, the second leg frame spaced apart a width from the first leg frame, wherein the first leg frame and the second leg frame each comprise a front leg tube and a rear leg tube and a seat contact tube joining the front leg tube to the rear leg tube, and wherein the first leg frame and the second leg frame each comprise a tube joined with and extending from the rear leg tube, in a direction away from the front leg tube; a lower support crossbar connected to a bottom surface of the seat contact tube of the first leg frame and the second leg frame and spanning the width; a seat pan comprising a seating side and a frame attachment side disposed opposite the seating side, wherein a portion of the seat pan on the frame attachment side is connected to an upper surface of the seat contact tube of the first leg frame and the second leg frame; and an upper support crossbar disposed at a rear of the shower chair and spanning from the first leg frame to the second leg frame, wherein the upper support crossbar comprises a first post connected to the tube of the first leg frame and a second post connected to the tube of the second leg frame.

Examples of the shower chair above may include one of the following features or any combination thereof. A backrest comprising a first end detachably connected to the lower support crossbar offset a distance from the seat pan on the frame attachment side and extending from the lower support crossbar past the seating side of the seat pan toward a second end of the backrest disposed at the rear of the shower chair. The seat pan comprises a sloped surface angled downward from a first point at a front of the shower chair to a second point at the rear of the shower chair, wherein the backrest comprises a sloped arcuate surface disposed adjacent the first end and angled downward from the rear of the shower chair toward the front of the shower chair, wherein a first gap is disposed between the seat pan at the backrest at the second point, and wherein a second gap is disposed between the first end of the backrest and the lower support crossbar providing an unrestricted water flow path for the shower chair running from the seat pan at the front of the shower chair toward the rear of the shower chair and then from the backrest at the rear of the shower chair toward the front of the shower chair in a space between the seat pan and the first end of the backrest.

In yet another aspect, a shower chair kit includes a first leg frame that defines a first side of the shower chair; a second leg frame that defines a second side of the shower chair opposite the first side, wherein the first leg frame and the second leg frame each comprise a front leg tube and a rear leg tube and a seat contact tube joining the front leg tube to the rear leg tube, and wherein the first leg frame and the second leg frame each comprise a tube joined with and extending from the rear leg tube, in a direction away from the front leg tube; two front legs that interconnect with the front leg tube of the first leg frame and the front leg tube of the second leg frame, respectively; two rear legs that interconnect with the rear leg tube of the first leg frame and the rear leg tube of the second leg frame, respectively; a lower support crossbar that connects to a bottom surface of the seat contact tube of the first leg frame and the second leg frame and, when connected maintains a width distance between the first leg frame and the second leg frame; a seat pan comprising a seating side and a frame attachment side disposed opposite the seating side, wherein a portion of the seat pan on the frame attachment side connects to an upper surface of the seat contact tube of the first leg frame and the second leg frame; an upper support crossbar comprising a first post that connects to the tube of the first leg frame and a second post that connects to the tube of the second leg frame; and a backrest comprising a first end that detachably connects to the lower support crossbar at a position offset a distance from the seat pan on the frame attachment side and that, when attached, extends from the lower support crossbar past the seating side of the seat pan toward a second end of the backrest, wherein the backrest comprises a handle aperture disposed adjacent the second end.

In one aspect, a shower chair includes a leg assembly, comprising a structural beam extending a width from a first end to a second end; a seat assembly, comprising: a front seat tube having a front set of adjustment posts having a first series of adjust holes disposed therein; and a rear seat tube having a rear set of adjustment posts having a second series of adjust holes disposed therein; and a seat-height adjustment mechanism attached to the structural beam between the first end and the second end, wherein the seat-height adjustment mechanism comprises: a height adjustment handle; and a plurality of bands each having a first end and a second end, wherein the first end of each band is attached to the height adjustment handle and the second end of each band is attached to a locking pin; wherein the locking pin of each band selectively engages with a respective adjust hole of the first series of adjust holes and second series of adjust holes, and wherein the locking pins are simultaneously moveable between an engaged state and a disengaged state by movement of the height adjustment handle.

Examples may include one of the following features, or any combination thereof. Aspects of the above shower chair may include wherein the leg assembly further comprises a first leg frame attached to the first end of the structural beam, and a second leg frame attached to the second end of the structural beam. Aspects of the above shower chair may include wherein the seat assembly further comprises a seat pan attached to the front seat tube and the second seat tube. Aspects of the above shower chair may include wherein the front set of adjustment posts and the rear set of adjustment posts engage with respective seat tube receiving holes in the leg assembly. Aspects of the above shower chair may include wherein each band of the plurality of bands have a length disposed within respective translation grooves of the structural beam. Aspects of the above shower chair may further comprise a sprayer holder comprising a first end configured to be attached to one of the front seat tube or rear seat tube, and a second end configured to receive a shower sprayer. Aspects of the above shower chair may include wherein the sprayer holder further comprises a hinge between the first end and second end allowing the sprayer holder to move from a retracted position to an extended position. Aspects of the above shower chair may further comprise a backrest. Aspects of the above shower chair may include wherein the backrest is attached to the rear seat tube. Aspects of the above shower chair may further comprise an armrest. Aspects of the above shower chair may include wherein the armrest is attached to the rear seat tube and is configured to rotate relative to the seat assembly.

In another aspect, a shower chair includes a shower chair, comprising: a leg assembly, comprising: a structural beam extending a width from a first end to a second end; a first leg frame attached to the first end of the structural beam; and a second leg frame attached to the second end of the structural beam; a seat assembly, comprising: a front seat tube having a front set of adjustment posts having a first series of adjust holes disposed therein; a rear seat tube having a rear set of adjustment posts having a second series of adjust holes disposed therein; and a seat pan attached to the front seat tube and the second seat tube; wherein the front set of adjustment posts and the rear set of adjustment posts engage with respective seat tube receiving holes in the leg assembly; and a seat-height adjustment mechanism attached to the structural beam between the first end and the second end, wherein the seat-height adjustment mechanism comprises: a height adjustment actuation handle; and a plurality of bands having a length disposed within respective translation grooves of the structural beam, wherein each band in the plurality of bands has a first end and a second end, wherein the first end of each band is attached to the height adjustment handle and the second end of each band is attached to a locking pin; wherein the locking pin of each band selectively engages with a respective adjust hole of the first series of adjust holes and second series of adjust holes, and wherein the locking pins are simultaneously moveable between an engaged state and a disengaged state by movement of the height adjustment handle.

Further examples may include one of the following features, or any combination thereof. Aspects of the above shower chair may further comprise a sprayer holder comprising a first end configured to be attached to one of the front seat tube or rear seat tube, and a second end configured to receive a shower sprayer. Aspects of the above shower chair may include wherein the sprayer holder further comprises a hinge between the first end and second end allowing the sprayer holder to move from a retracted position to an extended position. Aspects of the above shower chair may further comprise a backrest. Aspects of the above shower chair may include wherein the backrest is attached to the rear seat tube. Aspects of the above shower chair may further comprise an armrest. Aspects of the above shower chair may include wherein the armrest is attached to the rear seat tube and is configured to rotate relative to the seat assembly.

In some examples, the shower chair described herein may include an enhanced look and feel over conventional shower chairs. The shower chair may include a rounded seat pan and backrest providing a softer contoured look and more comfortable contact surfaces. Additionally or alternatively, the leg frames of the shower chair may be made from a continuous, uninterrupted length of bent metal tubing. The metal tubing may be radiused at corners along the length providing a smooth surface. For instance, the metal tubing may be slot-shaped having two linear sides and two radiused sides. The metal tubing may be hollow providing a slot-shaped receptacle that can receive similarly shaped legs. In addition to providing a delicate appearance and a strong construction, these seat pans, backrests, leg frames, and legs allow for various finishes, coatings, and/or colors. In one example, the seat pan and backrest may be made (e.g., molded or otherwise formed) from a white plastic or composite material and the leg frame and/or legs may be finished with a satin nickel, copper, antique brass, or other coating. In some examples, the leg frames and/or legs may be plated, anodized, painted, or powder coated to match any color or visual appearance. Among other things, these colors and finishes may be selected to match the colors and finishes associated with hardware (e.g., faucets, sinks, handles, attachments, covers, etc.) and/or other objects in the bathroom of a user.

In one example, the overall seat height may be adjusted and set using a single lever-, or button-, actuated cable system. For example, a user may actuate a single height adjustment handle to simultaneously retract, or unlock, the locking pins from each seat-height adjustment bar attached to the seat of the shower chair. The height adjustment handle and/or the locking pins may be spring-biased in a locking, or extended, position. When the user releases the height adjustment handle, the locking pins may return (e.g., under spring force, etc.) from the retracted position into an extended position. Once actuated, a user may grip the seat of the chair via an integrated drainage aperture, or hole, in the seat, and simply pull or push the seat (e.g., up or down, respectively) into a desired height position. The seat assembly may click and lock into place at predetermined intervals where a hole in the seat-height adjustment bars align with a respective locking pin in the leg assembly, or base, of the shower chair. When aligned, the locking pins may extend into respective holes of the seat-height adjustment bars locking the overall height of the seat relative to the floor. The height adjustment handle may be arranged at a rear of the shower chair under a structural beam portion of the leg assembly. Among other things, this protected rear position prevents accidental seat-height adjustment of the shower chair while in use.

In some examples, the shower chair may include an integrated shower sprayer holder. The shower sprayer holder may be attached to a side surface, or side facing surface, of the seat pan disposed on an underside of the seat pan. The shower sprayer holder may include a first end sized to be inserted into, and retained by, a receptacle disposed in the side surface of the seat pan. The first end may include a locking element that engages with a corresponding element in the seat tube. The shower sprayer holder may comprise a second end having a hook that receives a handle, hose, or other portion of a shower sprayer. In some examples, the shower sprayer holder may comprise a hinge disposed between the first end and the second end. The hinge may allow the shower sprayer holder to move from a retracted position (e.g., concealed under the seat pan) to an extended position (e.g., exposed from beneath the seat pan) where the hook is available to hold a shower sprayer. When not required, the shower sprayer holder may be maintained in the retracted position or removed completely from the seat tube of the seat assembly. An optional plug may be inserted into any side surface receptacle that is not accommodating the shower sprayer holder.

The terms "seatback" and "backrest" may be used interchangeably herein to refer to the upright portion of the seat extending from the seat pan of the shower chair that may contact the back of a user when in use.

In some examples, the shower chair may be used, or arranged, in one or more configurations including, but in no way limited to, an "armchair" configuration, a "chair" configuration, and a "stool" configuration. The armchair configuration may include a seat pan, a backrest, and one or more armrests. The chair configuration may include a seat pan and a backrest, but may exclude one or more armrests. Although described as having three different configurations, it should be appreciated that variations of these configurations may be employed by the shower chair described herein. For example, while the stool configuration may exclude the backrest, a variation of the stool configuration may include one or more armrests. Other variations and/or combinations of features may be made within the scope of this disclosure.

As provided above, the stool configuration may include the seat pan but may exclude the backrest and one or more armrests. The stool configuration may provide a user with greater movement and access to portions of their upper torso while cleaning. The shower chair may be changed from an armchair or chair configuration (e.g., having the backrest) to a stool configuration (e.g., without the backrest) or vice versa. When in the armchair or chair configurations, the shower chair may be changed into the stool configuration by, for instance, at least detaching the backrest from the seat assembly. In one example, the backrest may be attached to an underside of the seat pan. The attachment may comprise a pin-in-keyhole connection, a thumbscrew attachment, a quarter-turn lock attachment, or some other fastened (e.g., screw, bolt, etc.) attachment.

The preceding is a simplified summary of the disclosure to provide an understanding of some aspects of the disclosure. This summary is neither an extensive nor exhaustive overview of the disclosure and its various aspects, examples, and configurations. It is intended neither to identify key or critical elements of the disclosure nor to delineate the scope of the disclosure but to present selected concepts of the disclosure in a simplified form as an introduction to the more detailed description presented below. As will be appreciated, other aspects, examples, and configurations of the disclosure are possible utilizing, alone or in combination, one or more of the features set forth above or described in detail below. All examples and features mentioned above can be combined in any technically possible way.

Numerous additional features and advantages are described herein and will be apparent to those skilled in the art upon consideration of the following Detailed Description and in view of the figures.

DETAILED DESCRIPTION

Figure 1A:
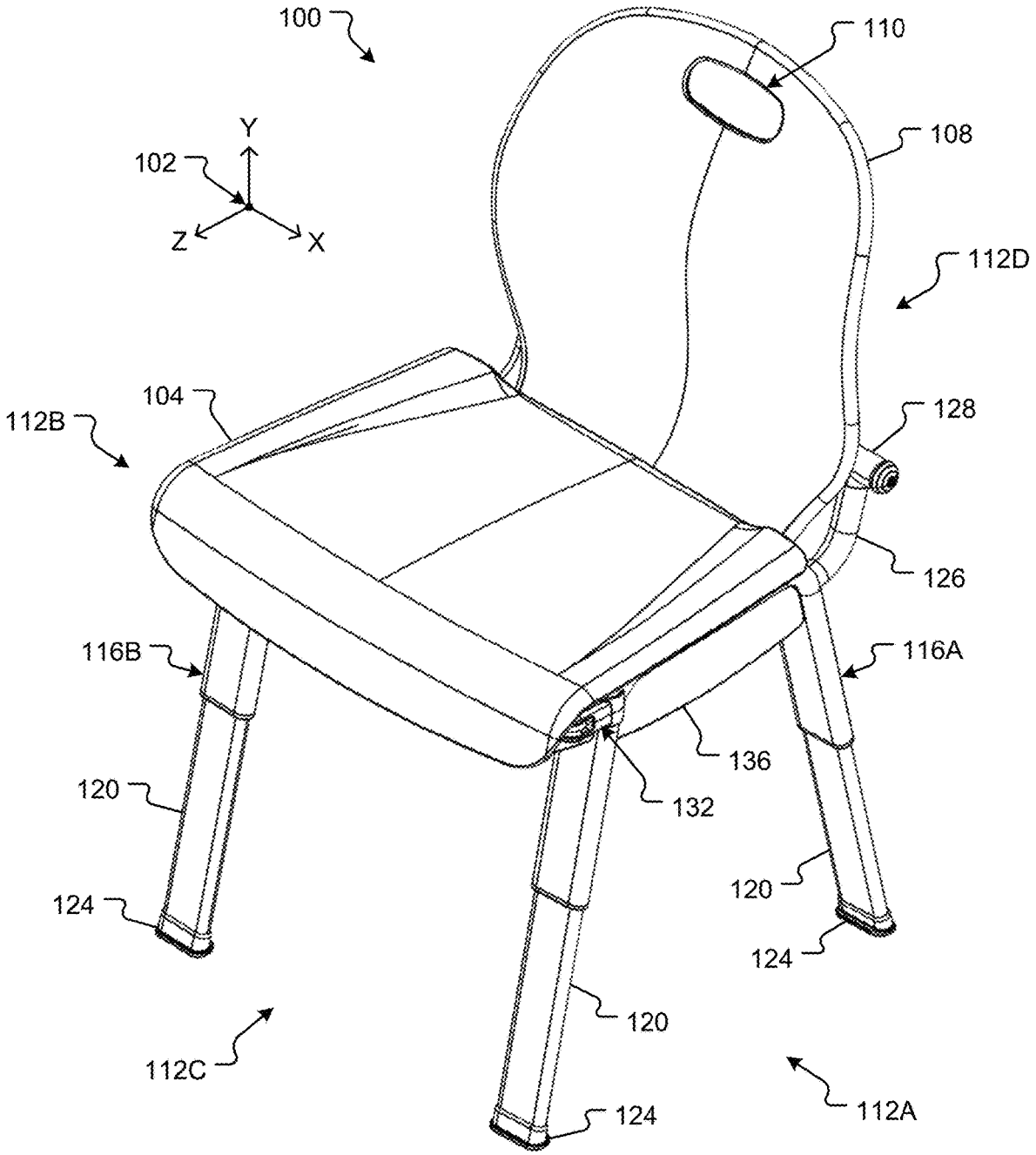
FIG. 1A is a top front perspective view of the shower chair in accordance with examples of the present disclosure.

Before any examples of the disclosure are explained, it is to be understood that the disclosure is not limited in its application to the details of construction and the arrangement of components set forth in the following description or illustrated in the drawings. The disclosure is capable of other examples and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the present disclosure may use examples to illustrate one or more aspects thereof. Unless explicitly stated otherwise, the use or listing of one or more examples (which may be denoted by "for example," "by way of example," "e.g.," "such as," or similar language) is not intended to and does not limit the scope of the present disclosure.

The ensuing description provides examples only, and is not intended to limit the scope, applicability, or configuration of the claims. Rather, the ensuing description will provide those skilled in the art with an enabling description for implementing the described examples. It being understood that various changes may be made in the function and arrangement of elements without departing from the spirit and scope of the appended claims.

The claims of the instant application are not limited to the ornamental designs of the various articles and examples shown in the accompanying figures. Moreover, the figures are not intended to illustrate the only available ornamental designs of the various articles and examples described herein. As can be appreciated by a person having ordinary skill in the art, numerous alternative design options are available for the disclosed articles that could achieve the same functionality as described and/or claimed herein.

Various aspects of the present disclosure will be described herein with reference to drawings that may be schematic illustrations of idealized configurations.

FIGS. 1A-1H show various views of the shower chair 100 in accordance with examples of the present disclosure. The shower chair 100 is shown in particular configurations (or shown to have a particular shape/design), but it should be appreciated that this is one of many possible configurations/shapes/designs. The shower chair 100 may comprise a seat pan 104, a backrest 108, and a leg assembly that includes two leg frames 116A, 116B, legs 120, and feet 124. The seat pan 104 may be attached to the leg assembly and the backrest 108 may be attached to a lower support crossbar 130 and/or upper support crossbar 128 of the shower chair 100. In some examples, the overall seat height of the shower chair 100 may be adjusted by individually adjusting each leg 120 relative to the leg frames 116A, 116B.

The coordinate system 102, as shown in the figures, includes three-dimensions comprising an X-axis, a Y-axis, and a Z-axis. Additionally or alternatively, the coordinate system 102 may be used to define planes (e.g., the XY-plane, the XZ-plane, and the YZ-plane) of the shower chair 100. These planes may be disposed orthogonal, or at 90 degrees, to one another. While the origin of the coordinate system 102 may be placed at any point on or near the components of the shower chair 100, for the purposes of description, the axes of the coordinate system 102 are always disposed along the same directions from figure to figure. In some examples, reference may be made to dimensions, angles, directions, relative positions, and/or movements associated with one or more components of the shower chair 100 with respect to the coordinate system 102. For instance, the width of the shower chair 100 may be defined as a dimension along the X-axis, the height of the shower chair 100 may be defined as dimension along the Y-axis, and the depth of the shower chair 100 may be defined as a dimension along the Z-axis of the coordinate system 102. Additionally or alternatively, the width of components of the shower chair 100 may be defined as a dimension along the X-axis, the height of the components of the shower chair 100 may be defined as dimension along the Y-axis, and the depth of the components of the shower chair 100 may be defined as a dimension along the Z-axis of the coordinate system 102.

Figure 1B:
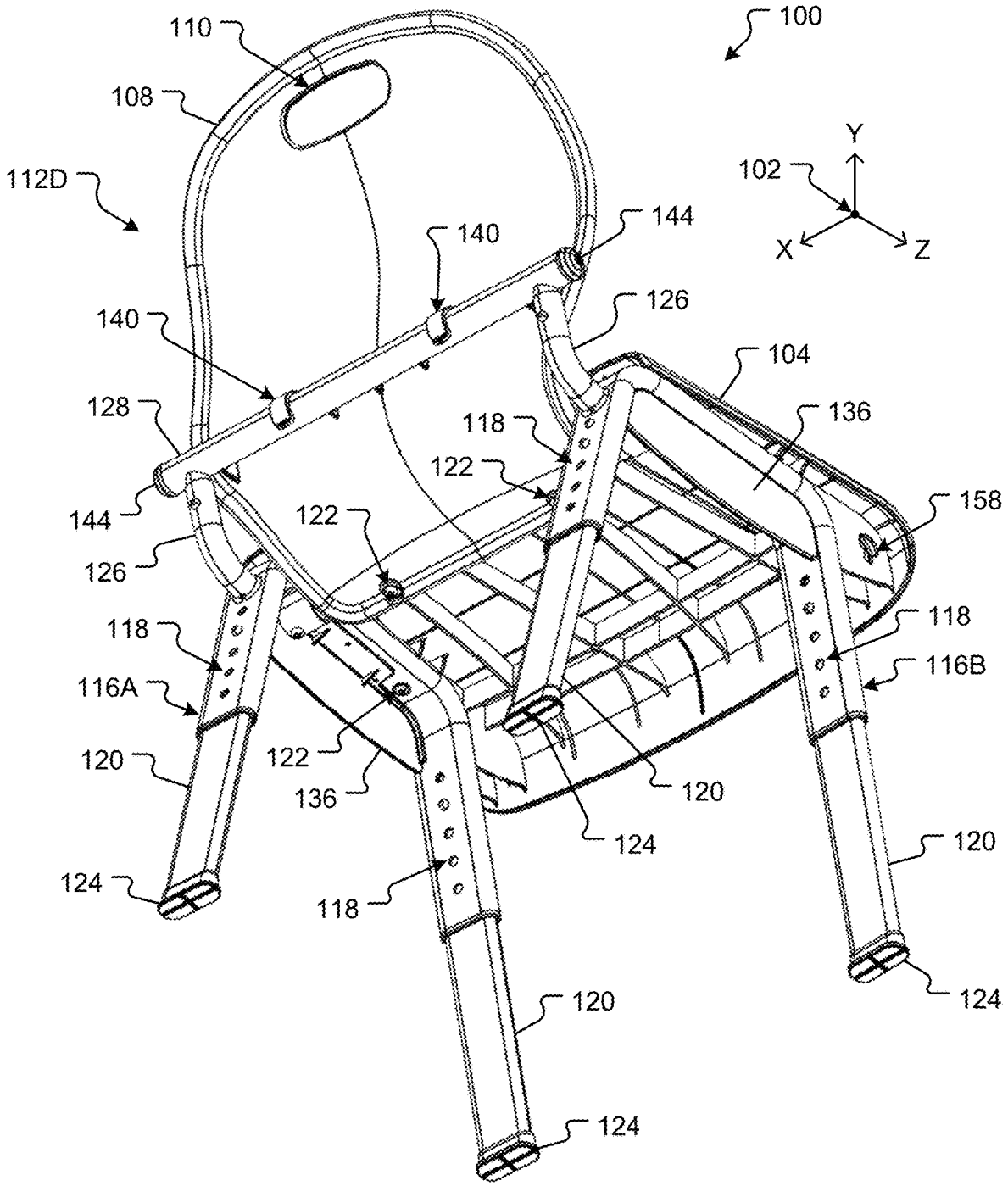
FIG. 1B is a bottom rear perspective view of the shower chair in accordance with examples of the present disclosure.
Figure 1C:
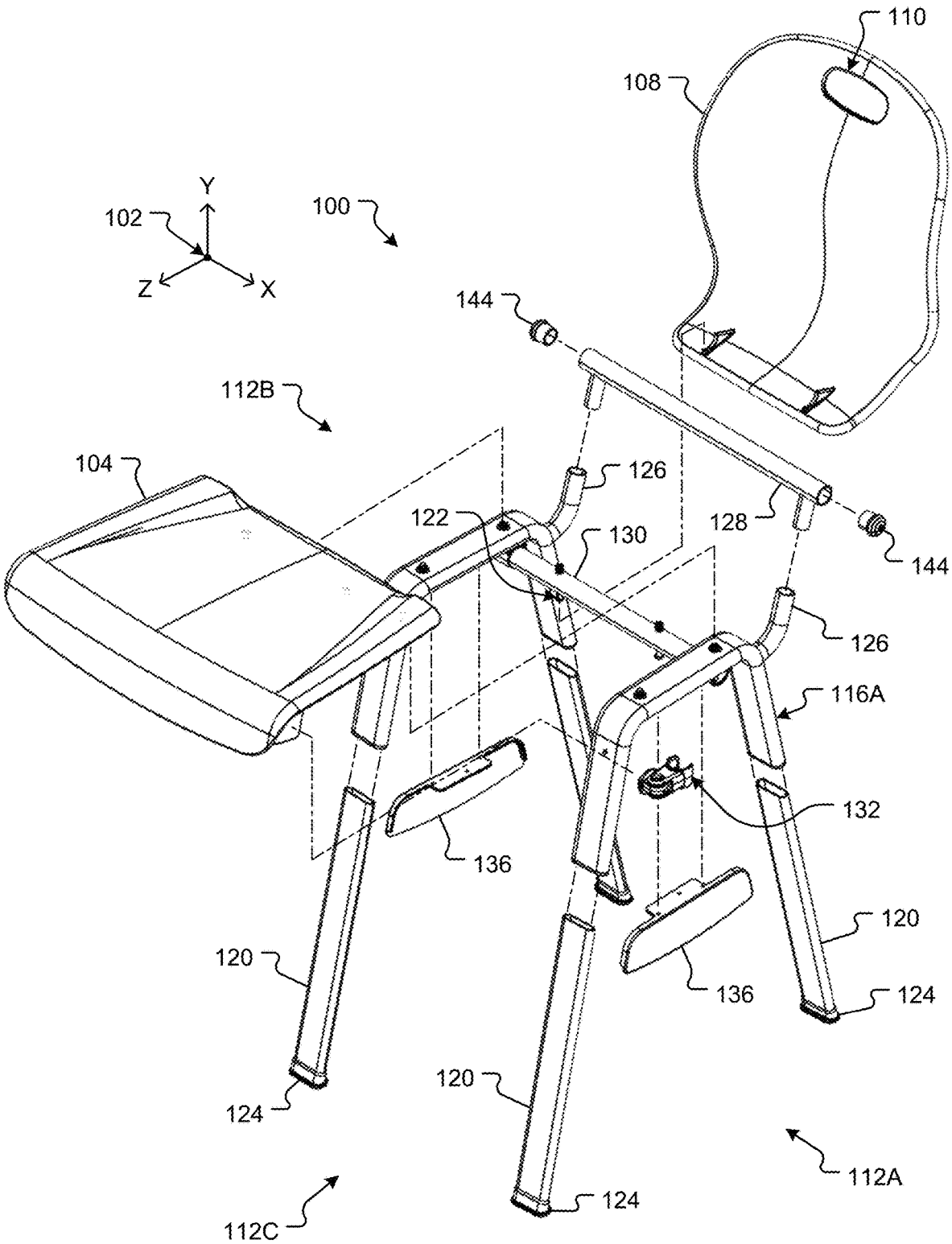
FIG. 1C is an exploded perspective view of the shower chair in accordance with examples of the present disclosure.

The shower chair 100 is assembled such that the first leg frame 116A is disposed on a first side 112A of the shower chair 100 and the second leg frame 116B is disposed on an opposite second side 112B of the shower chair 100 separated by a width (e.g., measured along the X-axis). In some examples, a lower support crossbar 130 may connect to and span from the first leg frame 116A to the second leg frame 116B at least partially maintaining the separation between the first and second leg frames 116A, 116B. The lower support crossbar 130 is attached between the front leg tubes 150 and the rear leg tubes 154 of each leg frame 116A, 116B. More specifically, the lower support crossbar 130 may be attached to a bottom surface of the seat contact tube 152 of each leg frame 116A, 116B. As illustrated in FIGS. 1C and 1H, this arrangement of the lower support crossbar 130 provides a mount point for the backrest 108 that is disposed under the seat pan 104. The leg frames 116A, 116B are shown in a particular configuration (or shown to have a particular shape/design), but it should be appreciated that this is one of many possible configurations/shapes/designs.

Each leg frame 116A, 116B may comprise a tube 126 that extends from the rear leg tube 154 in a direction away from the front side 112C of the shower chair 100. In some examples, the tubes 126 may be angled such from the rear leg tubes 154 to extend to above a seating side 168A of the seat pan 104 at the rear side 112D of the shower chair 100. The upper support crossbar 128 may be connected to each of the tubes 126 disposed at the rear side 112D of the shower chair 100. When connected, the upper support crossbar 128 may span from the first leg frame 116A to the second leg frame 116B. Details of this connection are described in greater detail in FIGS. 3A-5.

The shower chair 100 may be used with or without the backrest 108. The backrest 108 is shown in a particular configuration (or shown to have a particular shape/design), but it should be appreciated that this is one of many possible configurations/shapes/designs. In some examples, the backrest 108 may include a handle aperture 110 disposed adjacent a top (e.g., second end 172B) thereof. The handle aperture 110 may serve as a handle for carrying the shower chair 100. When the backrest 108 is detached from, or not used with, the shower chair 100, the upper support crossbar 128 may serve as a carry handle, support, and/or structural member of the shower chair 100. When the backrest 108 is attached to, or forms a part of, the shower chair 100, at least a portion of the backrest 108 may contact the upper support crossbar 128. This contact may provide rigidity across the width of the shower chair 100 and/or prevent the backrest 108 from flexing past the upper support crossbar 128 in a direction from the front side 112C toward the rear side 112D of the shower chair 100. In one example, the backrest 108 may be hooked onto the upper support crossbar 128 via at least one mount hook 140 disposed on the backrest 108 at the rear side 112D. In addition to offering additional constraints for the backrest 108 (e.g., preventing vertical movement along the Y-axis, forward movement along Z-axis, etc.), the mount hook 140 and upper support crossbar 128 interface may provide other advantages. For instance, during assembly the backrest 108 may be first hooked onto the upper support crossbar 128, via the mount hooks 140, and then positioned and fastened to the lower support crossbar 130 at the first end 172A of the backrest 108 (e.g., via at least one fastener 122). Among other things, this hook-and-fastener assembly approach allows the backrest 108 to be attached and detached from the shower chair 100 quickly and easily by a single person. The mount hook 140 may be formed from the backrest 108 and/or separately affixed to the backrest 108. The fastener 122 may correspond to a pin (e.g., in a pin-in-keyhole connection), a thumbscrew, a quarter-turn locking fastener, a threaded fastener (e.g., bolt, screw, etc.) and/or the like. In one example, the fastener 122 may pass through the first end 172A of the backrest 108 at least into the lower support crossbar 130. The fastener 122 may connect to threads, threaded inserts, nuts, or standoffs, and/or other mating fastener features that are disposed in the body of the seat pan 104.

As illustrated in FIG. 1C, the upper support crossbar 128 may be a hollow tube that extends a width of the shower chair 100. The hollow tube may have a first end disposed opposite a second end. In one example, end caps 144 may be disposed in the first end and/or the second end of the hollow tube. Although not shown in FIG. 1C, an optional armrest may be inserted into one or both of these ends of the upper support crossbar 128.

The seat pan 104 may contact each leg frame 116A, 116B at least at a respective seat contact tube 152 of leg frame 116A, 116B. Specifically, the seat pan 104 may rest on the upper surface of the seat contact tube 152 of each leg frame 116A, 116B. The seat pan 104 may comprise one or more molded features that locate, orient, and/or clip onto a portion of each leg frame 116A, 116B. These molded features may include, but are in no way limited to, tabs, grooves, protrusions, depressions, receptacles, etc., and/or combinations thereof. The seat pan 104 may be fastened to each leg frame 116A, 116B via one or more fasteners 122. For example, the fastener 122 may pass from a bottom surface of the seat contact tube 152 through the seat contact tube 152 of each leg frame 116A, 116B and into a body of the seat pan 104. Similar to the connection of the backrest 108, the body of the seat pan 104 may comprise one or more receiving threads, threaded inserts, nuts, or standoffs, and/or other mating fastener features that interconnect with the fastener 122.

Figure 1E:
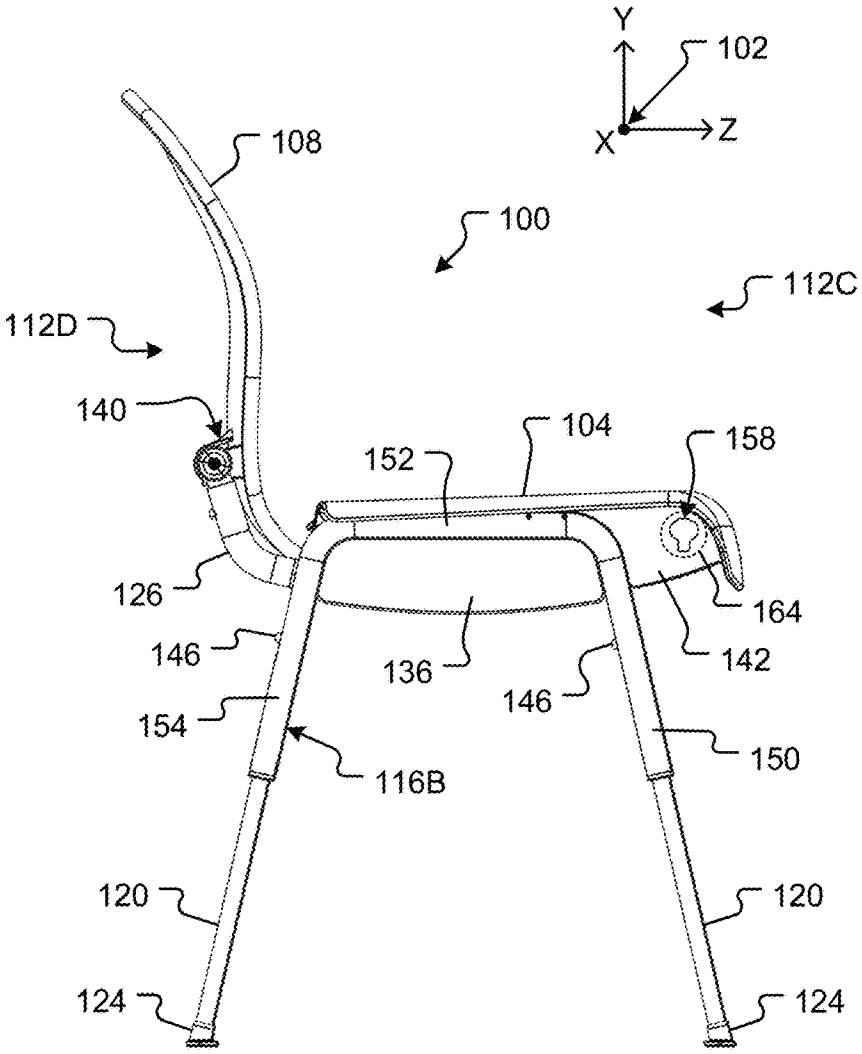
FIG. 1E is a second side elevation view of the shower chair in accordance with examples of the present disclosure.
Figure 1D:
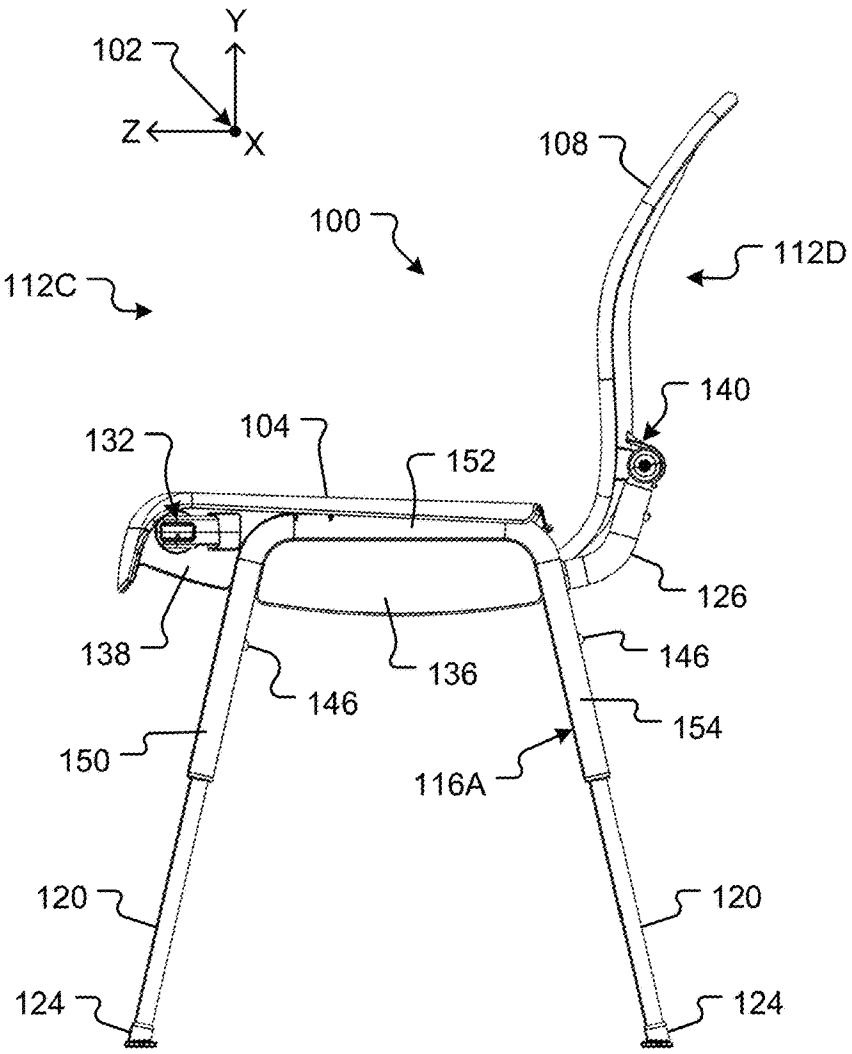
FIG. 1D is a first side elevation view of the shower chair in accordance with examples of the present disclosure.
Figure 1F:
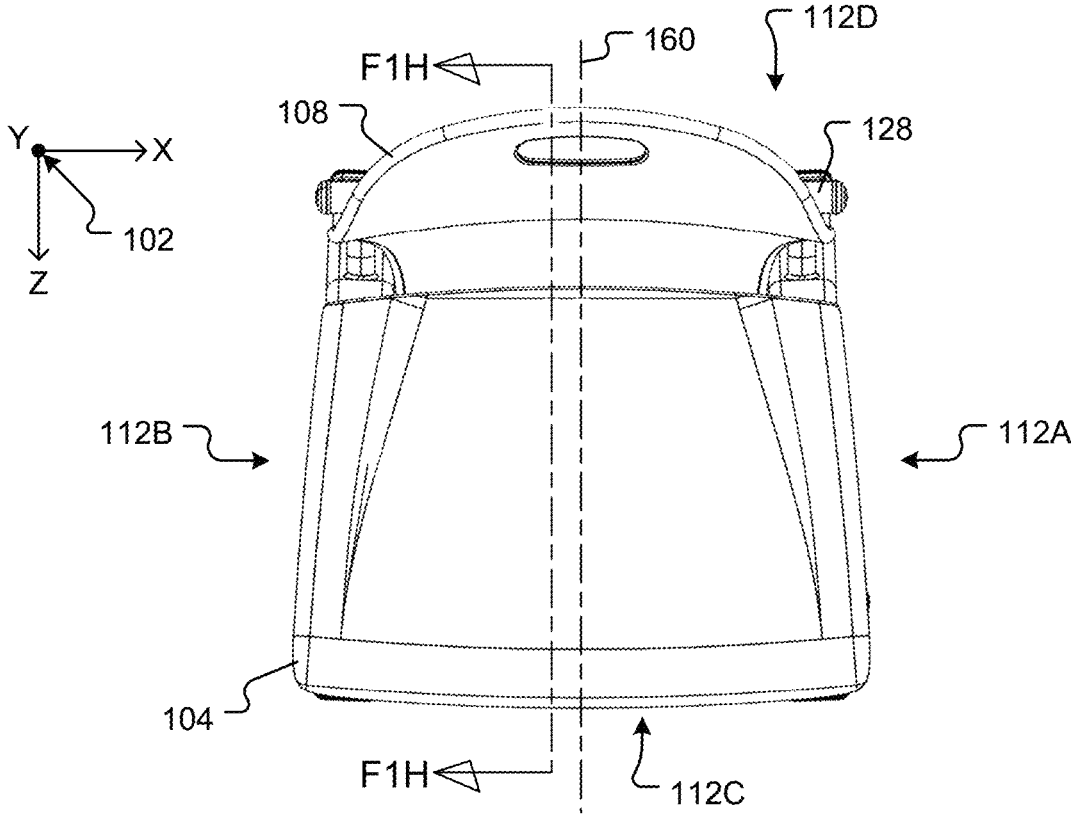
FIG. 1F is a plan view of the shower chair in accordance with examples of the present disclosure.
Figure 1G:
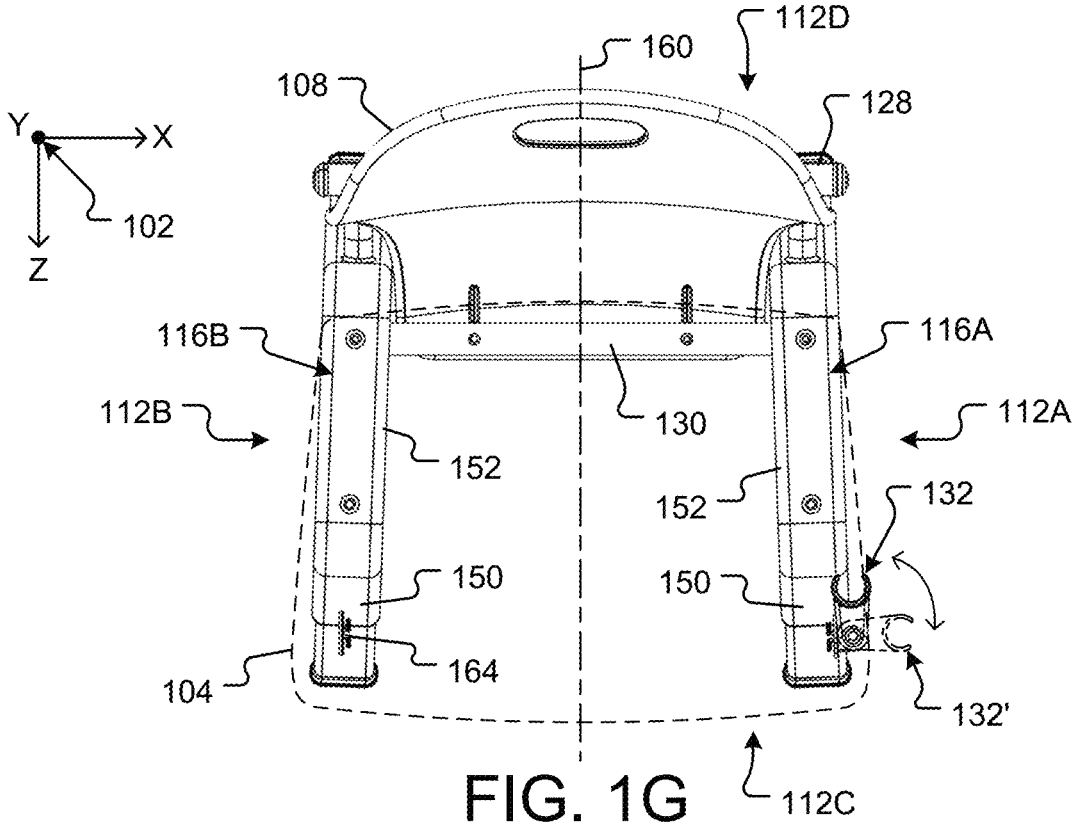
FIG. 1G is a plan view of the shower chair with the seat pan removed in accordance with examples of the present disclosure.
Figure 1H:
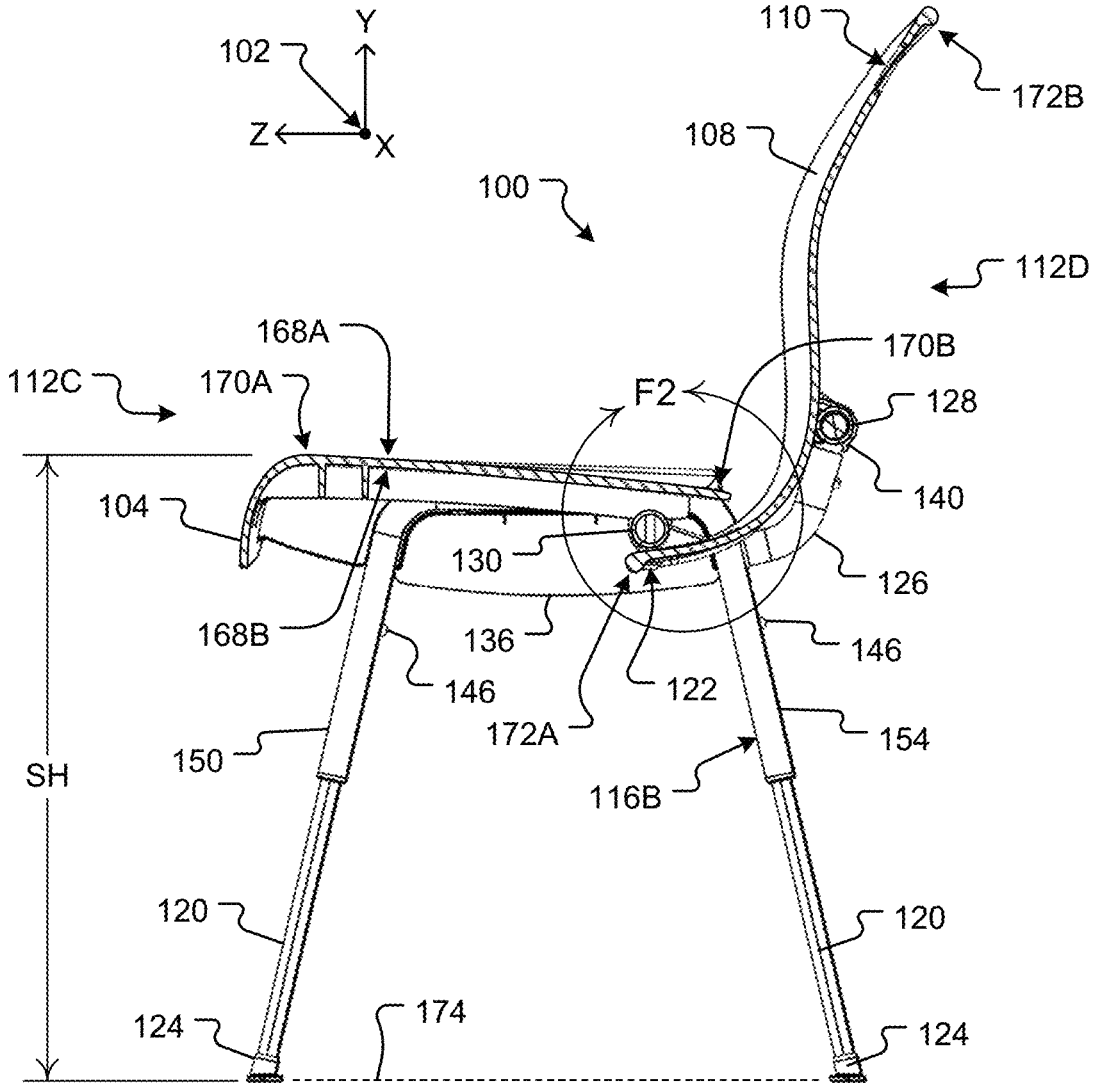
FIG. 1H is a cross-section view of the shower chair taken through line F1H-F1H of FIG. 1F.

As shown at least in FIGS. 1D, 1E, and 1H, the shower chair 100 may comprise side shields 136 and surfaces 138, 142 that extend from the frame attachment side 168B of the seat pan 104 in a direction toward the floor 174 and/or feet 124 of the shower chair 100. The side shields 136 and surfaces 138, 142 are shown in a particular configuration (or shown to have a particular shape/design), but it should be appreciated that this is one of many possible configurations/shapes/designs. The side shields 136, the first side surface 138, and the second side surface 142 may control the flow of water running off of the shower chair 100. Additionally or alternatively, the side shields 136, the first side surface 138, and the second side surface 142 may conceal a center bottom portion of the shower chair 100 from view (e.g., when viewed from the first side 112A and/or the second side 112B, etc.). A visible surface of the side shield 136 on the first side 112A may be coplanar with the first side surface 138, and a surface of the side shield 136 on the second side 112B may be coplanar with a visible surface of the second side surface 142. While the ornamental appearance of the side shields 136, the first side surface 138, and the second side surface 142 shown in the figures may not necessarily be dictated by the functions described herein (e.g., concealment, water control, etc.), together the side shields 136 and respective surfaces 138, 142 may have an arcuate edge shape that appears to run in a direction from the front side 112C to the rear side 112D of the shower chair 100. Each side shield 136 may be attached to a bottom surface of the seat contact tube 152 of a respective leg frame 116A, 116B. In one example, the side shield 136 may be attached by a screw, pin (e.g., plastic pin, ridged pin, dowel, etc.), tab, clip, etc., and/or combinations thereof.

Referring to FIG. 1D, which shows a side elevation view of the shower chair 100 when viewed from the first side 112A, the first side surface 138 is shown comprising a sprayer holder 132. The sprayer holder 132 is connected to the first side surface 138 by a connection receptacle 158 (not shown in FIG. 1D) disposed in the first side surface 138. In FIG. 1E, which shows a side elevation view of the shower chair 100 when viewed from the second side 112B, the connection receptacle 158 is shown disposed in the second side surface 142. When not in use, the connection receptacle 158 may be covered, or otherwise concealed, by a cover plug 164. A sprayer holder 132 may be inserted into the connection receptacle 158 of the first side surface 138, the second side surface 142, and/or one sprayer holder 132 may be disposed in the connection receptacle 158 of the first side surface 138 and another sprayer holder 132 may be disposed in the connection receptacle 158 of the second side surface 142. Any connection receptacle 158 that is not in use (e.g., having a connected sprayer holder 132, etc.) may be concealed with a cover plug 164. In some examples, the shower chair 100 may comprise one cover plug 164 disposed in the connection receptacle 158 of the first side surface 138 and another cover plug 164 disposed in the connection receptacle 158 of the second side surface 142 such that no sprayer holder 132 is connected to the shower chair 100.

FIGS. 1B, 1D, and 1E, show the height adjustment components, comprising the series of receptacles 118 disposed in the leg tubes 150, 154 and the spring pins 146 attached to each leg 120 are arranged facing the rear side 112D of the shower chair 100. Among other things, this arrangement conceals the adjustment components from view when looking at the first side 112A of the shower chair 100 (e.g., as shown in FIGS. 1A and 1C) providing a clean look. Moreover, the concealed arrangement prevents accidental adjustment of the legs 120 when a user is seated in the shower chair 100. For instance, rather than arranging the spring pins 146 facing the front side 112C of the shower chair 100, where a user may unintentionally contact the spring pins 146, the present arrangement disposes the spring pins 146 facing the rear side 112D of the shower chair 100 (e.g., facing a direction away from the front side 112C of the shower chair 100).

The feet 124 may be made from a compliant material and provide a nonslip interface with a floor 174. The floor 174 may correspond to an interior of a bathtub, a shower pan, tiled area, and/or some other washdown or bathroom surface. In one example, the foot may be made from a nonslip grip material (e.g., rubber, silicone, urethane, etc.) and/or include one or more nonslip features (e.g., sipes, suction cups, grip protrusions, etc.). The foot 124 may insert into an end of each leg 120, wrap around the end of the leg 120, and/or combinations thereof.

FIGS. 1F and 1G show top plan views of the shower chair 100 with the sprayer holder 132 in various positions. In some examples, the shower chair 100 may be symmetrical about the centerline 160, or center plane, that runs through the shower chair 100 in a direction from the front side 112C to the rear side 112D (e.g., along the YZ-plane). In FIG. 1F, the sprayer holder 132 is concealed from view by the seat pan 104. In FIG. 1G, the perimeter of the seat pan 104 is shown in dashed lines for clarity. When the sprayer holder 132 is in the retracted position, the majority, if not all, of the sprayer holder 132 may not be visible from the top of the shower chair 100. As shown in FIG. 1G, the position of the extended sprayer handle 132' is shown exposed from the perimeter of the seat pan 104. In this position, the extended sprayer handle 132' may be used to hold a shower sprayer, a handle of a shower sprayer, and/or other objects. When not in use, the sprayer holder 132 may be returned to the concealed position under the seat pan 104.

FIG. 1H shows a cross-section view of the shower chair taken through line F1H-F1H of FIG. 1F. The cross-section view of FIG. 1H is shown from the first side 112A of the shower chair 100. As provided above, the seat height, SH, of the shower chair 100 relative to the floor 174 may be adjusted by individually adjusting a height of each leg 120 of the shower chair 100. In some examples, the legs 120 at the rear side 112D of the shower chair 100 may be set lower than the legs 120 at the front side 112C of the shower chair 100, or vice versa. Allowing for different front and rear leg heights, within reason, may provide a customizable user experience with the shower chair 100.

In some examples, the surfaces of the seat pan 104, the backrest 108, and/or other components of the shower chair 108 may be sloped, inclined, or angled relative to a horizontal reference plane (e.g., the floor 174, the upper surface of the seat contact tube 152, etc.). These angled surfaces may be configured to allow water to drain off of the shower chair 100 to the floor 174. The seat pan 104 is shown in a particular configuration (or shown to have a particular shape/design), but it should be appreciated that this is one of many possible configurations/shapes/designs. In one example, the water may be directed to drain off of the shower chair 100 toward a center of the shower chair 100 and/or in a direction of a drain on the floor 174. The seat pan 104 may include a radiused front portion that simultaneously serves a comfort edge for a user and as a drainage surface. As illustrated in FIG. 1H, the seat pan 104 may be sloped downward from a first point 170A at the front side 112C of the shower chair 100 to a second point 170B adjacent the rear side 112D of the shower chair 100. In some examples, the first end 172A of the backrest 108 that attaches to the lower support crossbar 130 may be sloped downward from a point adjacent the rear side 112D toward the front side 112C of the shower chair 100. In some examples, water draining from the seating side 168A of the seat pan 104 may drain toward the rear side 112D of the shower chair 100 onto the sloped first end 172A end of the backrest 108 and then drain in a direction back toward the front side 112C of the shower chair 100 under the seat pan 104. Among other things, this arrangement of surfaces prevents water from collecting on surfaces of the shower chair 100 during or after use.

Figure 2:
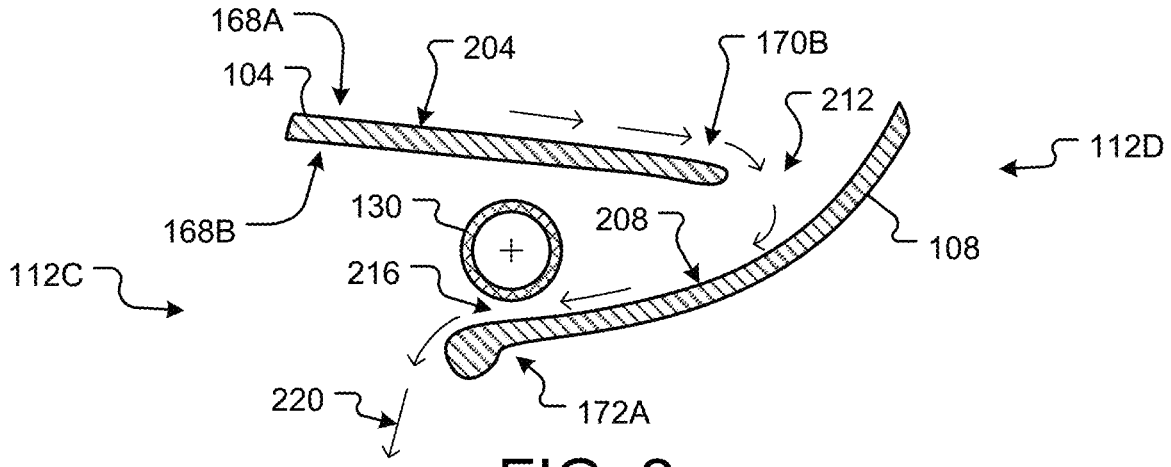
FIG. 2 is a schematic detail view of a section of the shower chair as viewed from circle F2 of FIG. 1H.

Referring now to FIG. 2, a schematic detail view of a section of the shower chair as viewed from circle F2 of FIG. 1H. Among other things, FIG. 2 shows surfaces of the seat pan 104 relative to those of the backrest 108 and the lower support crossbar 130, with other components of the shower chair 100 removed for clarity. An unrestricted water flow path 220 is shown by arrows running from the seat pan 104 to the backrest 108 and then off the first end 172A of the backrest 108. The seat pan 104 comprises a sloped surface 204 that is inclined downward from the front side 112C to the rear side 112D of the shower chair 100. Stated another way, a distance measured from the floor 174 to the first point 170A, along the Y-axis, is greater than a distance measured from the floor 174 to the second point 170B, along the Y-axis. This sloped surface 204 allows water to flow toward the backrest 108 under gravity. A first gap 212 is disposed between the seat pan 104 and the backrest 108 adjacent the second point 170B. Water may continue to pass off of the seat pan 104 and into contact with the sloped arcuate surface 208 of the backrest 108. At this point, the unrestricted water flow path 220 may change direction and flow in a direction from the rear side 112D to the front side 112C of the shower chair 100. As the unrestricted water flow path 220 approaches the first end 172A of the backrest 108, the unrestricted water flow path 220 may flow under the lower support crossbar 130 through the second gap 216 disposed between the lower support crossbar 130 and the backrest 108. In some examples, the first end 172A may comprise a teardrop shaped cross-sectional shape that allows water to easily separate from the backrest 108. Although described as being arcuate in shape, one or more portions of the sloped arcuate surface 208 and/or the first end 172A of the backrest 108 may be linear or some other shape. In one example, the seat pan 104 and/or the backrest 108 may additionally slope from an outer width of the shower chair 100 toward the centerline 160 of the shower chair 100. Among other things, these compound sloped surfaces may serve to control the flow of water off the shower chair 100.

Figure 3A:
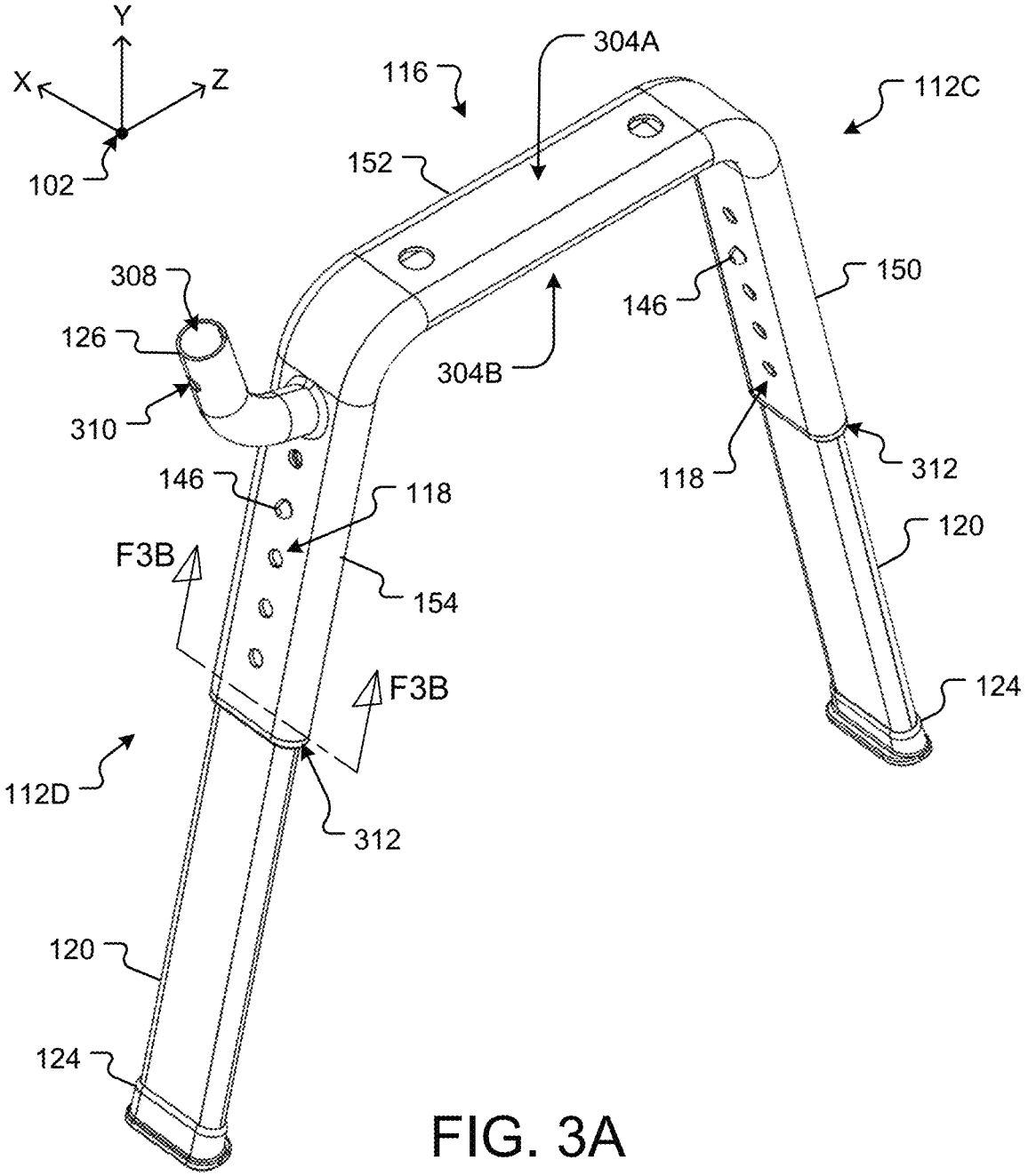
FIG. 3A is a rear perspective view of a portion of a leg assembly of the shower chair in accordance with examples of the present disclosure.

FIG. 3A is a rear perspective view of a portion of a leg assembly of the shower chair 100 in accordance with examples of the present disclosure. In particular, the portion of the leg assembly comprises a leg frame 116, two legs 120 disposed at least partially inside ends of the leg frame 116, and feet 124 attached to ends of the legs 120. The leg frame 116 may correspond to the first leg frame 116A and/or the second leg frame 116B. The leg frame 116 may comprise a length of metal tubing (e.g., aluminum, stainless steel, etc.) that is bent such that opposite ends are each facing the floor. For instance, the leg frame 116 may correspond to a continuous section of tubing that extends from a front leg tube 150 to a seat contact tube 152 and then to a rear leg tube 154, or vice versa. The seat contact tube 152 may comprise an upper surface 304A and a bottom surface 304B disposed opposite the upper surface 304A. A portion of the seat pan 104 (e.g., extending from the frame attachment side 168B) may contact the upper surface 304A of the seat contact tube 152. In some examples, a bend may be disposed between the front leg tube 150 and the seat contact tube 152 and/or between the rear leg tube 154 and the seat contact tube 152. The seat contact tube 152 may be configured as a horizontal member (e.g., running in the XZ-plane) and the upper surface 304A may correspond to a horizontal reference surface thereof.

As shown in FIG. 3A, the series of receptacles 118 on the front leg tube 150 are disposed facing the rear side 112D of the leg frame 116. Similarly, the series of receptacles 118 on the rear leg tube 154 are disposed facing the rear side 112D of the leg frame 116. However, while both series of receptacles 118 face the rear side 112D, the series of receptacles 118 of the front leg tube 150 are disposed on an inner surface of the leg frame 116, the series of receptacles 118 of the rear leg tube 154 are disposed on an outer surface of the leg frame 116. At least some advantages of such an arrangement are described above.

The leg frame 116 comprises a tube 126 that extends from the rear leg tube 154 in a direction away from the front side 112C. In some examples, the tube 126 is angled and may extend in a direction away from the legs 120 and feet 124 of the leg assembly. The tube 126 may be hollow and/or comprise a tube receptacle 308 that is sized to receive a portion of the upper support crossbar 128. For example, the tube receptacle 308 may be sized to receive the posts (e.g., the first post 504A or the second post 504B described in conjunction with FIG. 5) of the upper support crossbar 128. The tube 126 may comprise a pin receiving receptacle 310 that extends from an exterior of the tube 126 into the tube receptacle 308.

As provided above, the leg 120 may be adjusted by pushing a spring pin 146 into a first receptacle of the series of receptacles 118 and then sliding the leg 120 relative to the leg frame 116. When the spring pin 146 aligns with a second receptacle in the series of receptacles 118, a protruding dome portion of the spring pin may force into the second receptacle locking the leg 120 in the new position. Since the leg frame 116 and the leg 120 are noncircular, the user does not need to work to maintain rotational orientation between the leg 120 and the leg frame 116 when adjusting. Rather, the shape of the leg 120 and the shape of the leg frame 116 (e.g., leg tubes 150, 154) provide a keyed nonrotating arrangement. As can be appreciated, this keyed nonrotating arrangement allows for quick and easy adjustment of each leg 120. The legs 120 are shown in particular configurations (or shown to have a particular shape/design), but it should be appreciated that this is one of many possible configurations/shapes/designs. In some examples, an open end of the front and rear leg tubes 150, 154 may include an anti-rattle sleeve 312 disposed therein. The anti-rattle sleeve 312 may provide a bearing surface between the leg 120 and the front and rear leg tubes 150, 154. Additionally or alternatively, the anti-rattle sleeve 312 may fill a gap between the front and rear leg tubes 150, 154 and a respective leg 120. In some examples, the anti-rattle sleeve 312 may be made from plastic, resin, polyoxymethylene, thermoplastic, etc., and/or other nonmetallic material. In one example, the anti-rattle sleeve 312 may be made from bronze, aluminum-bronze, and/or some other bearing metal material.

Figure 3B:
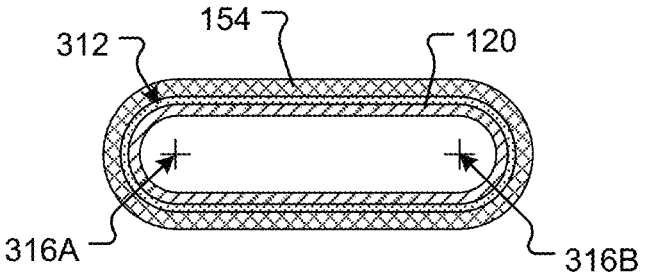
FIG. 3B is a schematic cross-section view of a leg and leg frame of the leg assembly taken through line F1H-F1H in FIG. 1F.

FIG. 3B shows a schematic cross-section view of a leg 120 and a portion of the leg frame 116 shown in FIG. 1F. As illustrated in FIG. 3B, the legs 120 may be slot-shaped (e.g., a rectangle with radiused ends, etc.) that matches an internal shape of the portion of the leg frame 116. For instance, the rear leg tube 154 may correspond to a section of hollow tubing having a slot-shaped internal and external shape. The slot-shaped receptacle of the rear leg tube 154 may extend in distance from the first center point 316A to the second center point 316B. In FIG. 3B, a portion of the anti-rattle sleeve 312 is shown disposed between the leg 120 and the slot-shaped receptacle of the rear leg tube 154. Incorporating radiused tubing for the leg frame 116, including the front leg tube 150 and the rear leg tube 154 allows for enhanced washdown capabilities over square, rectangular, or non-radiused shapes. Although shown taken through the rear leg tube 154 of the leg frame 116, the same, or similar, arrangement may apply to a cross-section taken through a corresponding location of the front leg tube 150 of the leg frame 116.

Figure 4B:
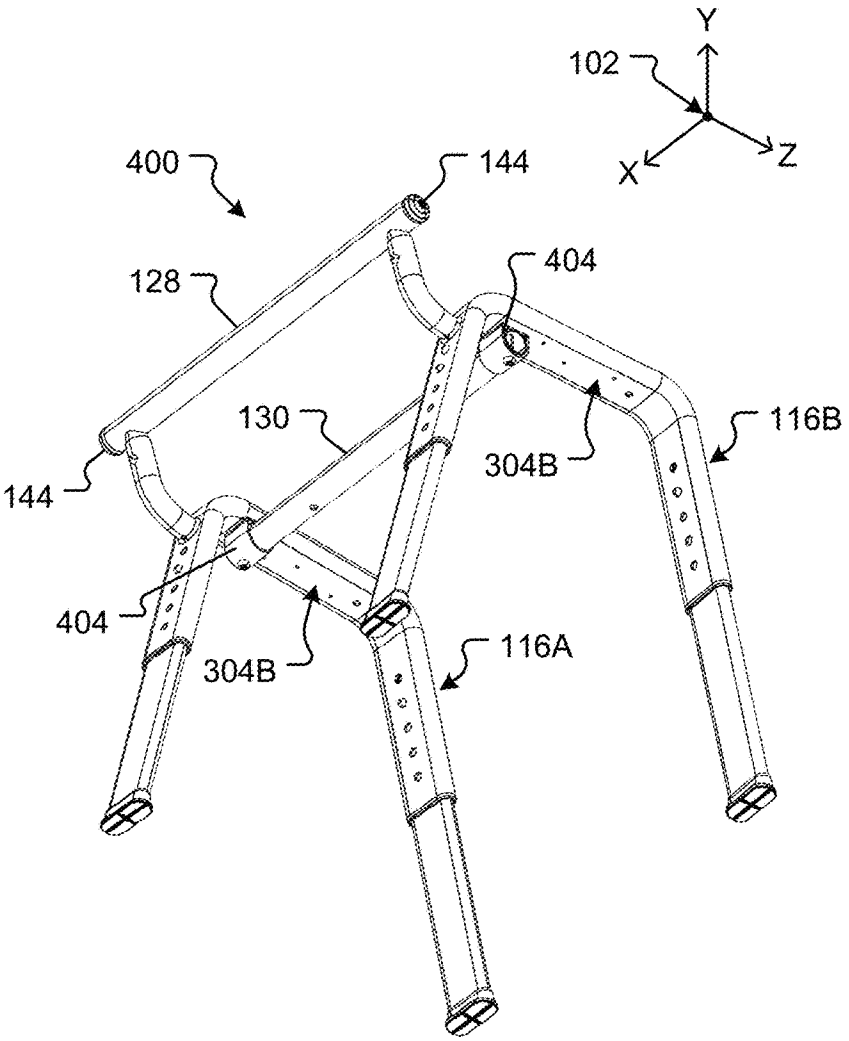
FIG. 4B is a bottom rear perspective view of the subframe of the shower chair shown in FIG. 4A.
Figure 4A:
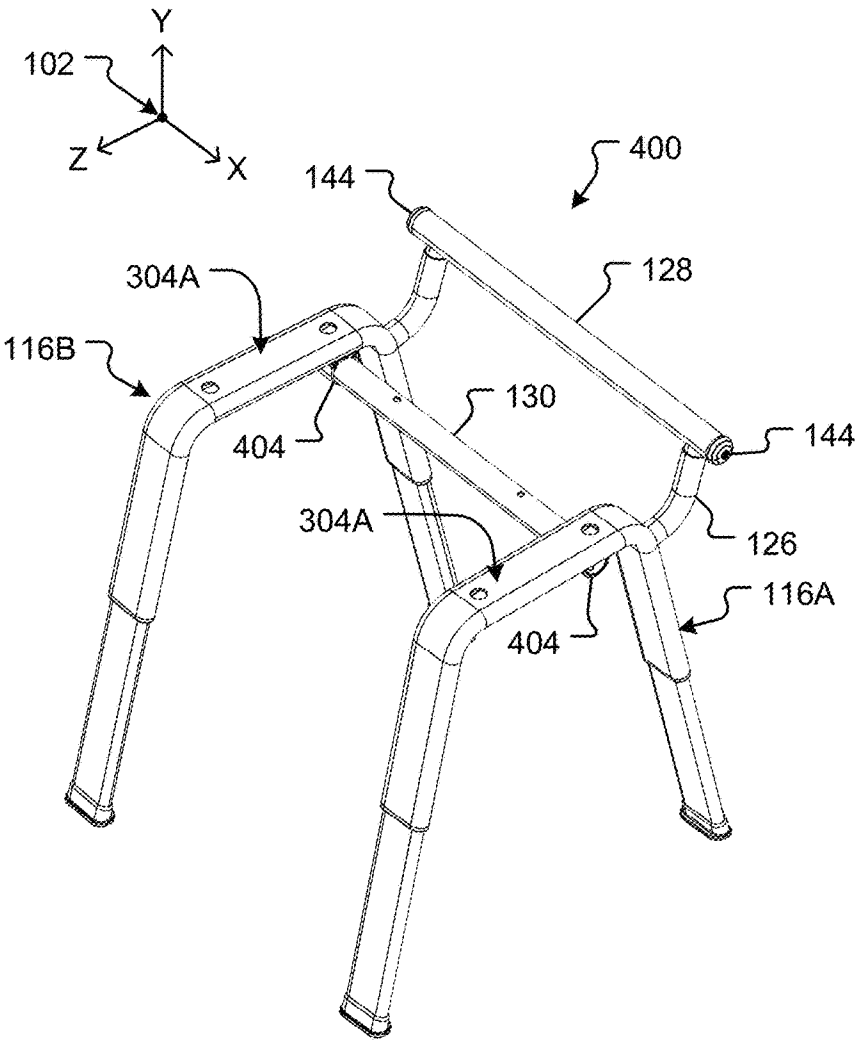
FIG. 4A is a top front perspective view of a subframe of the shower chair in accordance with examples of the present disclosure.

FIGS. 4A and 4B show various perspective views of a subframe assembly 400 in accordance with examples of the present disclosure. The subframe assembly 400 may include the first leg frame 116A, the second leg frame 116B, the lower support crossbar 130, and the upper support crossbar 128. The lower support crossbar 130 may be attached to the first leg frame 116A via a first bracket 404 and the second leg frame 116B via a second bracket 404. The upper support crossbar 128 connects to the tube 126 of each of the leg frames 116A, 116B. As described above, the subframe assembly 400 may include end caps 144 that are inserted into opposing ends of the upper support crossbar 128. These end cap 144 may be removed to accommodate an armrest, a sprayer holder 132, and/or other object. The subframe assembly 400 may serve as the base support framework for the shower chair 100 as described herein. In one example, the subframe assembly 400 may correspond to a shower chair 100 with the seat pan 104 and backrest 108 removed.

Figure 5:
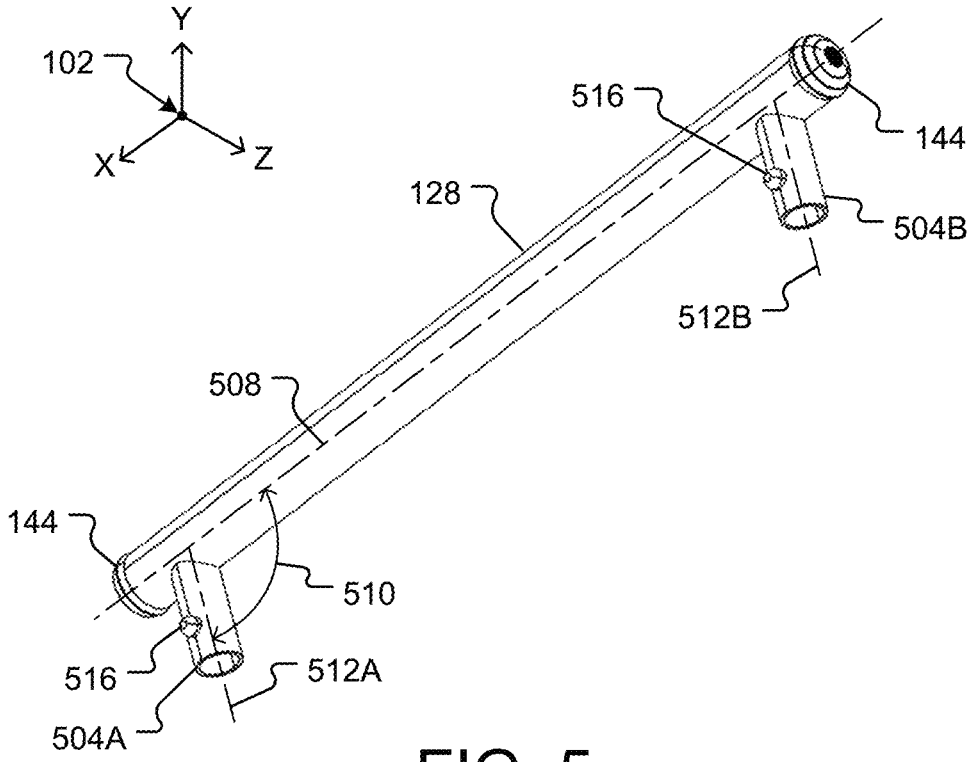
FIG. 5 is a bottom rear perspective view of the upper support crossbar of the shower chair in accordance with examples of the present disclosure.

FIG. 5 shows a bottom rear perspective view of the upper support crossbar 128 of the shower chair 100 in accordance with examples of the present disclosure. The upper support crossbar 128 may comprise a tubular member extending along a crossbar axis 508 from a first end to a second end. The tubular member may correspond to a round hollow tube. The upper support crossbar 128 may comprise a first post 504A formed adjacent a first end thereof and a second post 504B formed adjacent a second, opposite, end thereof. In one example, the first post 504A and/or the second post 504B may be welded to the upper support crossbar 128. In any event, the first post 504A may be attached to the upper support crossbar 128 such that the first post axis 512A, of the first post 504A, is disposed at an orthogonal angle 510 (e.g., 90 degrees, etc.) to the crossbar axis 508. Similarly, the second post 504B may be attached to the upper support crossbar 128 such that the second post axis 512B, of the second post 504B, is disposed at an orthogonal angle 510 to the crossbar axis 508. In one example, the first post axis 512A may be parallel to the second post axis 512B. The first post 504A and/or the second post 504B may comprise a spring pin 516 that retracts, at least partially, into a portion of the post 504A, 504B. In some examples, the upper support crossbar 128 may attach to the tube 126 of the first leg frame 116A and the tube 126 of the second leg frame 116B and be retained therein by the spring pin 516 of each post 504A, 504B engaging with the pin receiving receptacle 310 of each tube 126. In some examples, the spring pin 516 may be the same as, or similar to, the spring pin 146 described in conjunction with FIGS. 1A-1H, or vice versa.

Figure 6:
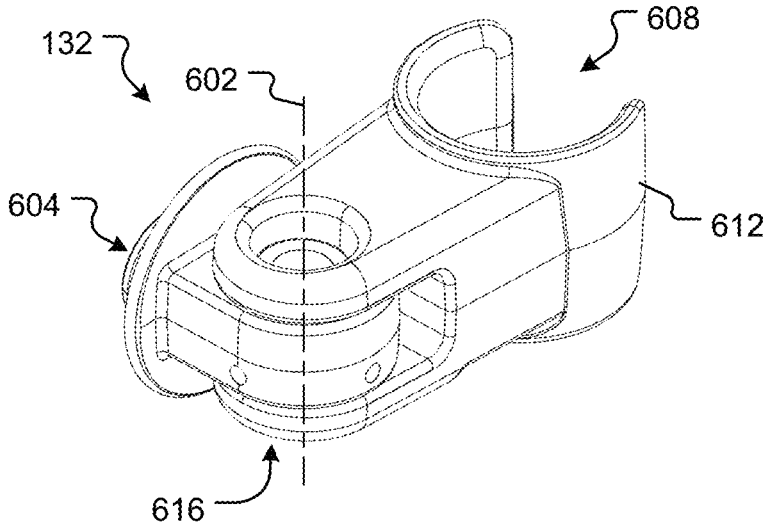
FIG. 6 is a perspective view of the sprayer holder in a retracted position in accordance with examples of the present disclosure.

FIG. 6 is a perspective view of the sprayer holder 132 in a retracted position in accordance with examples of the present disclosure. The sprayer holder 132 may be added to any connection receptacle 158 of the seat pan 104, and/or an open tube end of the subframe assembly 400 of the seat shower chair 100. In one example, the sprayer holder 132 may comprise a first end 604 that inserts into the connection receptacle 158 of the first side surface 138 and/or second side surface 142. In some examples, the sprayer holder 132 may be excluded, or removed, from the shower chair 100. In these cases, the connection receptacle 158 may be covered by a cover plug 164.

The sprayer holder 132 may have an extended state and a retracted state. In the extended state, a second end 608 of the sprayer holder 132 including clamp 612 (e.g., one or more of a hook, finger, etc.) may be revealed from beneath the seat pan 104 of the shower chair 100 (e.g., as shown in FIG. 1G). The clamp 612 of the second end 608 may be configured to engage with, retain, grasp, or otherwise hold a shower sprayer handle, hose, or other portion of a washing appliance. In the retracted state, the second end 608 of the sprayer holder 132 may be concealed beneath the seat pan 104 of the shower chair 100. The second end 608 may pivot relative to the first end 604 about a pivot axis 602 of a hinge 616 (e.g., a joint, knuckle, etc.) disposed along the length of the sprayer holder 132 running from the first end 604 to the second end 608 thereof.

Figure 7B:
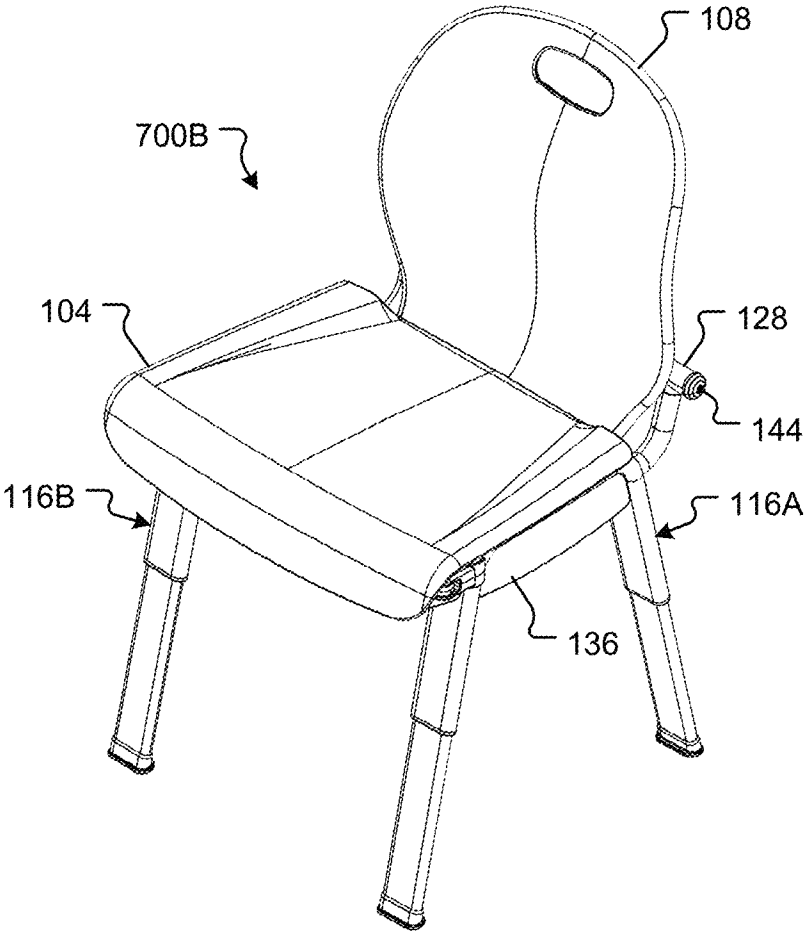
FIG. 7B is a perspective view of a chair configuration of the shower chair in accordance with examples of the present disclosure.
Figure 7A:
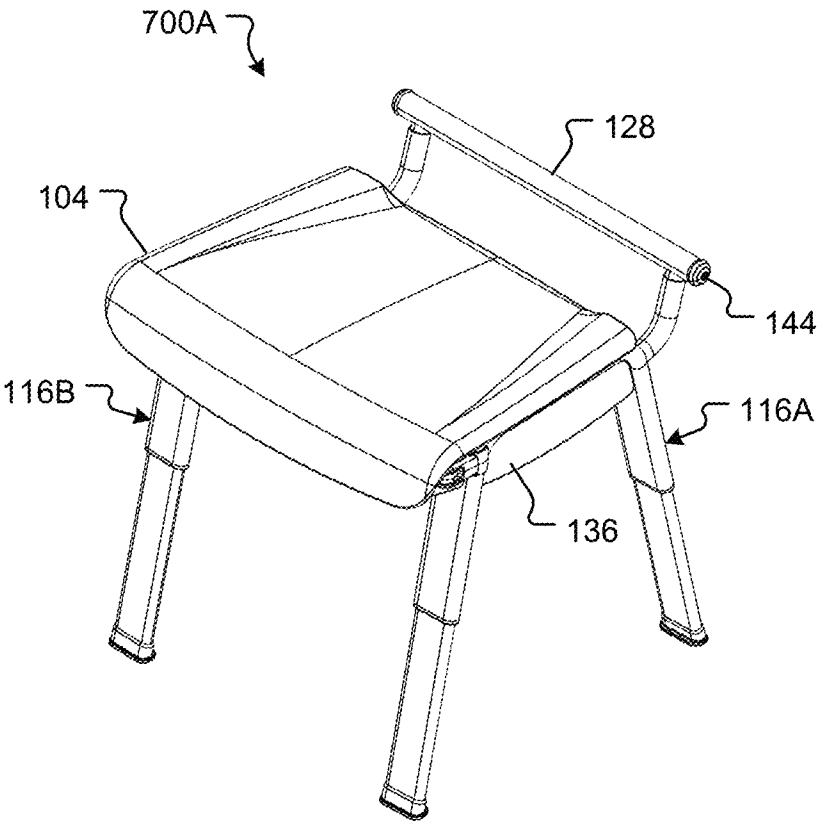
FIG. 7A is a perspective view of a stool configuration of the shower chair in accordance with examples of the present disclosure.
Figure 8A:
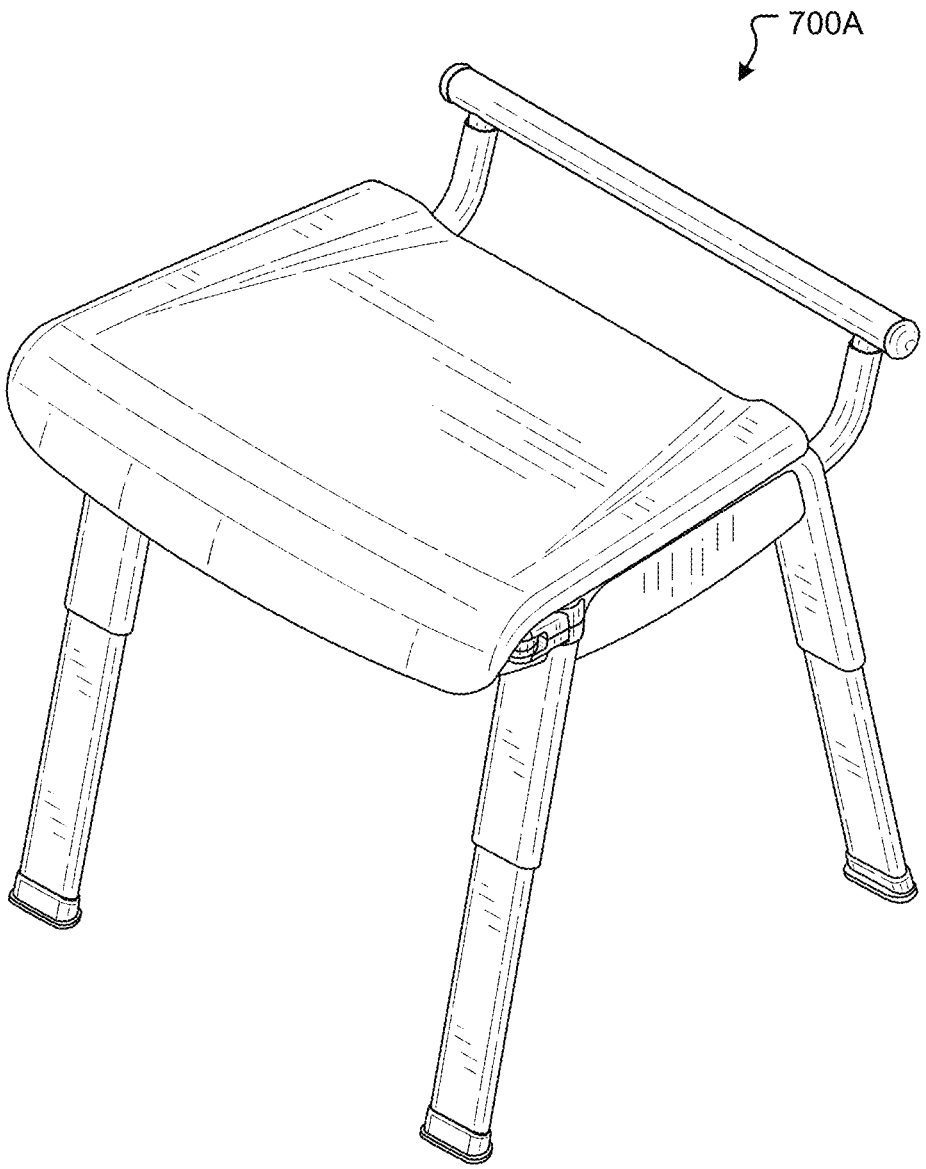
FIG. 8A is a top front perspective view of the shower chair in the stool configuration in accordance with examples of the present disclosure.
Figure 8B:
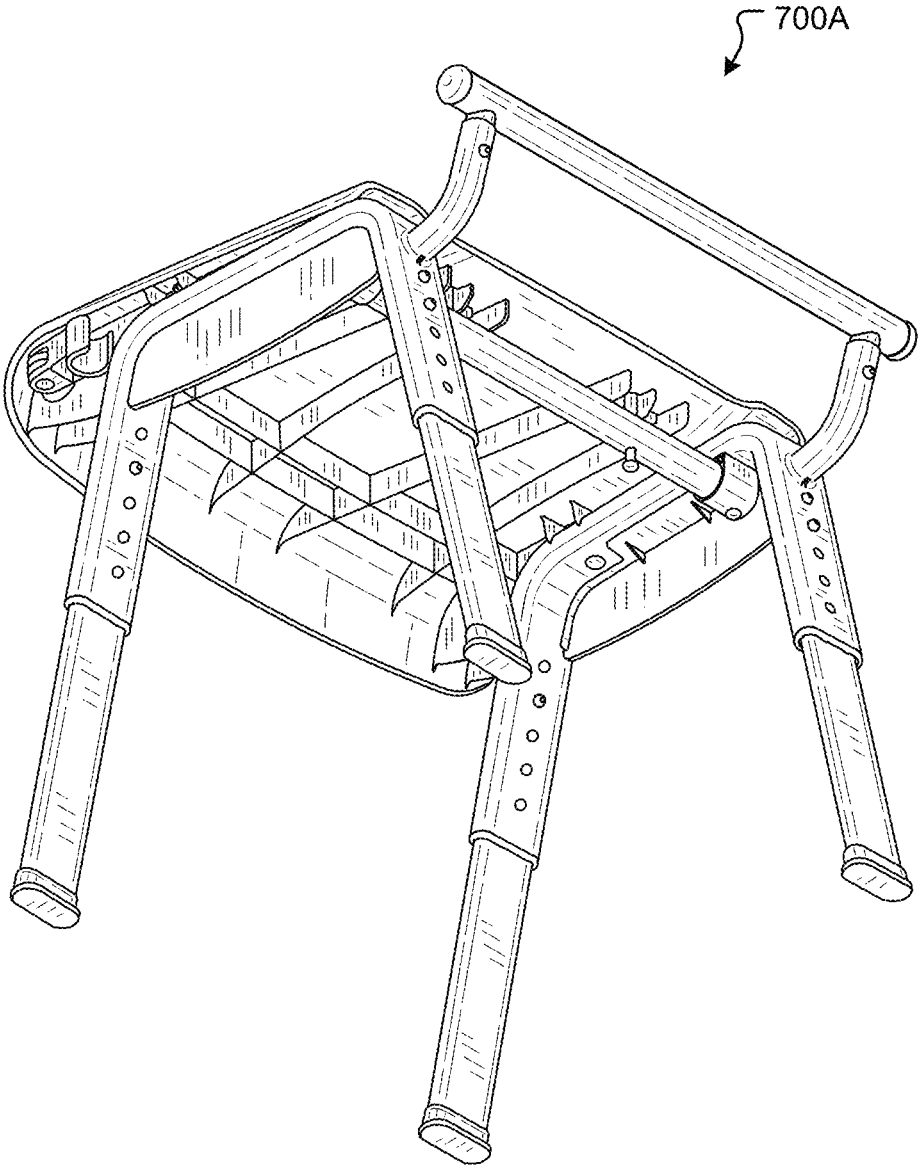
FIG. 8B is a bottom rear perspective view of the shower chair of FIG. 8A.
Figure 8C:
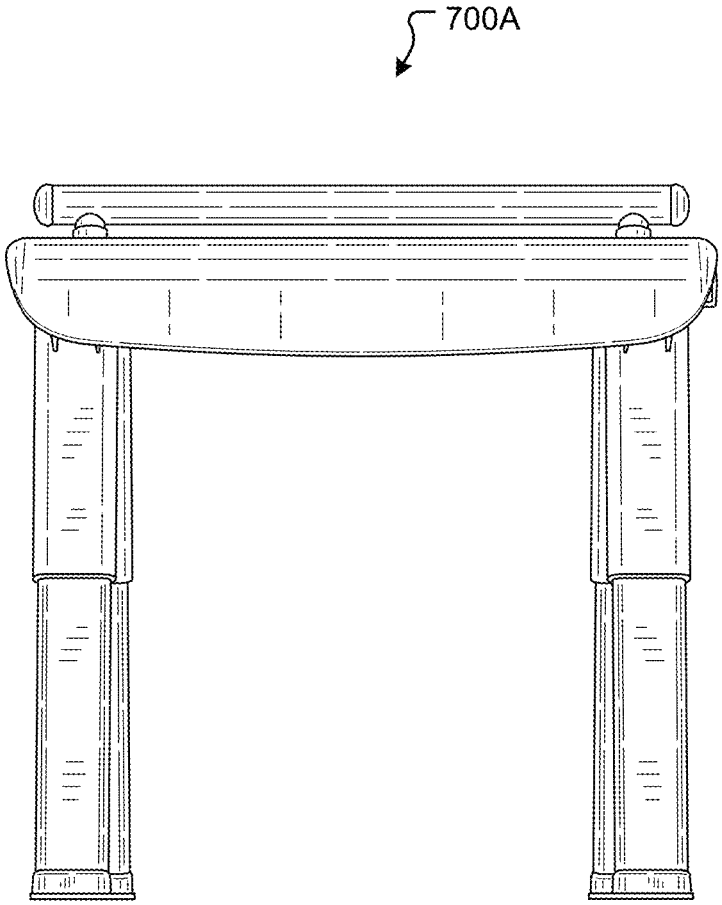
FIG. 8C is a front elevation view of the shower chair of FIG. 8A.
Figure 8D:
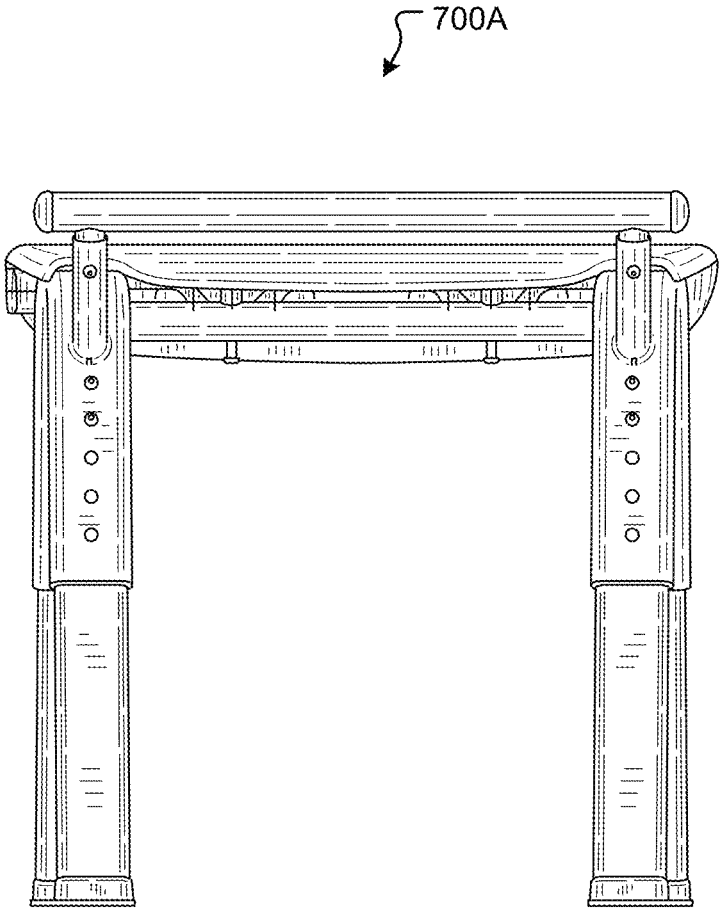
FIG. 8D is a rear elevation view of the shower chair of FIG. 8A.
Figure 8E:
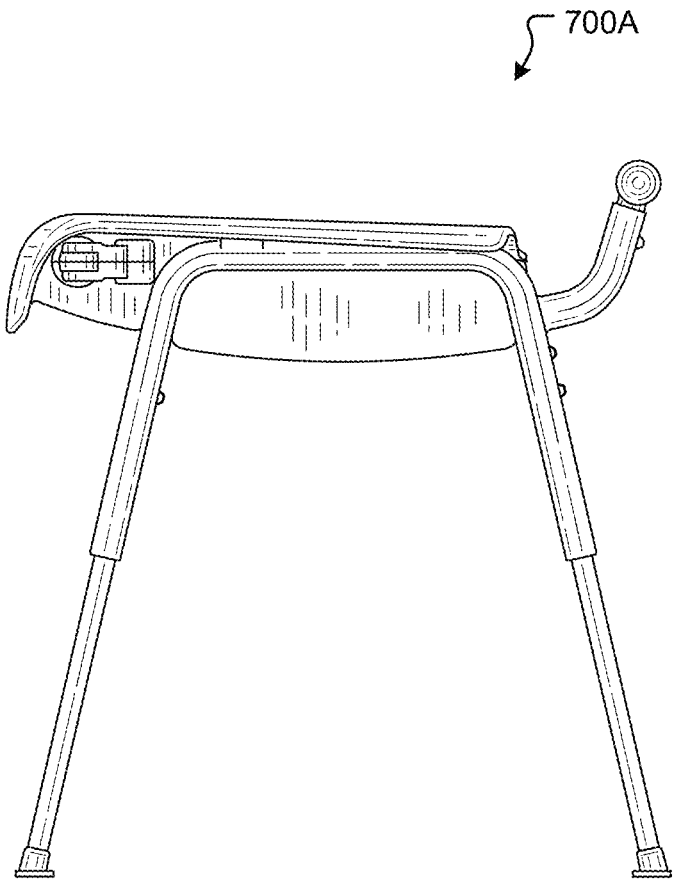
FIG. 8E is a right side elevation view of the shower chair of FIG. 8A.
Figure 8F:
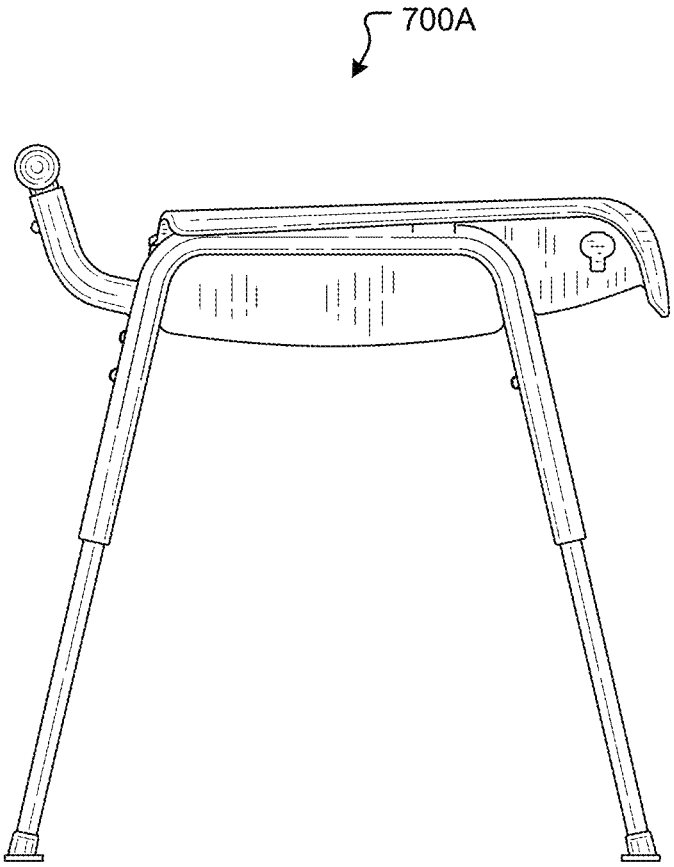
FIG. 8F is a left side elevation view of the shower chair of FIG. 8A.
Figure 8H:
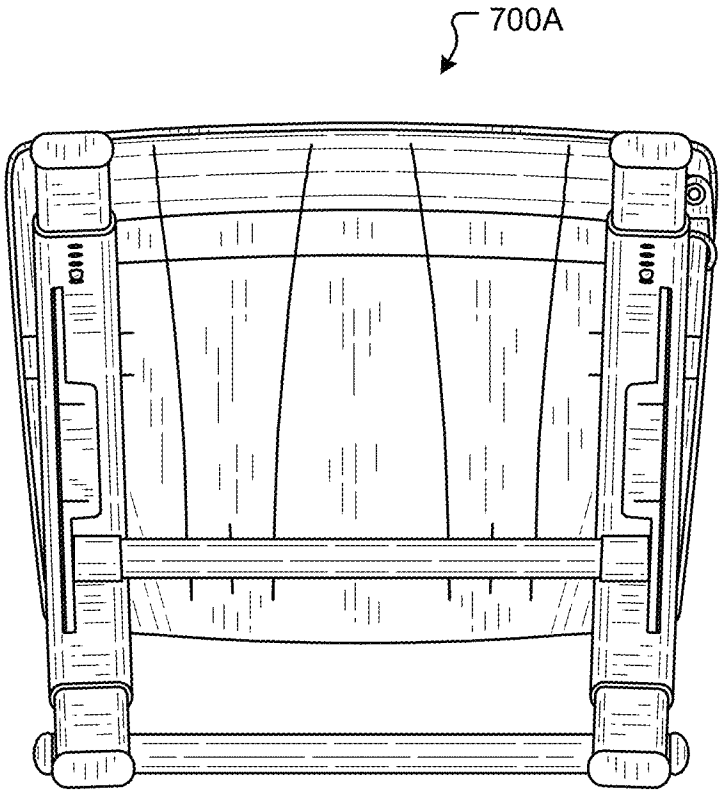
FIG. 8H is a bottom plan view of the shower chair of FIG. 8A.
Figure 8G:
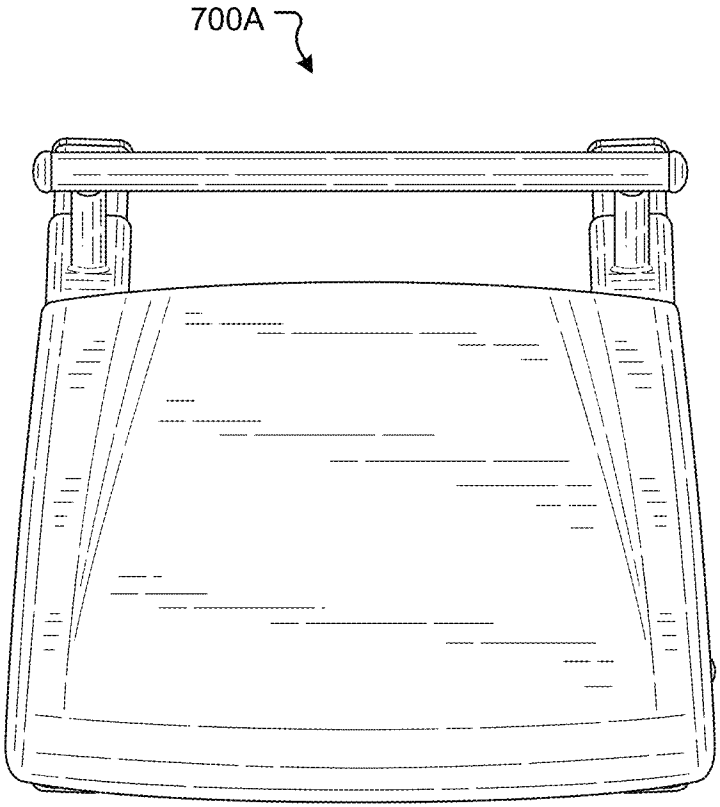
FIG. 8G is a top plan view of the shower chair of FIG. 8A.
Figure 9A:
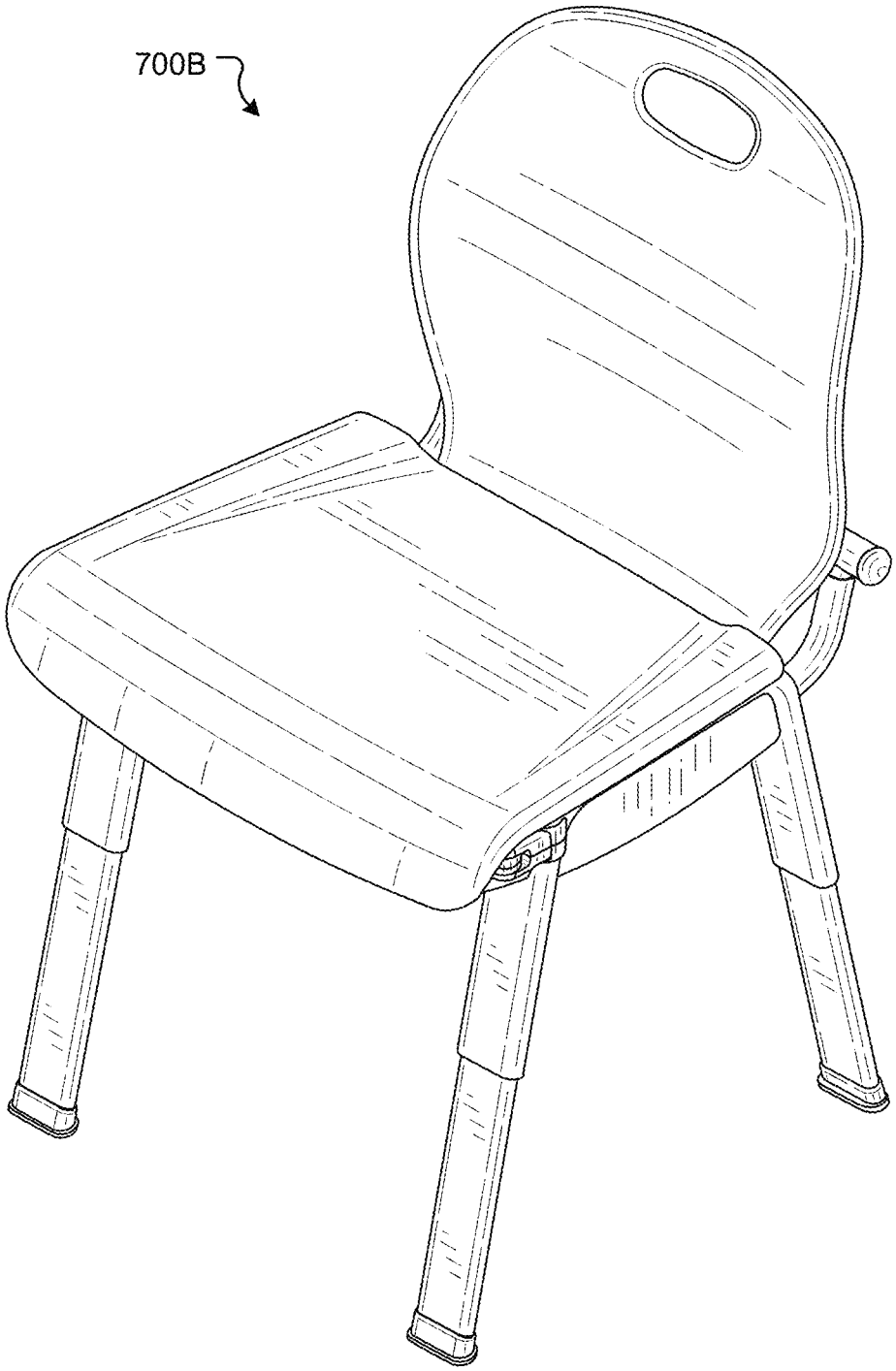
FIG. 9A is a top front perspective view of the shower chair in the chair configuration in accordance with examples of the present disclosure.
Figure 9B:
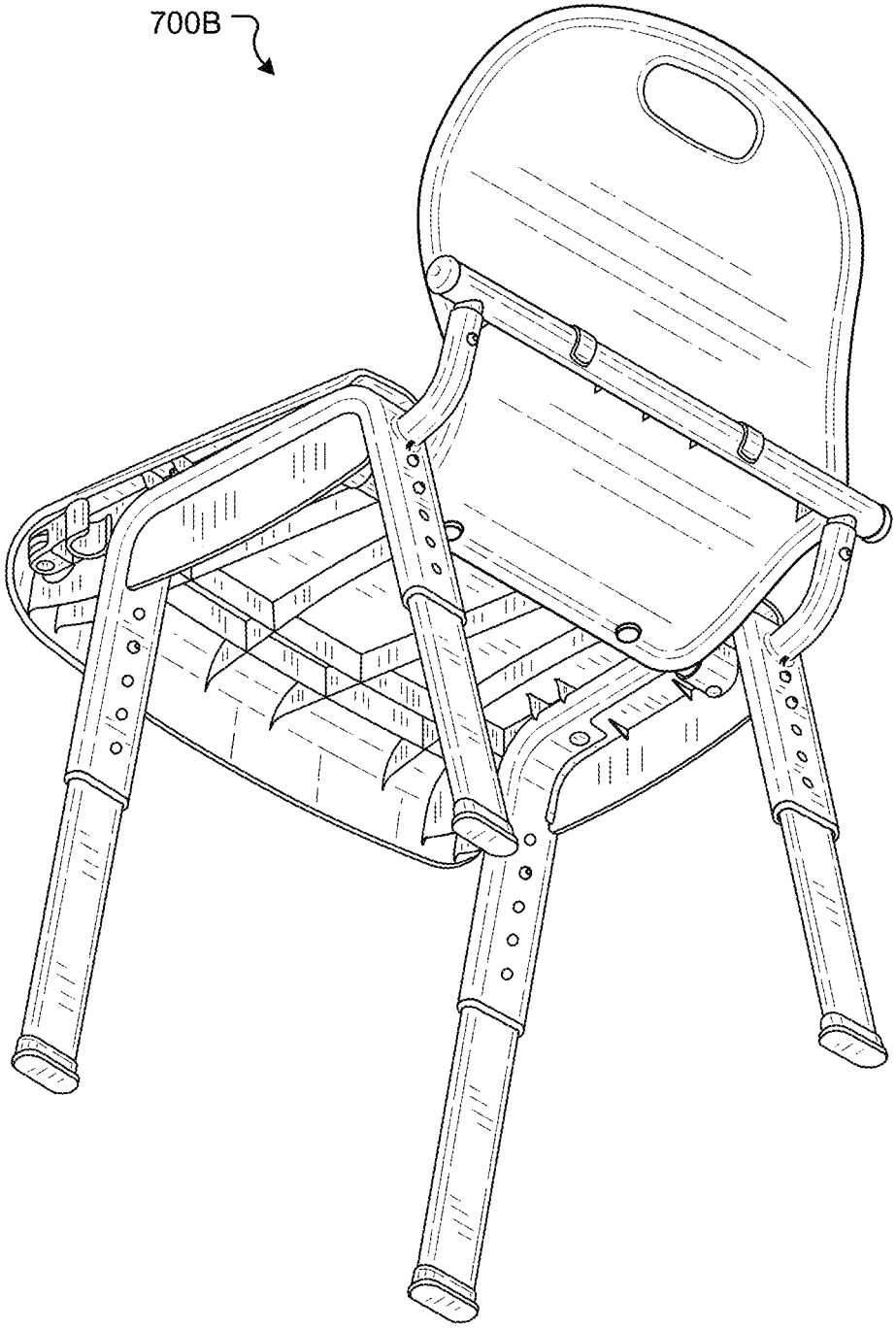
FIG. 9B is a bottom rear perspective view of the shower chair of FIG. 9A.
Figure 9C:
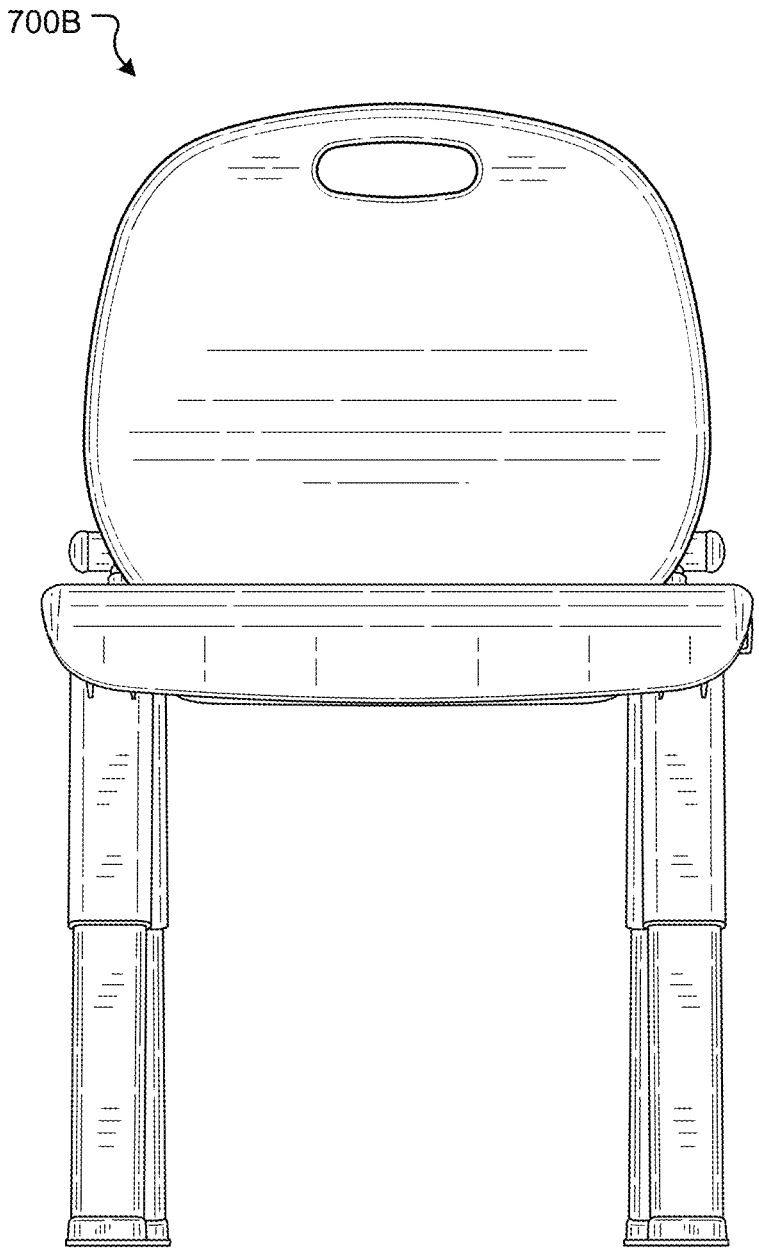
FIG. 9C is a front elevation view of the shower chair of FIG. 9A.
Figure 9D:
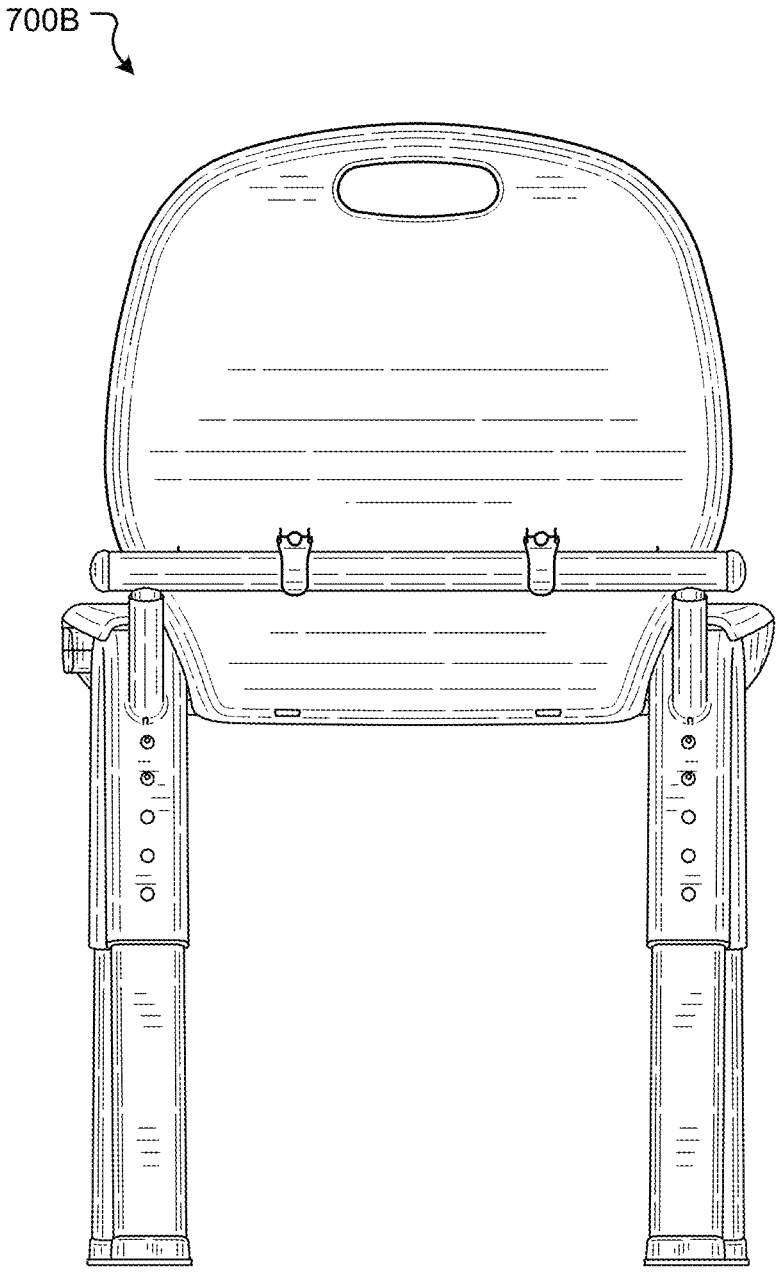
FIG. 9D is a rear elevation view of the shower chair of FIG. 9A.
Figure 9E:
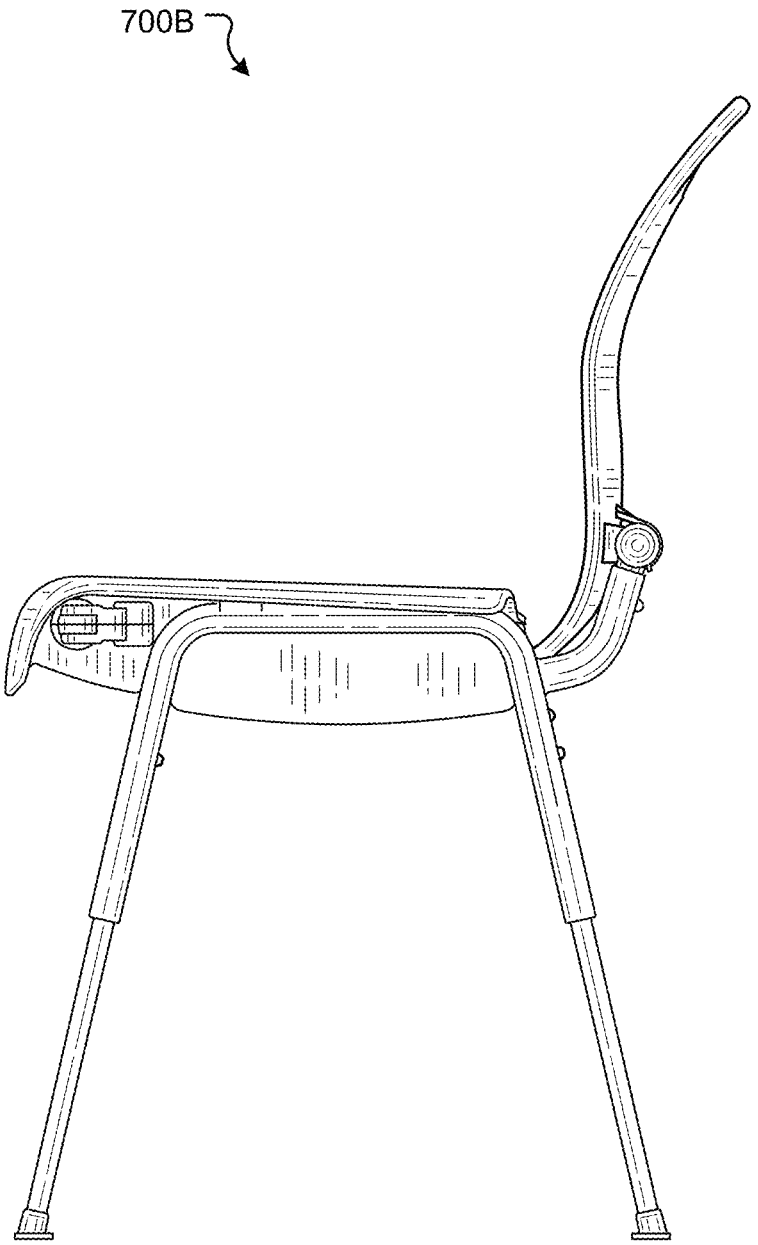
FIG. 9E is a right side elevation view of the shower chair of FIG. 9A.
Figure 9F:
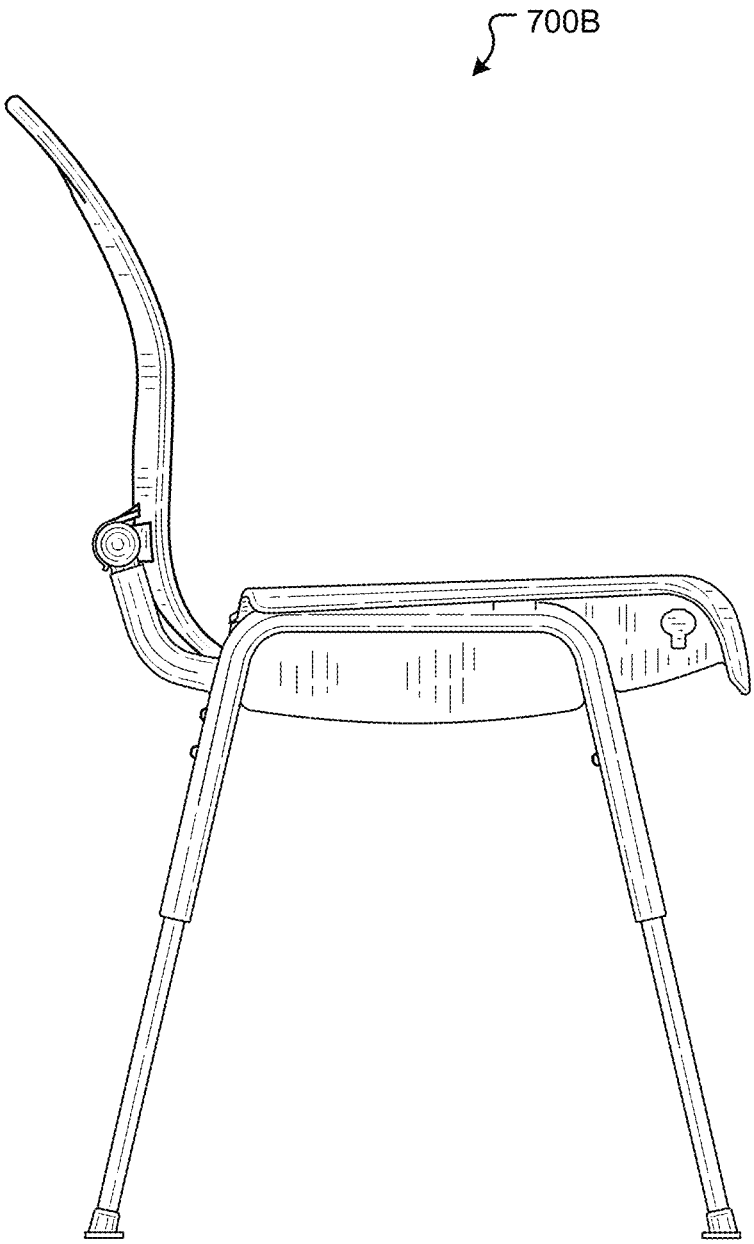
FIG. 9F is a left side elevation view of the shower chair of FIG. 9A.
Figure 9H:
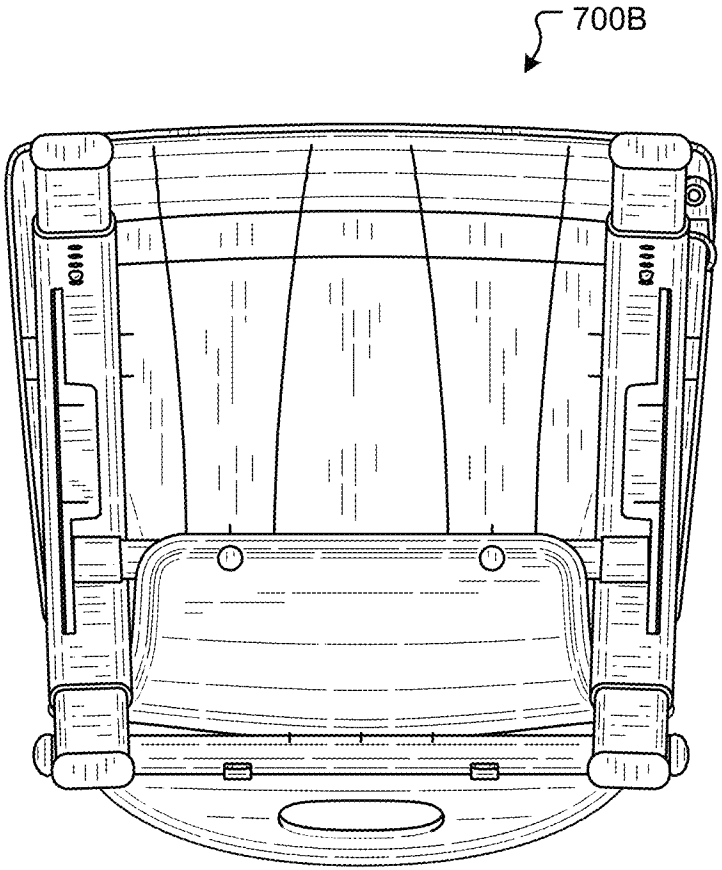
FIG. 9H is a bottom plan view of the shower chair of FIG. 9A.
Figure 9G:
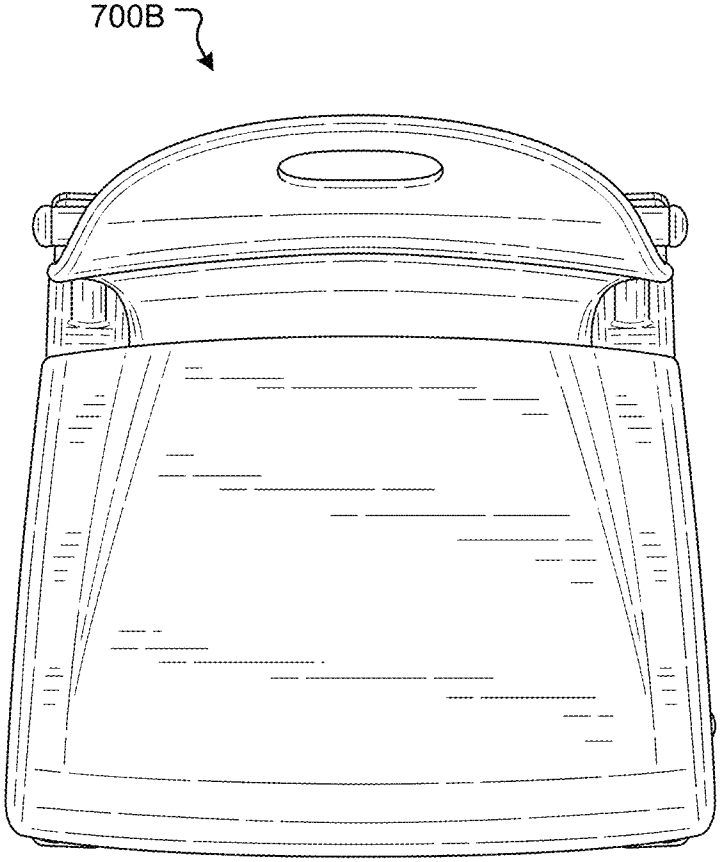
FIG. 9G is a top plan view of the shower chair of FIG. 9A.

FIGS. 7A-7B show perspective views of the shower chair 100 in various configurations. According to at least one example of the present disclosure, the shower chair 100 may be converted between a "chair" configuration 700B and a "stool" configuration 700A by detaching the backrest 108 from the shower chair 100, or vice versa.

FIG. 7A is a perspective view of the stool configuration 700A of the shower chair in accordance with examples of the present disclosure. In the stool configuration 700A, the shower chair 100 excludes the backrest 108 and any optional armrests (not shown). In FIG. 7B, a perspective view of the chair configuration 700B of the shower chair 100 is shown in accordance with examples of the present disclosure. The chair configuration 700B of the shower chair 100 includes the backrest 108, but excludes any optional armrests. In another configuration (not shown), an armchair configuration of the shower chair 100 may include the features shown in the chair configuration 700B along with one or more armrests disposed in the ends of the upper support crossbar 128 in place of the end caps 144.

FIG. 8A-8H show additional views of the shower chair 100 in the stool configuration 700A for illustrative purposes.

FIGS. 9A-9H show additional views of the shower chair 100 in the chair configuration 700B for illustrative purposes.

Figure 10A:
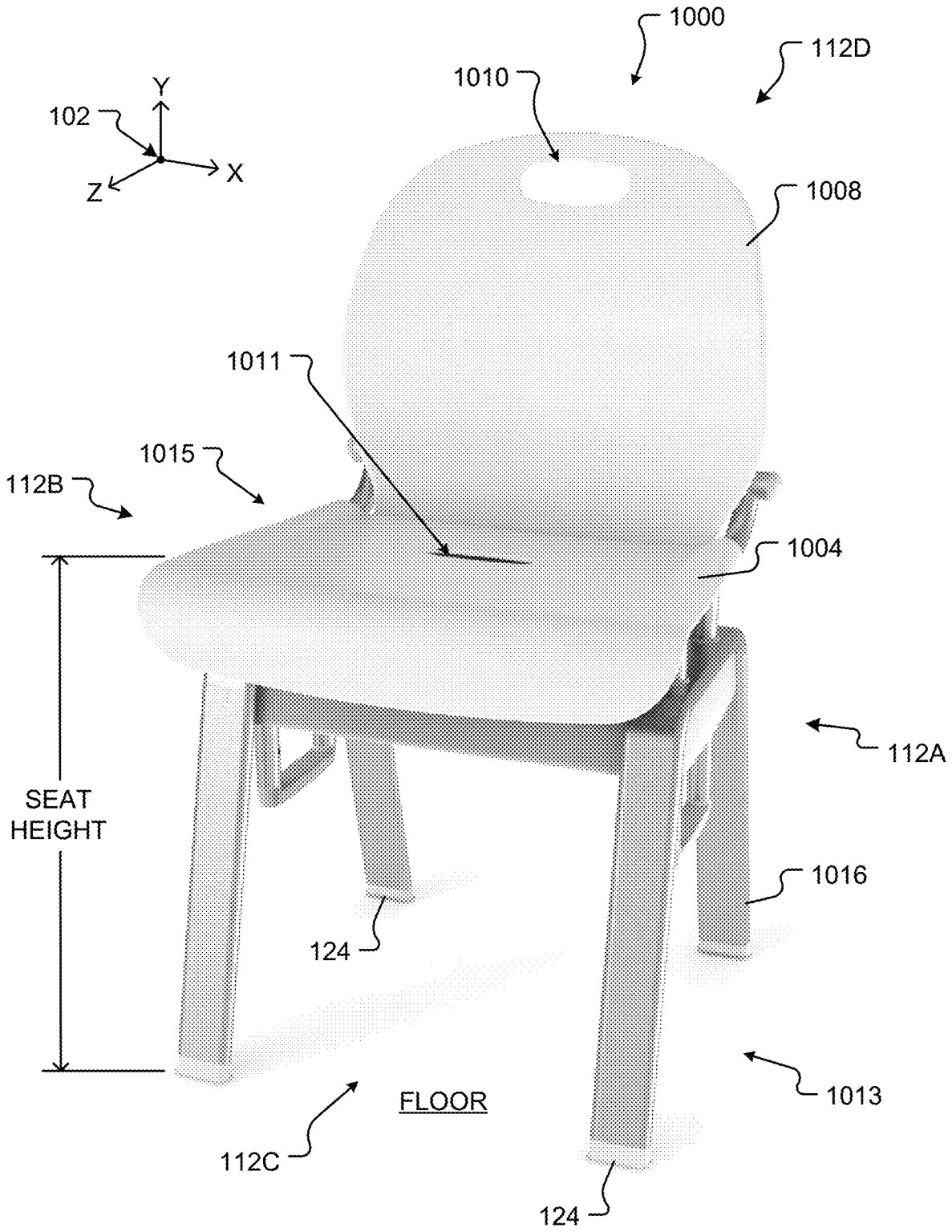
FIG. 10A is a perspective view of the shower chair in accordance with examples of the present disclosure.
Figure 10B:
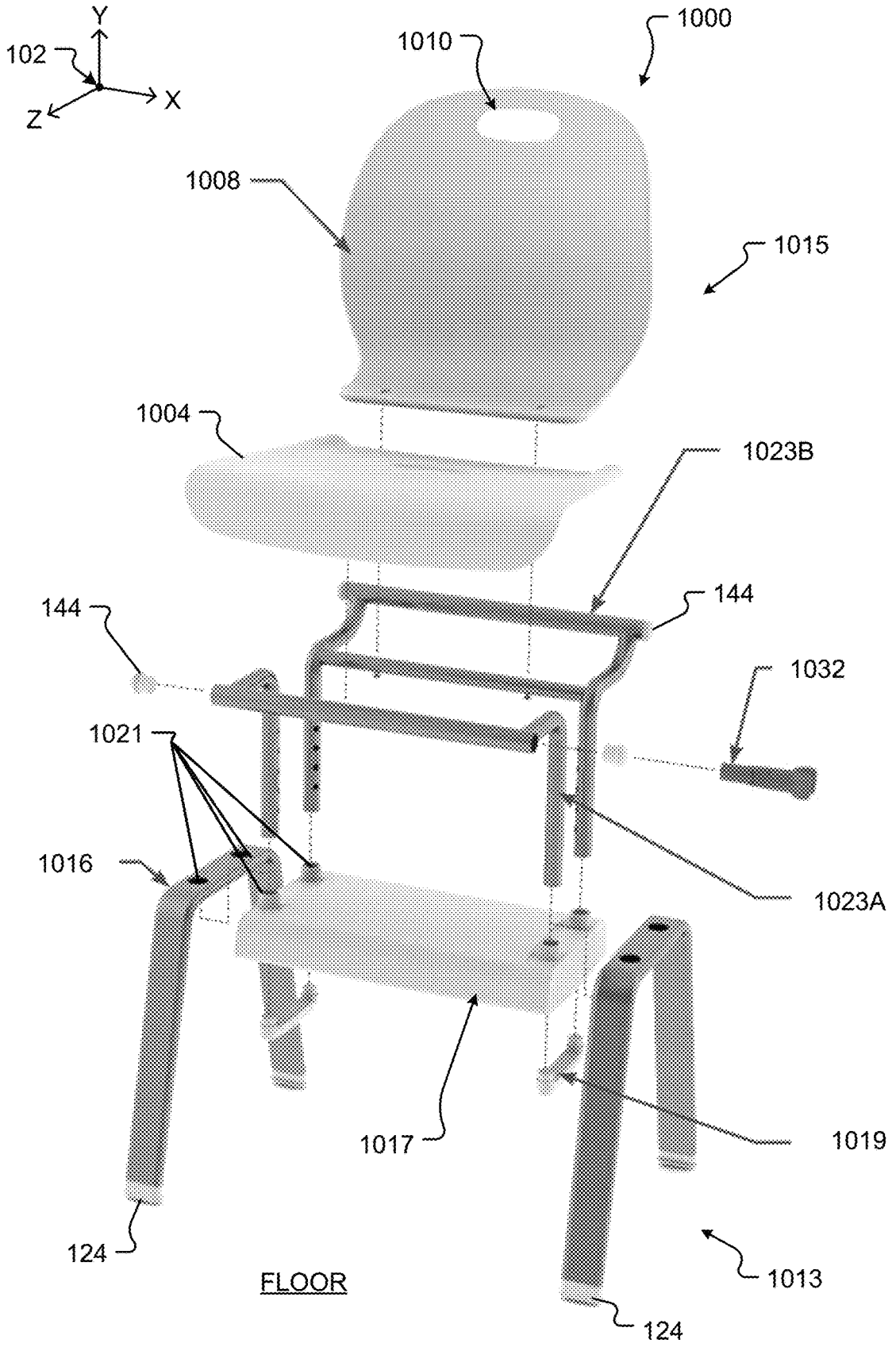
FIG. 10B is an exploded perspective view of the shower chair in accordance with examples of the present disclosure.

FIGS. 10A-10B show various perspective views of a shower chair 1000 in accordance with examples of the present disclosure. The shower chair 1000 may comprise a leg assembly 1013, or base, and a seat assembly 1015. In some examples, the overall seat height of the shower chair 1000 may be adjusted by moving the seat assembly 1015 relative to the leg assembly 1013.

The seat assembly 1015 may comprise front and rear seat tubes 1023A, 1023B, a seat pan 1004, a backrest 1008, and seat tube end caps. In some examples, the seat pan 1004 may attach to a tubular framework formed by the front seat tube 1023A and the rear seat tube 1023B. The front seat tube 1023A may comprise two vertical posts that bend and join to a front crossbar extending a width (e.g., measured along the X-axis) of the shower chair 1000. Similarly, the rear seat tube 1023B may comprise two vertical posts that bend and join to a rear crossbar extending a width of the shower chair 1000. In addition to the rear crossbar, the rear seat tube 1023B may comprise a backrest attachment bar extending from one vertical post of the rear seat tube 1023B to the other vertical post of the rear seat tube 1023B. In some examples, this backrest attachment bar may include attachment pins that engage with receiving features of the backrest 1008. When engaged, the attachment pins may fasten the backrest 1008 to the backrest attachment bar. Open ends of the rear crossbar may be covered, or sealed, with end caps 144. In some examples, both open ends of the front crossbar may be covered, or sealed, with end caps 144. In one example, at least one open end of the front and/or rear crossbar may receive a sprayer holder 1023. The front seat tube 1023A and the rear seat tube 1023B may be connected to one another by seat tube end caps 1019 attached to a lower end (e.g., an end closest to the floor, etc.) of the vertical posts of the front and rear seat tubes 1023A, 1023B. The upper end of the front and rear seat tubes 1023A, 1023B may interconnect (e.g., fasten, lock, etc.) with the underside of the seat pan 1004. The floor may correspond to an interior of a bathtub, a shower pan, and/or some other washdown surface. Additional details surrounding the seat assembly 1015 are described in conjunction with FIGS. 11A-11C.

The leg assembly 1013, or base, may comprise two leg frames 1016 interconnected to one another via a structural beam 1017. Each of the leg frames 1016 may comprise a length of rectangular tubing (e.g., aluminum, stainless steel, etc.) that are bent such that ends of each leg frame 1016 are facing the floor. Each end of a leg frame 1016 may include a foot 124. The foot 124 may be made from a nonslip grip material (e.g., rubber, silicone, urethane, etc.). In one example, the foot 124 may insert into the end of the leg frame 1016, wrap around the end of the leg frame 1016, and/or combinations thereof. The leg frame 1016 may include several through-holes 1021 disposed therein that engage with portions of the structural beam 1017. The structural beam 1017 may comprise protrusions that insert into these through-holes 1021. Additional details surrounding the leg assembly 1013 are described in conjunction with FIGS. 13A-13B.

As shown in FIG. 10A, the seat assembly 1015 slidably, and adjustably, interconnects with the leg assembly 1013 via the vertical posts of the front and rear seat tubes 1023A, 1023B engaging with the seat tube receiving holes 1021 disposed in the leg frames 1016 and structural beam 1017 of the leg assembly 1013. In assembling the shower chair 1000, the vertical posts of the front and rear seat tubes 1023A, 1023B of the seat assembly 1015 may be aligned with the seat tube receiving holes 1021 in the leg assembly 1013 and the seat assembly 1015 lowered toward the floor such that the vertical tubes pass through the seat tube receiving holes 1021. Once disposed through the seat tube receiving holes 1021, the seat tube end caps 1019 may be attached to the open ends of the front and rear seat tubes 1023A, 1023B on a first side and a second opposite side of the width of the shower chair 1000 joining the front seat tubes 1023A to the rear seat tubes 1023B and providing a structural member between the front and rear of the seat assembly 1015.

Figure 11A:
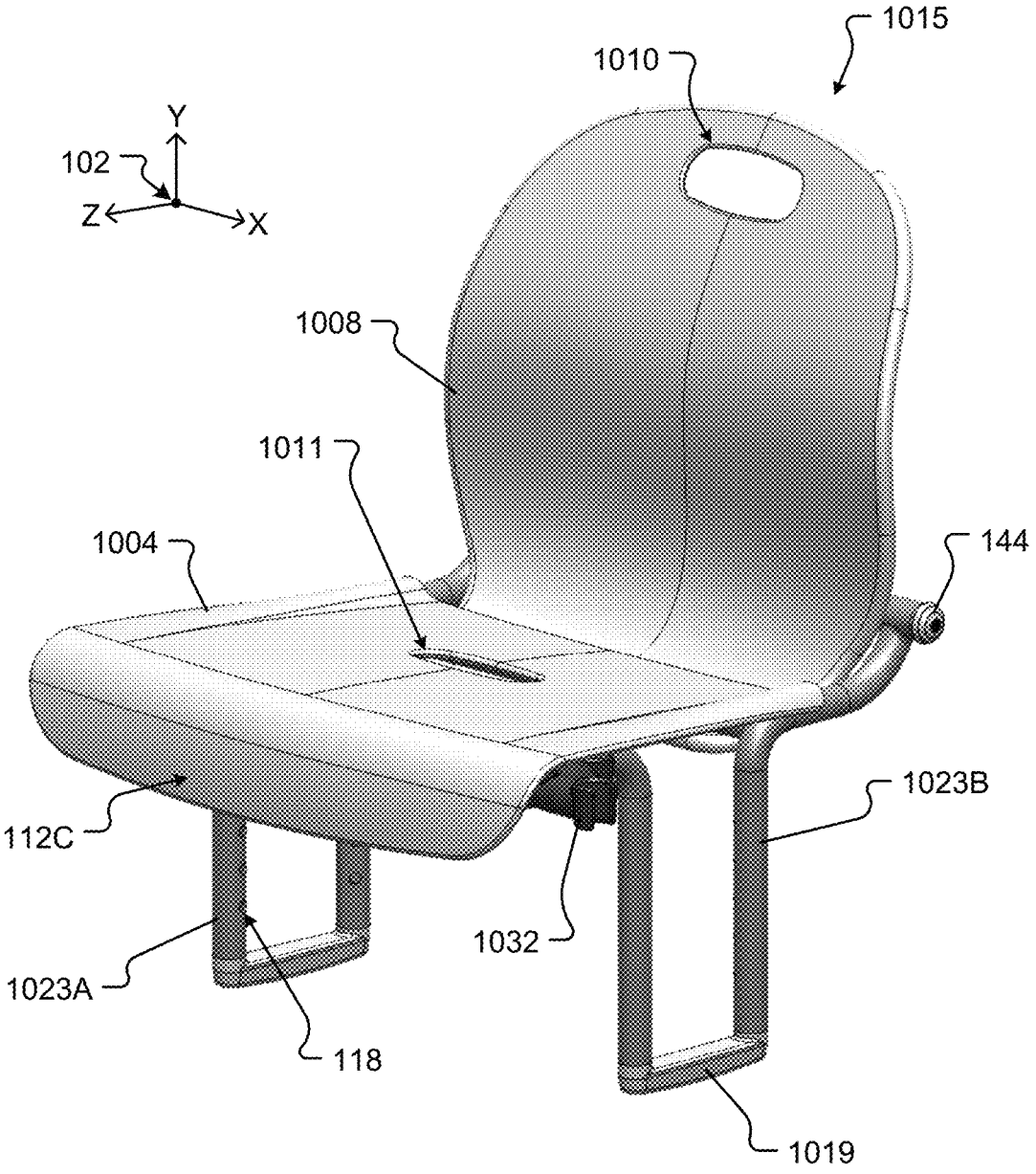
FIG. 11A is a perspective view of the seat assembly of the shower chair in accordance with examples of the present disclosure.
Figure 11B:
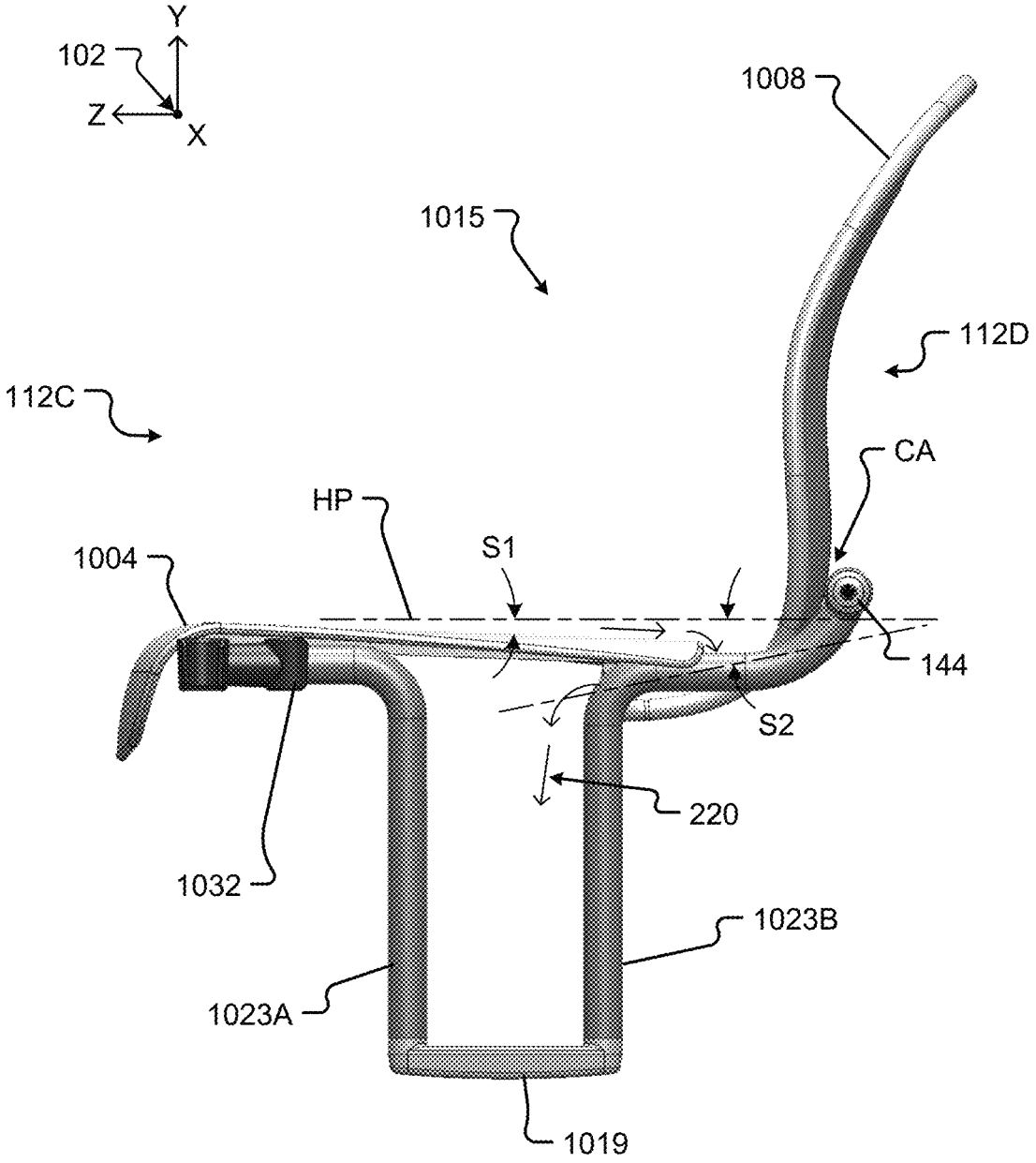
FIG. 11B is a side elevation view of the seat assembly of the shower chair in accordance with examples of the present disclosure.
Figure 11C:
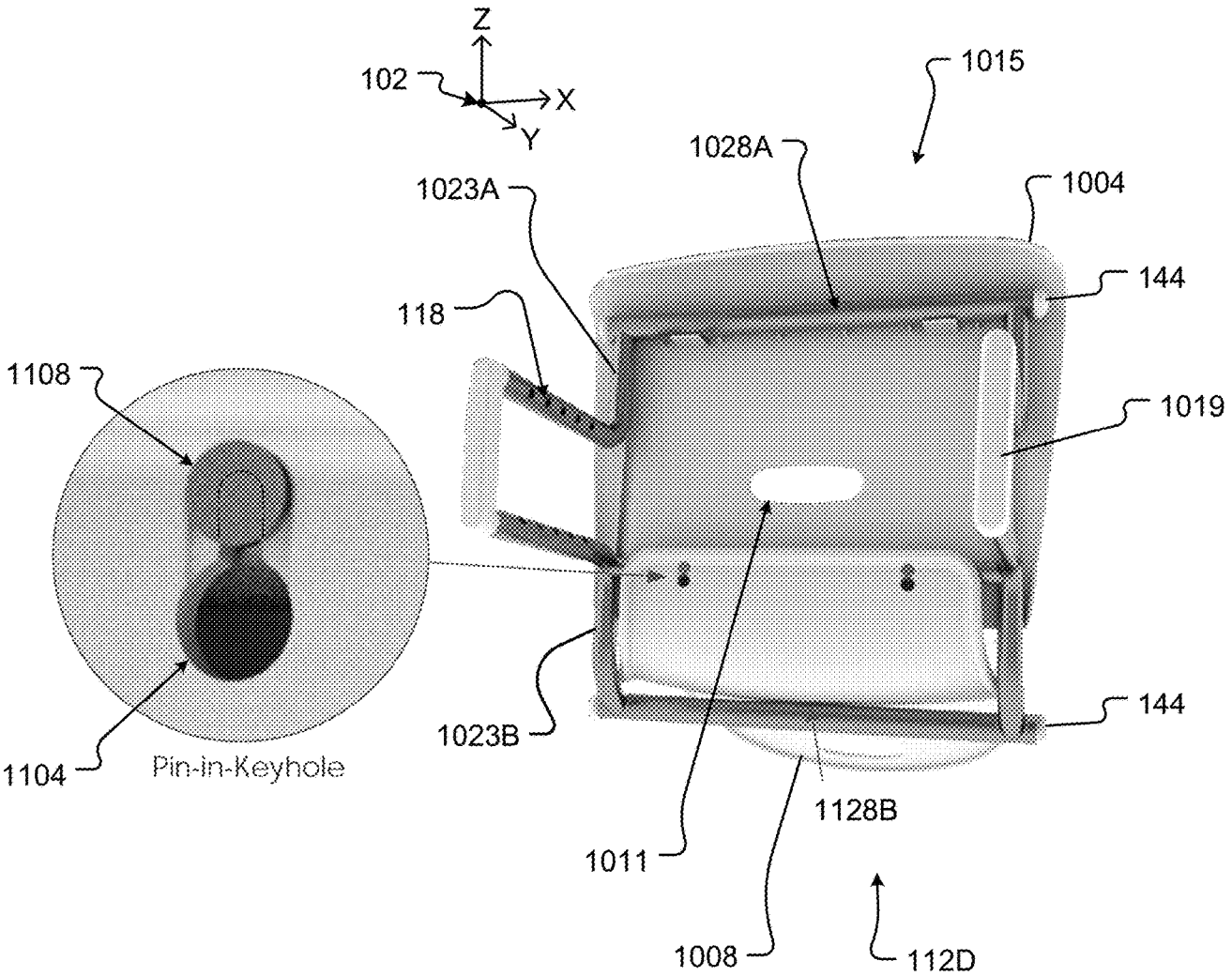
FIG. 11C is a bottom perspective view of the seat assembly of the shower chair showing the backrest attachment in accordance with examples of the present disclosure.

FIGS. 11A-11C show various views of the seat assembly 1015 in accordance with examples of the present disclosure. As described above, the seat assembly 1015 comprises a front and rear seat tube 1023A, 1023B (e.g., a tubular framework) to which the seat pan 1004 and the backrest 1008 are attached. As shown in the perspective view of FIG. 11A, the seat assembly 1015 comprises a number of integrated handles and/or adjustment apertures. For instance, a handle 1010 may be disposed in the backrest 1008 of the shower chair 1000. A user of the shower chair 1000 may grasp the shower chair 1000 using the handle 1010 to lift, move, or otherwise maneuver the shower chair 1000. The adjust aperture 1011 may be disposed in the seat pan 1004 of the seat assembly 1015. This adjust aperture 1011 may provide a handle by which the seat assembly 1015 can be lifted (e.g., during adjustment) relative to the leg assembly 1013 of the shower chair 1000. Additionally or alternatively, the adjust aperture 1011 may serve as an opening, through which water, soap, and/or other material may pass during use (e.g., washing and/or cleaning operations, etc.).

Referring to FIG. 11B, a side elevation view of the seat assembly 1015 of the shower chair 1000 is shown in accordance with examples of the present disclosure. In some examples, the surfaces of the seat pan 1004, the backrest 1008, and/or other components of the shower chair 1000 may be sloped, inclined, or angled relative to a horizontal reference plane. These angled surfaces may be configured to allow water to drain off of the shower chair 1000 and the seat assembly 1015. The angled surfaces may be similar, or identical, to the sloped surfaces described in conjunction with FIGS. 1H and 2 above. In one example, the water may be directed to drain off of the shower chair 1000 in a center of the shower chair 1000 and/or in a direction of a drain. The seat pan 1004 may include a radiused front portion that simultaneously serves a comfort edge for a user and a drainage surface. As illustrated in FIG. 2B, the seat pan 1004 may be sloped, a first slope angle, S1, from the front of the seat assembly 1015 to the rear of the seat assembly 1015. Water draining from the upper surface of the seat pan 1004 may drain off of the seat pan 1004 through the adjust aperture 1011 disposed in the center of the seat pan 1004 and/or at the rear of the seat pan 1004. In some examples, the end of the backrest 1008 that attaches to the rear seat tube 1023B (e.g., the backrest attachment bar) may be sloped, a second slope angle, S2, from the rear of the seat assembly 1015 to the front of the seat assembly 1015. In some examples, water draining from the upper surface of the seat pan 1004 may drain onto the sloped end of the backrest 1008 and drain back toward the front of the seat assembly 1015 under the seat pan 1004. This arrangement of surfaces prevents water from collecting on surfaces of the shower chair 1000 during or after use.

FIG. 11C is a bottom perspective view of the seat assembly 1015 of the shower chair 1000 showing the seatback, or backrest 1008, attachment in accordance with examples of the present disclosure. As provided above, the front seat tube 1023A may include a front crossbar 1028A running a width from a first side to a second side of the seat assembly 1015. The rear seat tube 1023B may include a rear crossbar 1028B running a width from a first side to a second side of the seat assembly 1015. In one example, the front crossbar 1028A may be parallel to the second crossbar 1028B. In some examples, the backrest 1008 may be attached to the underside of the seat pan 1004 or the backrest attachment bar of the rear seat tube 1023B of the shower chair 1000. In one example, the backrest 1008 may be attached by a keyhole 1104 and pin-in-keyhole interface (e.g., via a pin 1108). Among other things, this attachment may allow for the quick attachment or detachment of the backrest 1008 from the seat assembly 1015. According to at least one example of the present disclosure, the shower chair 1000 may be converted between a "chair" configuration and a "stool" configuration by detaching the backrest 1008 from the seat assembly 1013.

Figure 12A:
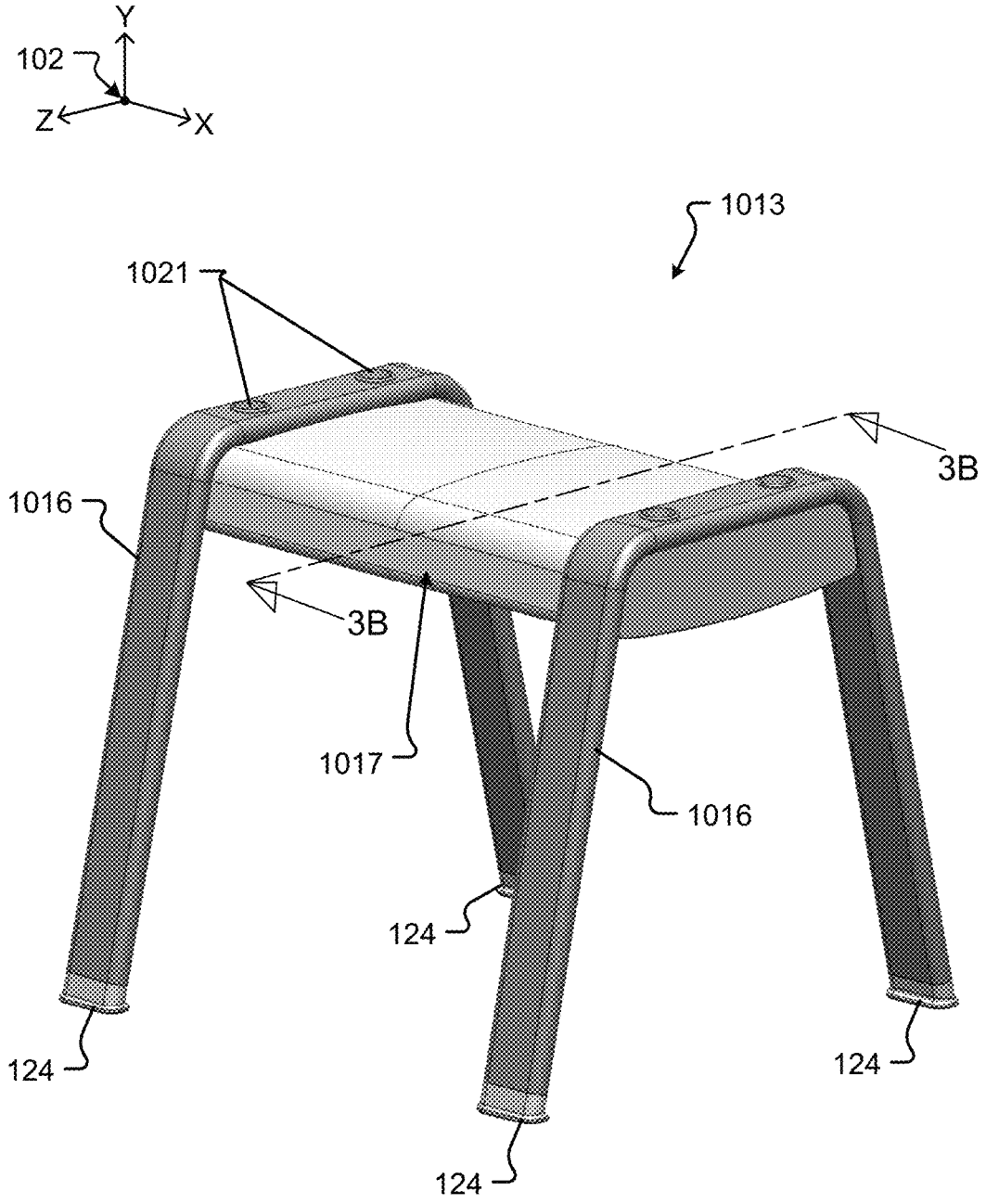
FIG. 12A is a perspective view of the leg assembly of the shower chair in accordance with examples of the present disclosure.
Figure 12B:
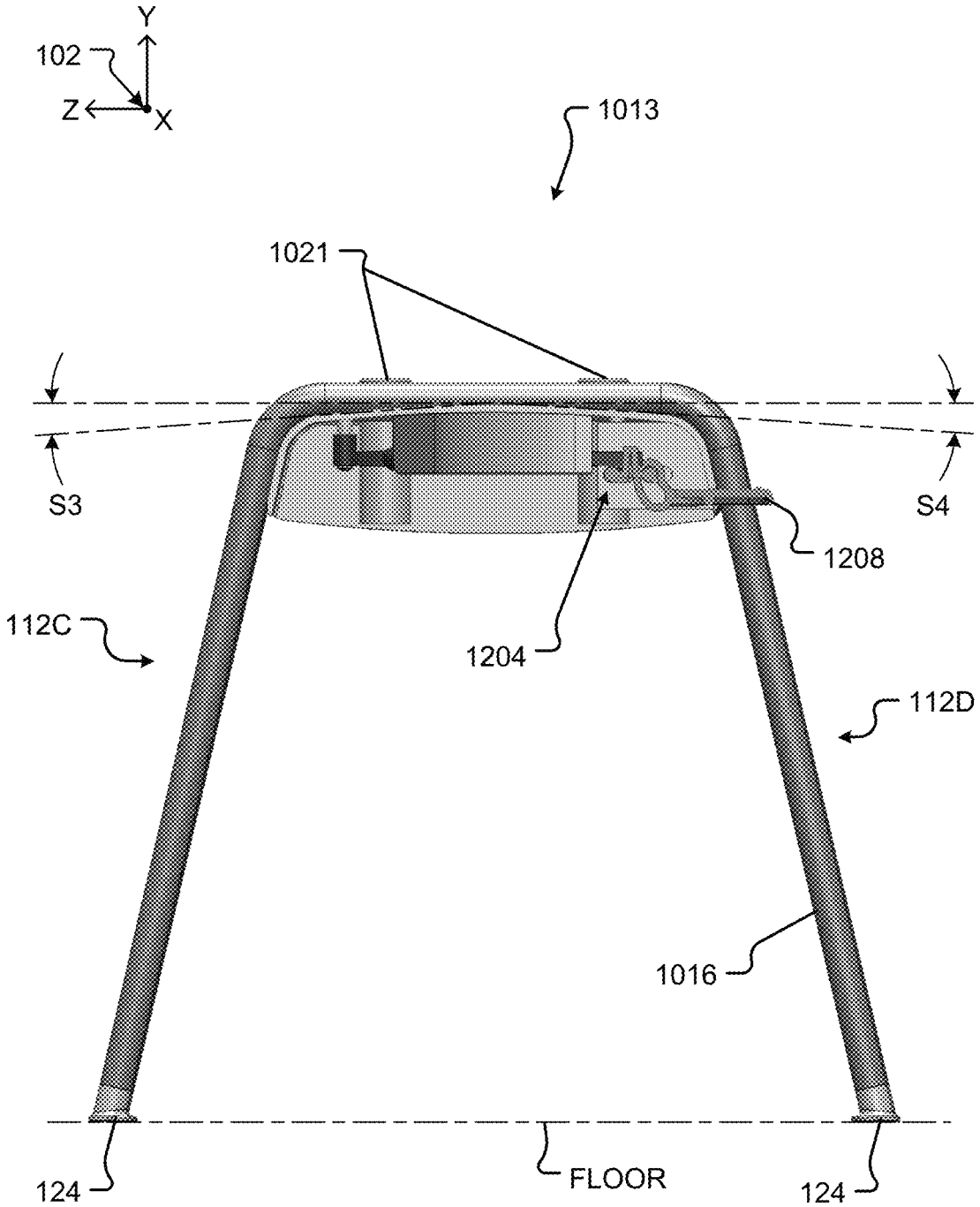
FIG. 12B is a side elevation section view of the leg assembly of FIG. 3A.

FIGS. 12A and 12B show various views of the leg assembly 1013 in accordance with examples of the present disclosure. The leg assembly 1013 may comprise a number of legs extending from a structural beam 1017, or member. In one example, the legs may be part of a first leg frame 1016 and a second leg frame 1016. For instance, each leg frame 1016 may correspond to a length of tubing (e.g., rectangular radiused tubing) that is bent such that the ends of the tubing include a portion disposed in a same plane that is parallel to the floor. At each end of the tubing a foot 124 may be inserted or attached to the leg frame 1016. The leg frames 1016 may be attached, at opposite width sides of the shower chair 1000, to the structural beam 1017. The structural beam 1017 may comprise a molded plastic part that includes a front and rear apron that extends from an upper surface of the structural beam 1017 in a direction toward the floor. The aprons may visually conceal and/or protect an underside of the structural beam 1017. In some examples, the structural beam 1017 may comprise bushings, or plastic tube portions, that receive the vertical posts of the front and rear seat tubes through the seat tube receiving holes 1021.

As shown in the side elevation section view of the leg assembly of FIG. 12B, the structural beam may comprise a front sloped upper surface and a rear sloped upper surface. The front sloped upper surface may slope, a third slope angle, S3, from a center of the leg assembly 1013 toward the front of the leg assembly 1013. In some examples, the rear sloped upper surface of the structural beam may slope, a fourth slope angle, S4, from a center of the leg assembly 1013 toward the rear of the leg assembly 1013. Among other things, these sloped surfaces may allow water to drain away from a center of the leg assembly 1013 toward a front and/or rear of the leg assembly 1013 and then (e.g., along the apron, etc.) toward the floor.

The structural beam 1017, and/or the leg assembly 1013, may comprise a seat-height adjustment mechanism 1204. The seat-height adjustment mechanism 1204 may comprise a number of cables, or bands, contained within respective translation grooves that, when moved via the actuation of a single height adjustment handle 1208, simultaneously retract a series of locking pins from adjust holes 118 disposed in the vertical post portions of the front and rear seat tubes 1023A, 1023B. Additional details of the seat-height adjustment mechanism 1204 are described in conjunction with FIGS. 13A-13E.

Figure 13B:
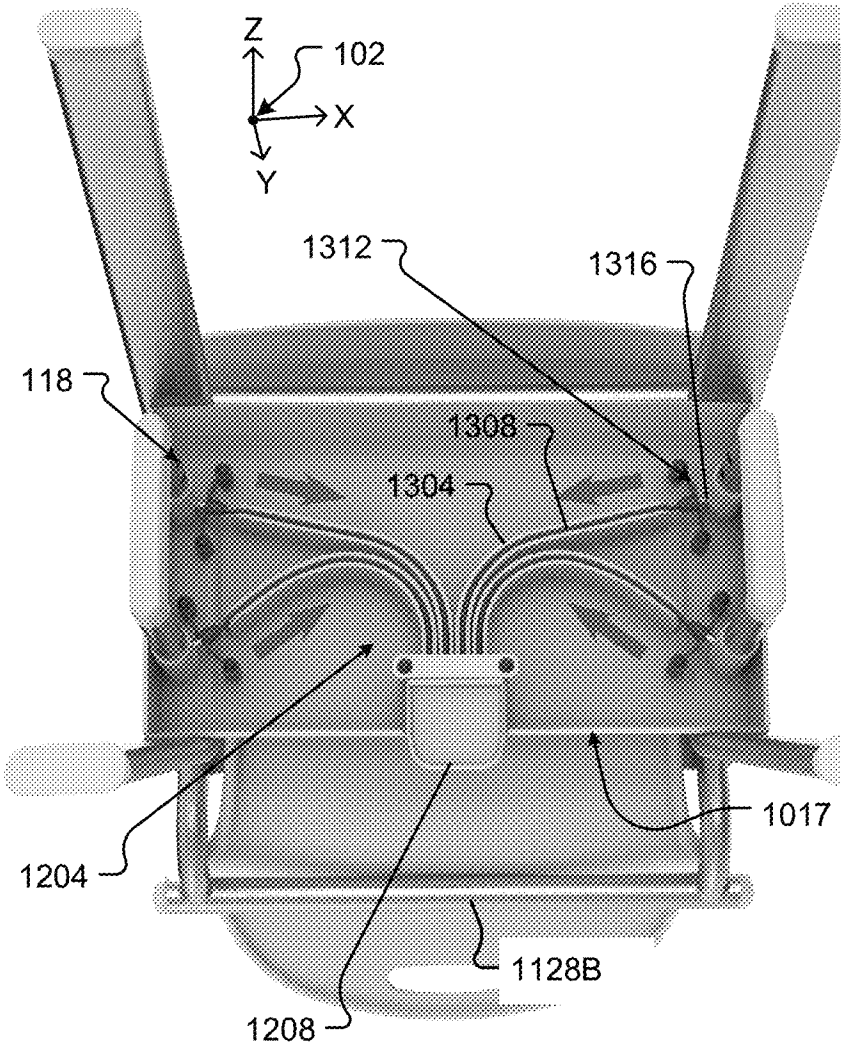
FIG. 13B is a bottom perspective view of the shower chair showing the seat-height adjustment mechanism in accordance with examples of the present disclosure.
Figure 13A:
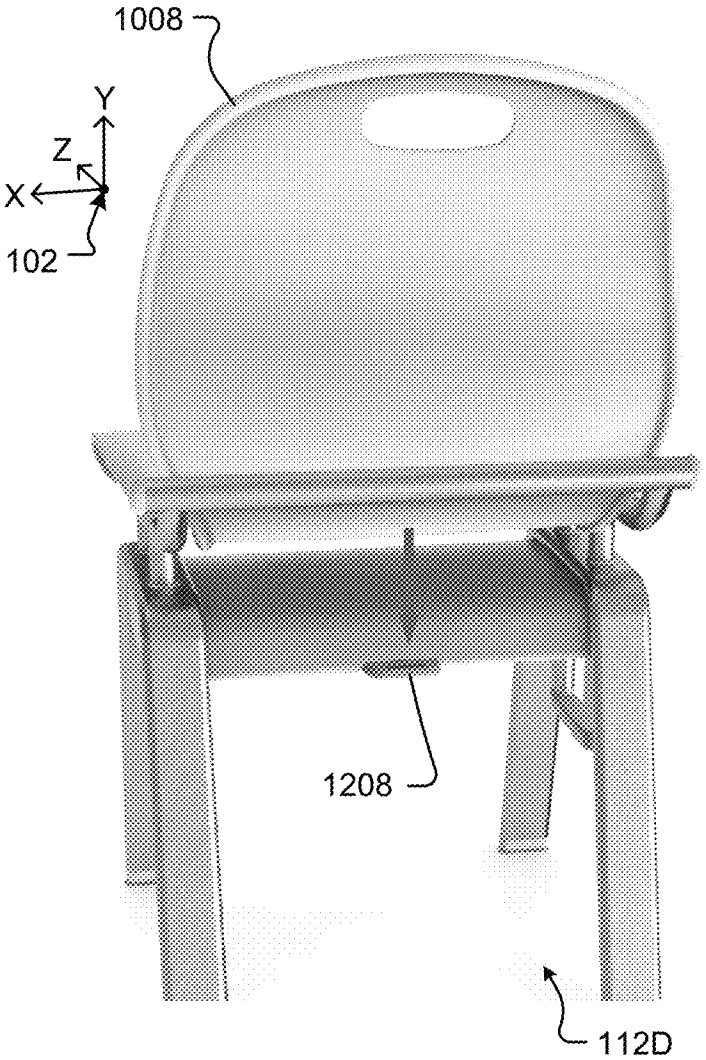
FIG. 13A is a rear perspective view of the shower chair in accordance with examples of the present disclosure.

FIG. 13A shows a rear perspective view of the shower chair 1000 in accordance with examples of the present disclosure. In FIG. 13A, the seat-height adjustment mechanism height adjustment handle 1208 is shown disposed at the rear side 112D of the shower chair 1000. Among other things, positioning the height adjustment handle 1208 at the rear side 112D of the shower chair 1000 allows a user to adjust the seat height of the shower chair 1000 prior to use while preventing accidental contact during use.

FIG. 13B is a bottom perspective view of the shower chair 1000 showing the seat-height adjustment mechanism 1204 in accordance with examples of the present disclosure. As provided above, the seat-height adjustment mechanism 1204 may comprise a number of cables 1308, or bands (e.g., ribbons, etc.), at least partially contained in a number of guides 1304, or translation grooves. The guides 1304 may correspond to a number of channels, grooves, or spaces, between molded portions of the structural beam 1017. The cables 1308 may be able to move within the guides 1304 (e.g., along a length of the guides 1304, etc.) upon actuation of the height adjustment handle 1208. The height adjustment handle 1208 may actuate by pivoting about a mount axis. Each of the cables 1308 may operatively connect to the height adjustment handle 1208 at a first end. The opposite second ends of the cables 1308 may be attached to a respective locking pin 1316. As the height adjustment handle 1208 is actuated (e.g., by applying a force to the end of the height adjustment handle 1208 in a direction toward the floor, etc.), the cables 1308 may simultaneously move, or slide, in a direction along the lengths of the guides 1304 toward the height adjustment handle 1208. This simultaneous movement withdraws the locking pins 1316 from the adjust holes 118 in the seat assembly 1015 allowing the seat-height of the seat assembly 1015 to be adjusted relative to the leg assembly 1013. Upon releasing the height adjustment handle 1208, or applied force, the cables 1308 may move, or slide, in a direction along the lengths of the guides 1304 toward the adjust holes 118 of the seat assembly 1015. This movement biases the locking pins 1316 in a direction toward the adjust holes 118 in the seat assembly 1015. In some examples, the outward biasing of the locking pins 1316 may be provided by a force from a leaf spring, living hinge, or other spring element 1312 in connection with the cables 1308. As illustrated in FIG. 13B, the second end of each cable 1308 is attached to a spring element 1312 at a center thereof. The spring element 1312 may be biased, or preloaded, in a direction of the adjust holes 118. When the seat assembly 1015 is moved along the Y-axis, to adjust a seat height of the shower chair 1000, and at least one set of the adjust holes 118 align with the locking pins 1316, the biased locking pins 1316 may extend into the set of adjust holes 118 locking the position of the seat assembly 1015 relative to the floor and leg assembly 1013. In one example, the cables 1308 may be configured as a series of Bowden cables. In some examples, the cables 1308 may be configured as a number of bands arranged in open grooves 1304. Using open grooves 1304 and bands 1308 allows water to quickly and easily drain from the seat-height adjustment mechanism 1204.

The seat-height adjustment mechanism 1204 provides users with an ergonomic quick-adjust feature for the seat height of the shower chair 1000. For instance, the user is only required to actuate a single height adjustment handle 1208 to withdraw multiple locking pins 1316 used for adjustment. Additionally or alternatively, when the locking pins 1316 are disengaged, the user can grasp the seat pan 1004 by the adjust aperture 1011 to pull, or push, the seat assembly 1015 to a desired seat height and the pins 1316 automatically engage with adjust holes 118 that are aligned with the locking pins 1316. Among other things, this arrangement requires little effort from a user and allows for quick adjustments. In contrast to conventional systems requiring individual ball-detent leg adjustments, for each of four legs (e.g., four individual adjustments), the present disclosure allows a user to make a single actuation of a height adjustment handle 1208 to adjust the seat height of the shower chair 1000.

Figures 13C, 13D, 13E:
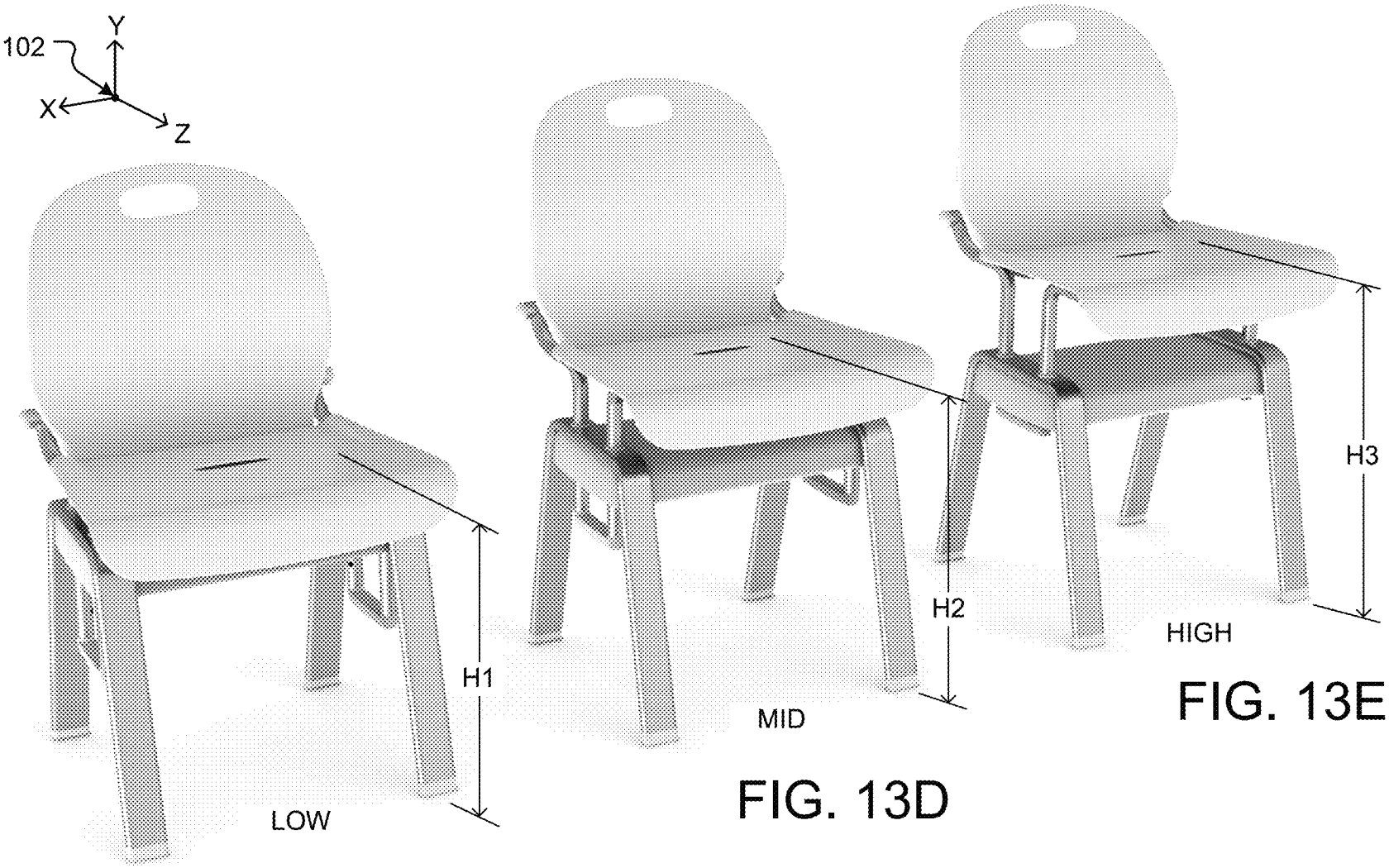
FIG. 13C is a perspective view of the shower chair in a first seat height position in accordance with examples of the present disclosure.
FIG. 13D is a perspective view of the shower chair in a second seat height position in accordance with examples of the present disclosure.
FIG. 13E is a perspective view of the shower chair in a third seat height position in accordance with examples of the present disclosure.

FIGS. 13C-13E show various seat-heights of the shower chair 1000 that can be adjusted using the seat-height adjustment mechanism 1204. The seat-heights, H1-H3 described may correspond to the distance from the upper surface of the seat pan 1004 of the seat assembly 1015 to the floor (or bottom of the foot of the leg assembly 1013). In FIG. 13C, the seat assembly 1015 is shown set in a "low" position, where the first seat-height, H1, is set at a first distance along the Y-axis. In one example, this first distance may be approximately 17 inches. In FIG. 13D, the seat assembly 1015 is shown in a "mid" range position, where the second seat-height, H2, is set at a second distance along the Y-axis. In one example, this second distance may be approximately 19 inches. In FIG. 13E, the seat assembly 1015 is shown set in a "high" position, where the third seat-height, H3, is set at a third distance along the Y-axis. In some examples, this third distance may be approximately 21 inches. As can be appreciated, the distances between adjust holes 118 in the front and rear seat tubes 1023A, 1023B may provide greater adjustment ranges between the first seat-height, H1, and the third seat-height, H3, than shown in FIGS. 13C-13E. For instance, when the distance between adjust holes is 0.5 inches, the seat assembly 1015 may be adjusted relative to the leg assembly 1013 in half-inch increments of adjustment. When the distance between adjust holes is 1 inch, the seat assembly 1015 may be adjusted relative to the leg assembly 1013 in one-inch increments of adjustment along the Y-axis. Other distances between the adjust holes 118 may provide additional variability. The distances between adjacent adjust holes in the adjust holes 118 may be equal along the length of the front and rear seat tubes 1023A, 1023B.

Figure 14A:
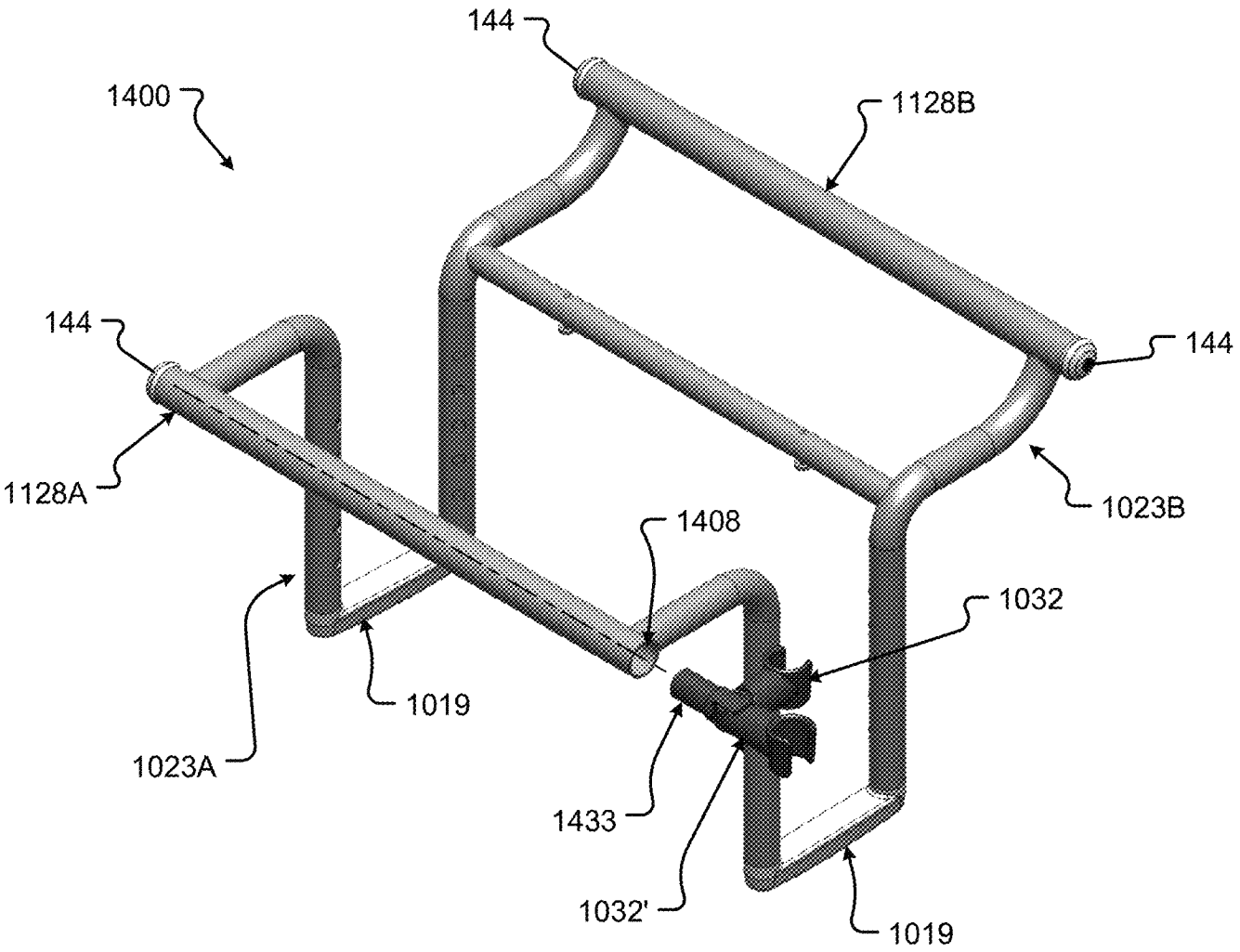
FIG. 14A is an exploded view of the sprayer holder removed from the front crossbar of the seat assembly in accordance with examples of the present disclosure.
Figure 14B:
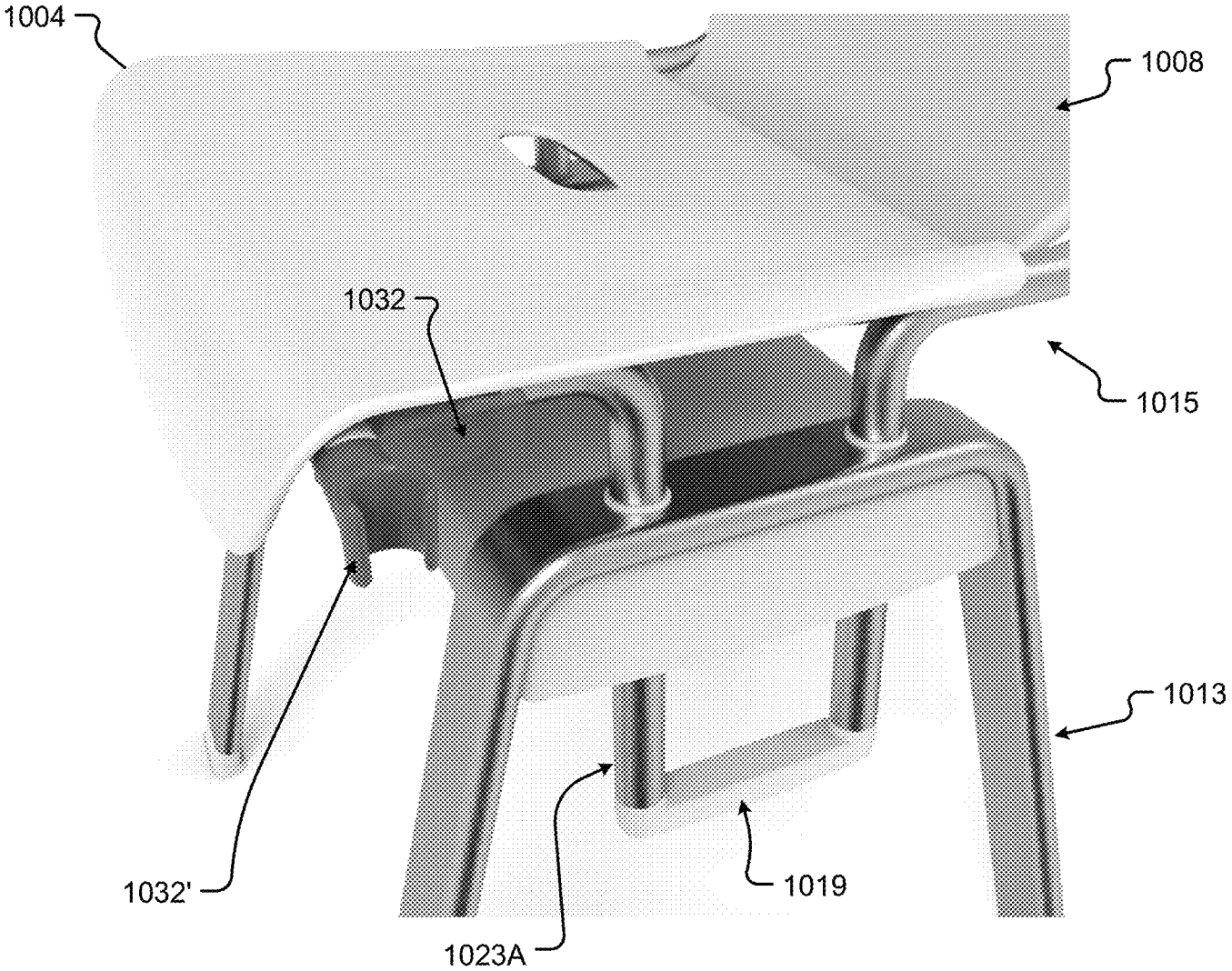
FIG. 14B is a detail perspective view of the sprayer holder in a retracted and extended position when attached to the shower chair in accordance with examples of the present disclosure.

FIGS. 14A and 14B show views of the sprayer holder 1032 of the shower chair 1000. The sprayer holder 1032 may be added to any open tube end of the tubular framework 1400 of the seat assembly 1015 of the shower chair 1000. In one example, the sprayer holder 1032 may comprise a first end 1433 that inserts into an open end 1408 of a tube, or bar (e.g., the front or rear crossbar 1028A, 1028B, etc.), of the tubular framework 1400. As shown in the exploded view of FIG. 14A, the sprayer holder is removed from the tube end 1408 of the front crossbar 1028A of the seat assembly 1015. The first end 1433 of the sprayer holder 1032 in FIG. 14A may be sized having an outer diameter, or peripheral surface circumference, that is less than an inner diameter, or interior circumferential surface, of the front crossbar 1028A. In some examples, the sprayer holder 1032 may be excluded, or removed, from the shower chair 1000. In these cases, the tube end 1408 may be sealed by an end cap 144. The end caps 144 may be at least partially inserted into the tube end 1408 of each open end of the front and/or rear crossbars 1028A, 1028B.

The sprayer holder 1032 may have an extended state 1032' and a retracted state. In the extended state 1032', a second end of the sprayer holder 1032' including a hook, clamp, or finger, may be revealed from beneath the seat pan 1004 of the seat assembly 1015. The hook of the second end may be configured to engage with, retain, grasp, or otherwise hold a shower sprayer handle, hose, or other portion. In the retracted state, the second end of the sprayer holder 1032 may be concealed beneath the seat pan 1004 of the seat assembly 1015. The second end may pivot relative to the first end 1433 about a joint, or knuckle, disposed along the length of the sprayer holder 1032 running from the first end 1433 to the second end.

FIG. 14B shows a detail perspective view of a side of the shower chair 1000 with the sprayer holder 1032 in an extended state 1032' and in a retracted state 1032 in accordance with examples of the present disclosure. As illustrated in FIG. 14B, when in the extended state 1032', or position, the second end of the sprayer holder 1032' extends from the underside of the seat pan 1004. When in the retracted state 1032, or position, the second end of the sprayer holder 1032 is at least partially concealed under the seat pan 1004.

Figure 15C:
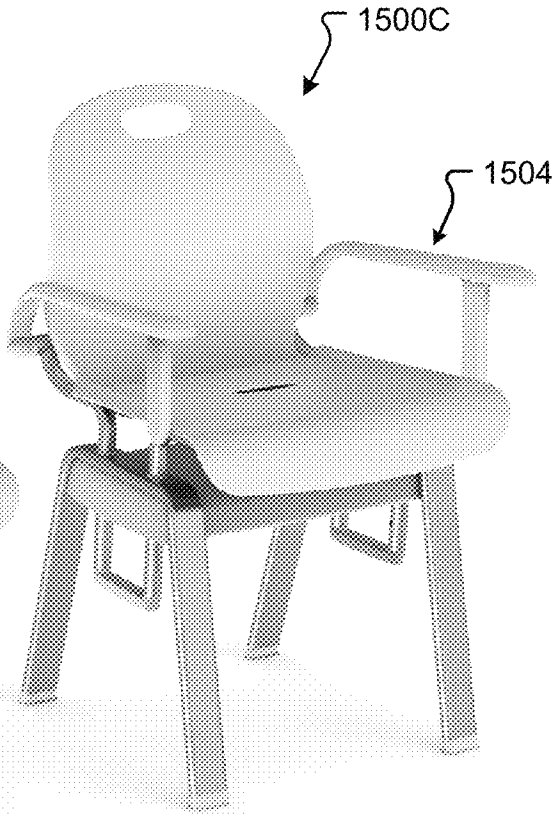
FIG. 15C is a perspective view of an armchair configuration of the shower chair in accordance with examples of the present disclosure.
Figure 15B:
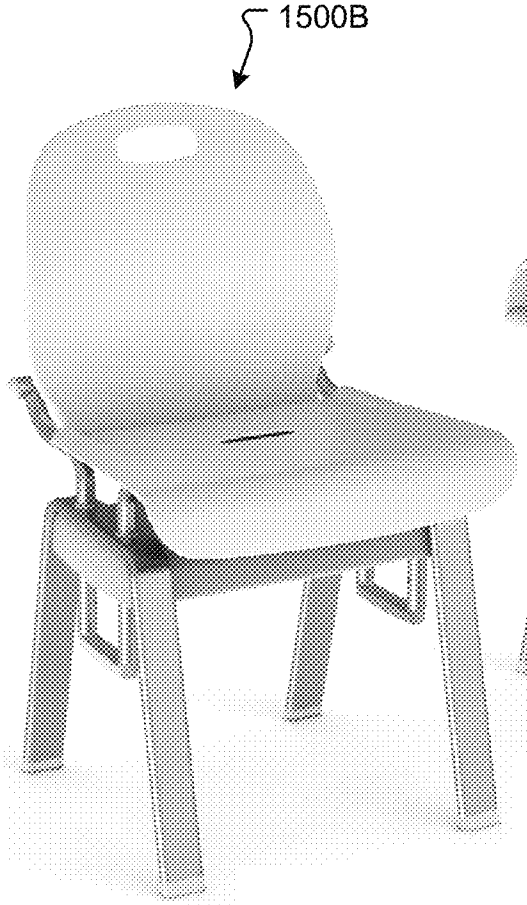
FIG. 15B is a perspective view of a chair configuration of the shower chair in accordance with examples of the present disclosure.
Figure 15A:
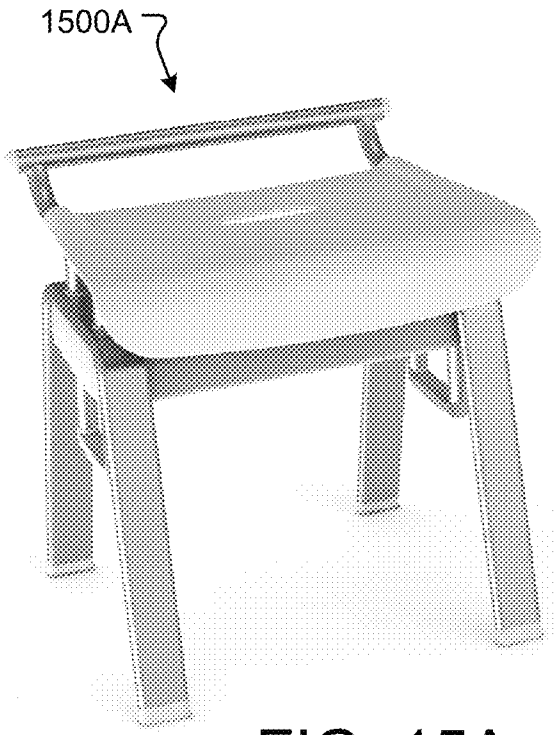
FIG. 15A is a perspective view of a stool configuration of the shower chair in accordance with examples of the present disclosure.
Figure 16B:
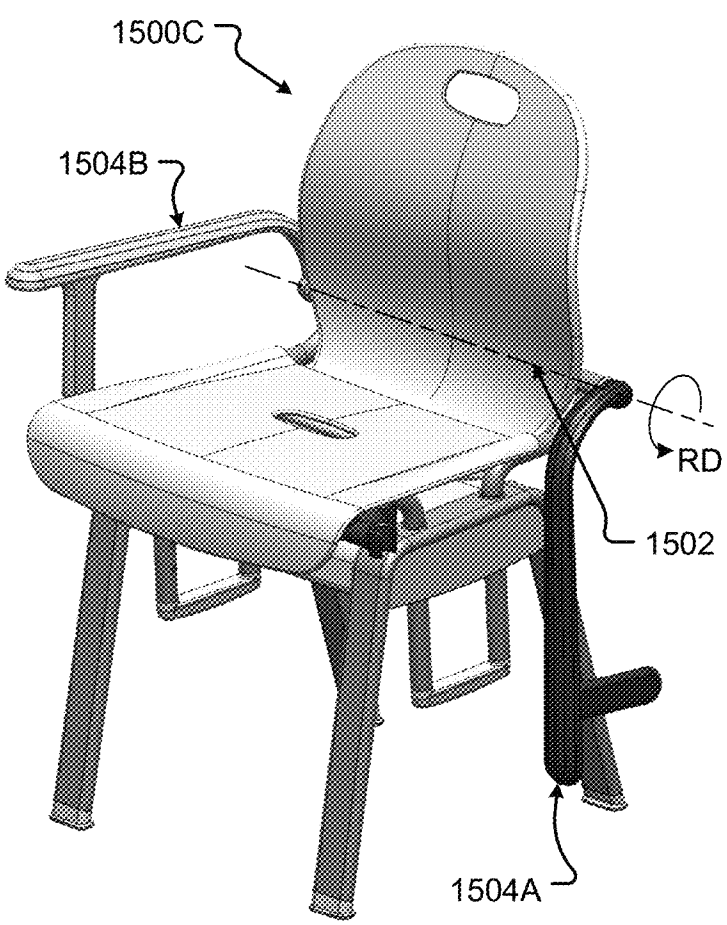
FIG. 16B is a perspective view of the armchair configuration of the shower chair with a first armrest shown in a rotated down clearance position in accordance with examples of the present disclosure.

FIGS. 15A-15C show various configurations of the shower chair 1000 in accordance with examples of the present disclosure. FIG. 15A shows a perspective view of a stool configuration 1500A of the shower chair 1000. In the stool configuration 1500A, the shower chair 1000 excludes the backrest 1008 and armrests 1504. In FIG. 16B, the chair configuration 1500B of the shower chair 1000 is shown in accordance with examples of the present disclosure. The chair configuration 1500B of the shower chair 1000 includes the backrest 1008, but excludes armrests 1504. FIG. 15C shows a perspective view of an armchair configuration 1500C of the shower chair 1000 in accordance with examples of the present disclosure. The armchair configuration 1500C may include the backrest 1008 as well as one or more armrests 1504.

Figure 16A:
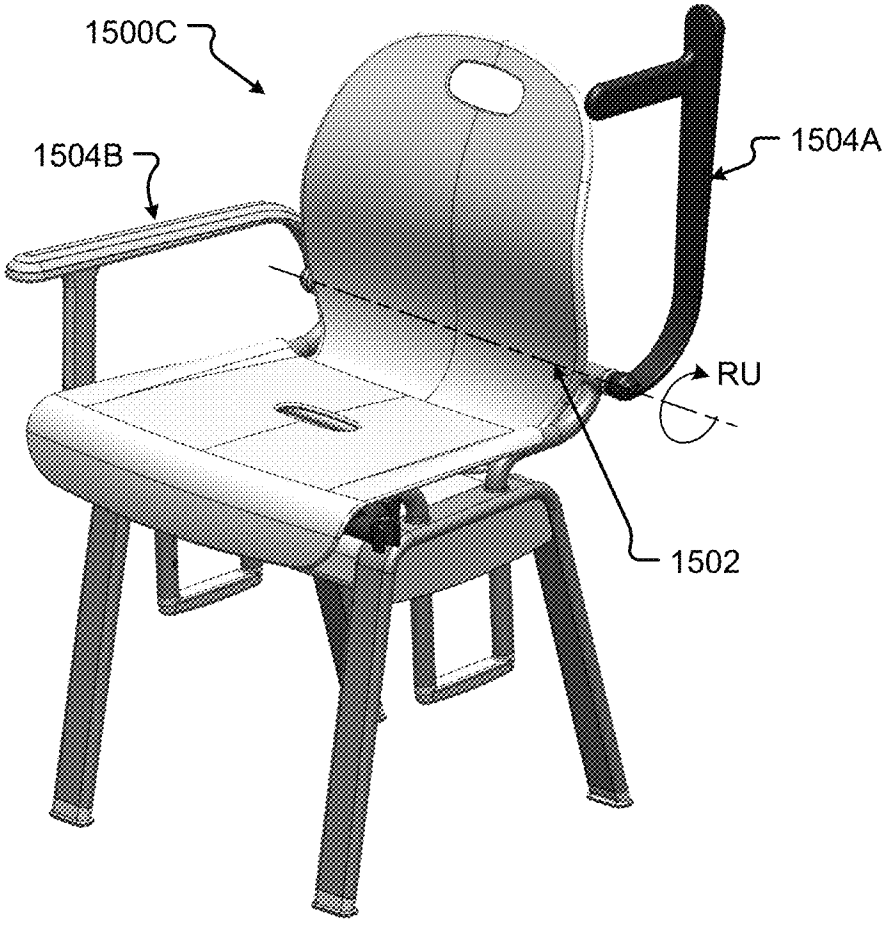
FIG. 16A is a perspective view of the armchair configuration of the shower chair with a first armrest in a rotated up clearance position in accordance with examples of the present disclosure.

FIGS. 16A-16B show examples of the shower chair 1000 with moveable armrests 1504A, 1504B. Although the figures show a single armrest 1504A that moves to provide access to the shower chair 1000 from a side thereof, it should be appreciated that each armrest 1504A, 1504B may move to provide access from either side of the shower chair 1000. The first and second armrests 1504A, 1504B may move independently as shown or together as a single unit. The first and second armrests 1504A, 1504B may be operatively attached (e.g., at least partially inserted into) the rear crossbar 1028B of the seat assembly 1015. For instance, the end caps 144 may be removed from the rear crossbar 1028B and the armrest assembly 1504 may be inserted into the open tube end of the rear crossbar 1028B. The armrest assembly 1504 may comprise a bearing assembly, bushing, or other rotational device that allows rotation of the armrest relative to the seat assembly 1015 and/or the leg assembly 1013.

FIG. 16A shows a perspective view of the armchair configuration 1500C of the shower chair 1000 with a first armrest 1504A in a "rotated up" clearance position in accordance with examples of the present disclosure. In FIG. 16A, the first armrest 1504A is rotated clockwise about the rear crossbar axis 1502 to provide clearance to the shower chair 1000 from a side other than the front side 112C of the shower chair 1000. This clearance may provide access when a user is ready to seat, ready to stand, and/or while cleaning their torso, etc.

In some examples, the first armrest 1504A may be rotated toward the floor to provide clearance to the shower chair 1000. For example, FIG. 16B shows a perspective view of the armchair configuration 1500C of the shower chair 1000 with the first armrest 1504A shown in a "rotated down" clearance position in accordance with examples of the present disclosure. In FIG. 16B, the first armrest 1504A is rotated counterclockwise about the rear crossbar axis 1502 to provide clearance to the shower chair 1000 from a side other than the front side of the shower chair 1000. This rotation may allow a seated user to move the first armrest 1504A toward the floor without stretching upwardly. Prior to seating, the clearance may provide access for a user to enter the wash area and seat without obstruction.

The exemplary systems and methods of this disclosure have been described in relation to shower chairs. However, to avoid unnecessarily obscuring the present disclosure, the preceding description omits a number of known structures and devices. This omission is not to be construed as a limitation of the scope of the claimed disclosure. Specific details are set forth to provide an understanding of the present disclosure. It should, however, be appreciated that the present disclosure may be practiced in a variety of ways beyond the specific detail set forth herein.

A number of implementations have been described. Nevertheless, it will be understood that additional modifications may be made without departing from the scope of the inventive concepts described herein, and, accordingly, other examples are within the scope of the following claims.

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more examples, configurations, or aspects for the purpose of streamlining the disclosure. The features of the examples, configurations, or aspects of the disclosure may be combined in alternate examples, configurations, or aspects other than those discussed above. This method of disclosure is not to be interpreted as reflecting an intention that the claimed disclosure requires more features than are expressly recited in each claim. Rather, as the following claims reflect, inventive aspects lie in less than all features of a single foregoing disclosed example, configuration, or aspect. Thus, the following claims are hereby incorporated into this Detailed Description, with each claim standing on its own as a separate preferred example of the disclosure.

Moreover, though the description of the disclosure has included description of one or more examples, configurations, or aspects and certain variations and modifications, other variations, combinations, and modifications are within the scope of the disclosure, e.g., as may be within the skill and knowledge of those in the art, after understanding the present disclosure. It is intended to obtain rights, which include alternative examples, configurations, or aspects to the extent permitted, including alternate, interchangeable and/or equivalent structures, functions, ranges, or steps to those claimed, whether or not such alternate, interchangeable and/or equivalent structures, functions, ranges, or steps are disclosed herein, and without intending to publicly dedicate any patentable subject matter.

It is to be appreciated that any feature described herein can be claimed in combination with any other feature(s) as described herein, regardless of whether the features come from the same described example or aspect.

As used herein, the singular forms "a," "an," and "the" are intended to include the plural forms as well, unless the context clearly indicates otherwise. It will be further understood that the terms "include," "including," "includes," "comprise," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. The term "and/or" includes any and all combinations of one or more of the associated listed items.

The term "a" or "an" entity refers to one or more of that entity. As such, the terms "a" (or "an"), "one or more," and "at least one" can be used interchangeably herein. It is also to be noted that the terms "comprising," "including," and "having" can be used interchangeably.

The phrases "at least one," "one or more," "or," and "and/or" are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B, and C together. When each one of A, B, and C in the above expressions refers to an element, such as X, Y, and Z, or a class of elements, such as X1-Xn, Y1-Ym, and Z1-Zo, the phrase is intended to refer to a single element selected from X, Y, and Z, a combination of elements selected from the same class (e.g., X1 and X2) as well as a combination of elements selected from two or more classes (e.g., Y1 and Zo).

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and this disclosure.

It should be understood that every maximum numerical limitation given throughout this disclosure is deemed to include each and every lower numerical limitation as an alternative, as if such lower numerical limitations were expressly written herein. Every minimum numerical limitation given throughout this disclosure is deemed to include each and every higher numerical limitation as an alternative, as if such higher numerical limitations were expressly written herein. Every numerical range given throughout this disclosure is deemed to include each and every narrower numerical range that falls within such broader numerical range, as if such narrower numerical ranges were all expressly written herein.

What is claimed is:

1. A shower chair, comprising:

a leg assembly;

a seat pan comprising a seating side and a frame attachment side disposed opposite the seating side, wherein a portion of the seat pan on the frame attachment side is connected to a first portion of the leg assembly; and a backrest comprising a first end detachably connected to a second portion of the leg assembly, the backrest offset a distance from the seat pan on the frame attachment side and extending from the second portion of the leg assembly past the seating side of the seat pan toward a second end of the backrest disposed at a rear of the shower chair, wherein a first gap is disposed between the seat pan at the backrest providing a water flow path for the shower chair.

2. The shower chair of claim 1, wherein the first end of the backrest comprises a tear-drop shaped cross-section.

3. The shower chair of claim 1, wherein the seat pan comprises a sloped surface angled downward from a first point at a front of the shower chair to a second point at the rear of the shower chair.

4. The shower chair of claim 3, wherein the backrest comprises a sloped arcuate surface disposed adjacent the first end and angled downward from the rear of the shower chair toward the front of the shower chair.

5. The shower chair of claim 4, wherein at least one of the seat pan or the backrest additionally slopes from an outer width of the shower chair toward a centerline of the shower chair.

6. The shower chair of claim 4, wherein a second gap is disposed between the first end of the backrest and a lower support crossbar of the leg assembly.

7. The shower chair of claim 6, wherein the first gap, the second gap, the sloped surface of the seat pan, and the sloped arcuate surface of the backrest define an unrestricted water flow path for the shower chair running from the seat pan at the front of the shower chair toward the rear of the shower chair and then from the backrest at the rear of the shower chair toward the front of the shower chair in a space between the seat pan and the first end of the backrest.

8. The shower chair of claim 7, wherein the leg assembly, comprises:

a first leg frame disposed on a first side of the shower chair; and a second leg frame disposed on a second side of the shower chair opposite the first side, the second leg frame spaced apart a width from the first leg frame, wherein the first leg frame and the second leg frame each comprise a front leg tube and a rear leg tube and a seat contact tube joining the front leg tube to the rear leg tube, and wherein the first leg frame and the second leg frame each comprise a tube joined with and extending from the rear leg tube, in a direction away from the front leg tube, wherein the lower support crossbar is connected to a bottom surface of the seat contact tube of the first leg frame and the second leg frame and spanning the width.

9. The shower chair of claim 8, wherein a portion of a rear surface of the backrest contacts an upper support crossbar disposed at a point between the seating side of the seat pan and the second end of the backrest disposed at the rear of the shower chair, wherein the backrest comprises at least one mount hook that hooks onto the upper support crossbar, and wherein the first end detachably connected to the lower support crossbar is attached via at least one fastener.

10. A shower chair, comprising:

a leg assembly;

a seat pan comprising a seating side and a frame attachment side disposed opposite the seating side, wherein a portion of the seat pan on the frame attachment side is connected to a first portion of the leg assembly; and a backrest comprising a first end detachably connected to a second portion of the leg assembly, the backrest offset a distance from the seat pan on the frame attachment side and extending from the second portion of the leg assembly past the seating side of the seat pan toward a second end of the backrest disposed at a rear of the shower chair, wherein a first gap is disposed between the seat pan at the backrest providing a water flow path for the shower chair and a second gap is disposed between the first end of the backrest and a lower support crossbar of the leg assembly.

11. The shower chair of claim 10, wherein the first end of the backrest comprises a tear-drop shaped cross-section.

12. The shower chair of claim 10, wherein the seat pan comprises a sloped surface angled downward from a first point at a front of the shower chair to a second point at the rear of the shower chair.

13. The shower chair of claim 12, wherein the backrest comprises a sloped arcuate surface disposed adjacent the first end and angled downward from the rear of the shower chair toward the front of the shower chair under a portion of the seat pan.

14. The shower chair of claim 13, wherein at least one of the seat pan or the backrest additionally slopes from an outer width of the shower chair toward a centerline of the shower chair.

15. The shower chair of claim 13, wherein the first gap, the second gap, the sloped surface of the seat pan, and the sloped arcuate surface of the backrest define an unrestricted water flow path for the shower chair running from the seat pan at the front of the shower chair toward the rear of the shower chair and then from the backrest at the rear of the shower chair toward the front of the shower chair in a space between the seat pan and the first end of the backrest.

16. The shower chair of claim 15, wherein the leg assembly, comprises:

a first leg frame disposed on a first side of the shower chair; and a second leg frame disposed on a second side of the shower chair opposite the first side, the second leg frame spaced apart a width from the first leg frame, wherein the first leg frame and the second leg frame each comprise a front leg tube and a rear leg tube and a seat contact tube joining the front leg tube to the rear leg tube, and wherein the first leg frame and the second leg frame each comprise a tube joined with and extending from the rear leg tube, in a direction away from the front leg tube, wherein the lower support crossbar is connected to a bottom surface of the seat contact tube of the first leg frame and the second leg frame and spanning the width.

17. The shower chair of claim 16, wherein a portion of a rear surface of the backrest contacts an upper support crossbar disposed at a point between the seating side of the seat pan and the second end of the backrest disposed at the rear of the shower chair, wherein the backrest comprises at least one mount hook that hooks onto the upper support crossbar, and wherein the first end detachably connected to the lower support crossbar is attached via at least one fastener.

18. A shower chair, comprising:

a leg assembly;

a seat pan comprising a seating side and a frame attachment side disposed opposite the seating side, wherein a portion of the seat pan on the frame attachment side is connected to a first portion of the leg assembly, wherein the seat pan comprises a sloped surface angled downward from a first point at a front of the shower chair to a second point at a rear of the shower chair; and a backrest comprising a first end detachably connected to a second portion of the leg assembly, the backrest offset a distance from the seat pan on the frame attachment side and extending from the second portion of the leg assembly past the seating side of the seat pan toward a second end of the backrest disposed at a rear of the shower chair, wherein the backrest comprises a sloped arcuate surface disposed adjacent the first end and angled downward from the rear of the shower chair toward the front of the shower chair, wherein a first gap is disposed between the seat pan at the backrest and a second gap is disposed between the first end of the backrest and a lower support crossbar of the leg assembly, and wherein the first gap, the second gap, the sloped surface of the seat pan and the sloped arcuate surface of the backrest define an unrestricted water flow path for the shower chair running from the seat pan at the front of the shower chair toward the rear of the shower chair and then from the backrest at the rear of the shower chair toward the front of the shower chair in a space between the seat pan and the first end of the backrest.

19. The shower chair of claim 18, wherein at least one of the seat pan or the backrest additionally slopes from an outer width of the shower chair toward a centerline of the shower chair.

20. The shower chair of claim 18, wherein the first end of the backrest comprises a tear-drop shaped cross-section, and wherein the first end is arranged under a portion of the seat pan.

* * * * *